US008570351B2

(12) United States Patent
Mori et al.

(10) Patent No.: US 8,570,351 B2
(45) Date of Patent: Oct. 29, 2013

(54) LIQUID CRYSTAL DISPLAY DEVICE

(75) Inventors: Tomohiko Mori, Osaka (JP); Kazunari Tomizawa, Osaka (JP); Yuichi Yoshida, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 311 days.

(21) Appl. No.: 13/142,041

(22) PCT Filed: Dec. 25, 2009

(86) PCT No.: PCT/JP2009/007233

§ 371 (c)(1),
(2), (4) Date: Jun. 24, 2011

(87) PCT Pub. No.: WO2010/073693

PCT Pub. Date: Jul. 1, 2010

(65) Prior Publication Data

US 2011/0254759 A1 Oct. 20, 2011

(30) Foreign Application Priority Data

Dec. 26, 2008 (JP) ..... 2008-335246
Jun. 1, 2009 (JP) ..... 2009-132500

(51) Int. Cl.
*G09G 5/10* (2006.01)
*G09G 3/36* (2006.01)

(52) U.S. Cl.
USPC ..... 345/690; 345/88

(58) Field of Classification Search
None
See application file for complete search history.

(56) References Cited

U.S. PATENT DOCUMENTS

| | | | |
|---|---|---|---|
| 4,800,375 | A | 1/1989 | Silverstein et al. |
| 6,661,488 | B1 | 12/2003 | Takeda et al. |
| 6,801,220 | B2 | 10/2004 | Greier et al. |
| 6,958,791 | B2 | 10/2005 | Shimoshikiryo |
| 7,034,789 | B2 | 4/2006 | Takeuchi et al. |
| 7,145,624 | B2 | 12/2006 | Kubo et al. |

(Continued)

FOREIGN PATENT DOCUMENTS

| | | | |
|---|---|---|---|
| JP | 09-251160 | A | 9/1997 |
| JP | 11-242225 | A | 9/1999 |

(Continued)

OTHER PUBLICATIONS

English translation of Official Communication issued in corresponding International Application PCT/JP2009/007233, mailed on Aug. 25, 2011.

(Continued)

*Primary Examiner* — Nicholas Lee
(74) *Attorney, Agent, or Firm* — Keating & Bennett, LLP

(57) ABSTRACT

A liquid crystal display device (100) according to the present invention includes pixels (P1) and (P2), each of which includes three subpixels (R1, G1, B1) and (R2, G2, B2). When the input signal indicates that a chromatic color should be represented, one of the subpixels (B1 and B2) is turned ON and at least one of the subpixels (R1, R2, G1 and G2) is turned ON, too. If the average luminance of the subpixels (B1 and B2) in a situation where the input signal indicates that the chromatic color should be represented is substantially equal to that of the subpixels (B1 and B2) in another situation where the input signal indicates that an achromatic color should be represented, the luminances of those subpixels (B1 and B2) in the former situation are different from those of the subpixels (B1 and B2) in the latter situation.

16 Claims, 44 Drawing Sheets

(56) References Cited

U.S. PATENT DOCUMENTS

| | | | |
|---|---|---|---|
| 2003/0146893 | A1 | 8/2003 | Sawabe |
| 2004/0174389 | A1 | 9/2004 | Ben-David et al. |
| 2004/0239698 | A1 | 12/2004 | Kamada et al. |
| 2005/0122294 | A1 | 6/2005 | Ben-David et al. |
| 2006/0164352 | A1 | 7/2006 | Yoo et al. |
| 2008/0036718 | A1 | 2/2008 | Lee |
| 2009/0167657 | A1 | 7/2009 | Tomizawa |

FOREIGN PATENT DOCUMENTS

| | | | |
|---|---|---|---|
| JP | 2001-209047 | A | 8/2001 |
| JP | 2001-306023 | A | 11/2001 |
| JP | 2003-043525 | A | 2/2003 |
| JP | 2003-255908 | A | 9/2003 |
| JP | 2004-062146 | A | 2/2004 |
| JP | 2004-078157 | A | 3/2004 |
| JP | 2004-525402 | A | 8/2004 |
| JP | 2006-209135 | A | 8/2006 |
| JP | 2007-226242 | A | 9/2007 |
| WO | WO 2007052381 | A1 * | 5/2007 |
| WO | 2007/097080 | A1 | 8/2007 |
| WO | WO 2008090845 | A1 * | 7/2008 |

OTHER PUBLICATIONS

Official Communication issued in International Patent Application No. PCT/JP2009/007233, mailed on Apr. 6, 2010.

Yang et al.; "31.1: Development of Six Primary-Color LCD"; Society for Information Display, 2005 International Symposium Digest of Technical Papers; vol. XXXVI; Book II; May 25-27, 2005; pp. 1210-1213.

Chino et al.; "25.1: Invited Paper: Development of Wide-Color-Gamut Mobile Displays With Four-Primary-Color LCDS"; Society for Information Display, 2006 International Symposium Digest of Technical Papers; vol. XXXVII, Book II; Jun. 7-9, 2006; pp. 1221-1224.

Ben-Chorin; "Improving LCD TV Color Using Multi-Primary Technology"; FPD International 2005 Forum; Oct. 19, 2005; 66 pages.

Official Communication issued in corresponding European Patent Application No. 09834499.7, mailed on Jul. 3, 2012.

* cited by examiner (a)

(b)

(a)

(b)

(a)

(b)

(c)

(a)

(b)

(c)

(a)

(b)

(a)

(b)

(c)

(a)

(b)

(c)

(a)

(b)

(c)

(a)

(b)

(a)

(b)

(a)

(b)

(a)

(b)

(a)

(b)

(a)

(b)

(c)

(a)

(b)

(c)

(a)

(b)

LIQUID CRYSTAL DISPLAY DEVICE

TECHNICAL FIELD

The present invention relates to a liquid crystal display device.

BACKGROUND ART

Liquid crystal displays (LCDs) have been used in not only TV sets with a big screen but also small display devices such as the monitor screen of a cellphone. In an LCD, one pixel consists of three subpixels representing red (R), green (G) and blue (B) that are the three primary colors of light, and the difference in color between those red, green and blue subpixels is typically produced by color filters.

TN (twisted nematic) mode LCDs, which would often be used in the past, achieved relatively narrow viewing angles, but LCDs of various other modes with wider viewing angles have recently been developed one after another. Examples of those wider viewing angle modes include IPS (in-plane switching) mode and VA (vertical alignment) mode. Among those wide viewing angle modes, the VA mode is adopted in a lot of LCDs because the VA mode would achieve a sufficiently high contrast ratio.

When viewed obliquely, however, the VA mode LCD sometimes produces grayscale inversion. Thus, to minimize such grayscale inversion, an MVA (multi-domain vertical alignment) mode in which multiple liquid crystal domains are defined within a single pixel region is adopted. In an MVA mode LCD, an alignment control structure is provided for at least one of the two substrates, which face each other with a vertical alignment liquid crystal layer interposed between them, so that the alignment control structure contacts with the liquid crystal layer. As the alignment control structure, a linear slit (opening) of an electrode or a rib (projection) may be used, thereby applying anchoring force to the liquid crystal layer from one or both sides thereof. In this manner, multiple (typically four) liquid crystal domains with multiple different alignment directions are defined, thereby minimizing the grayscale inversion.

Also known as another kind of VA mode is a CPA (continuous pinwheel alignment) mode. In a normal CPA mode LCD, its subpixel electrodes have a highly symmetric shape and either an opening or a projection (which is sometimes called a "rivet") is arranged on the surface of the counter substrate in contact with the liquid crystal layer so as to be aligned with the center of a liquid crystal domain. When a voltage is applied, an oblique electric field is generated by the counter electrode and the highly symmetric subpixel electrode and induces radially tilted alignments of liquid crystal molecules. Also, with a rivet provided, the alignment control force of the slope of the rivet stabilizes the tilted alignments of the liquid crystal molecules. As the liquid crystal molecules are radially aligned within a single subpixel in this manner, the grayscale inversion can be minimized.

However, when viewed obliquely, the image displayed on a VA mode LCD will look more whitish as a whole than when viewed straight on (see Patent Document No. 1), which is called a "whitening" phenomenon. In the LCD disclosed in Patent Document No. 1, each subpixel, representing an associated one of the three primary colors of red, green and blue, has multiple regions with mutually different luminances, thereby reducing such a whitening phenomenon when the screen is viewed obliquely and improving the viewing angle characteristic. More specifically, in the LCD disclosed in Patent Document No. 1, electrodes provided for those regions of each subpixel are connected to mutually different data lines (source bus lines) by way of respectively different TFTs. The LCD of Patent Document No. 1 makes the potentials at the electrodes provided for those regions of each subpixel different from each other, thereby making those regions of each subpixel have different luminances and attempting to improve the viewing angle characteristic.

Also, even in a situation where an achromatic color is being displayed at a middle grayscale, the chromaticity may also look different depending on whether the screen is viewed straight on or obliquely (see Patent Document No. 2, for example). In the LCD disclosed in Patent Document No. 2, in a low-luminance region of each of red, green and blue subpixels, the transmittance is caused to vary in the same way as a low-grayscale level does, thereby reducing the variation in chromaticity when an achromatic color is displayed.

Nevertheless, to make those regions of each subpixel have mutually different luminances, fine electrodes should be provided for those regions of each subpixel, thus increasing the cost and sometimes resulting in a decreased yield. But a TN mode LCD can be made at a lower cost than a VA mode LCD. That is why somebody proposed that the viewing angle characteristic of a TN mode LCD could be improved even without providing multiple electrodes for each subpixel (see Patent Document No. 3, for example). Specifically, in the LCD disclosed in Patent Document No. 3, if two subpixels, which are two adjacent portions to receive the same input signal one after the other, have middle grayscale levels, then the viewing angle characteristic could be improved by setting the grayscale level of one of the two subpixels to be relatively high and that of the other subpixel to be relatively low, respectively. Specifically, supposing such two subpixels, which receive the same input signal one after the other, have middle grayscale levels A and B and the average (=L(A)+L(B)/2) of their luminances L(A) and L(B) is identified by L(X), a grayscale level X associated with that average luminance L(X) is obtained and then relatively high and low grayscale levels A' and B' that achieve the luminance L(X) of the grayscale level X are obtained. In this manner, the LCD disclosed in Patent Document No. 3 corrects the grayscale levels A and B represented by the input signal into grayscale levels A' and B', thereby attempting to improve the viewing angle characteristic without providing any such fine electrodes for each subpixel electrode.

CITATION LIST

Patent Literature

Patent Document No. 1: Japanese Patent Application Laid-Open Publication No. 2006-209135

Patent Document No. 2: Japanese Patent Application Laid-Open Publication No. 2007-226242

Patent Document No. 3: PCT International Application Japanese National-Phase Publication No. 2004-525402

SUMMARY OF INVENTION

Technical Problem

All of the LCDs disclosed in these Patent Document Nos. 1 to 3 attempt to improve the viewing angle characteristic. Generally speaking, however, even if the difference in chromaticity according to the viewing angle can be decreased significantly when an achromatic color is displayed, there can still be a significant difference in chromaticity depending on whether the screen is viewed obliquely or straight on, when a chromatic color is displayed. Such a difference in chromaticity according to the viewing angle is also called a "color shift". If the color shift is significant, then the display quality will decline.

It is therefore an object of the present invention to provide a liquid crystal display device that can improve the viewing angle characteristic, and minimize the color shift, when the screen is viewed obliquely.

Solution to Problem

A liquid crystal device according to the present invention has multiple pixels including first and second pixels that are arranged adjacent to each other. Each of the pixels includes a number of subpixels including first, second and third subpixels. If an input signal indicates that each of the first and second pixels should represent a particular chromatic color, not only the third subpixel of at least one of the first and second pixels but also at least one of the respective first and second subpixels of the first and second pixels turn ON. If the average luminance of the respective third subpixels of the first and second pixels in one situation where the input signal indicates that each of the first and second pixels should represent the chromatic color is substantially equal to that of the respective third subpixels of the first and second pixels in another situation where the input signal indicates that each of the first and second pixels should represent an achromatic color, the luminances of the respective third subpixels of the first and second pixels in the former situation are different from those of the respective third subpixels of the first and second pixels in the latter situation.

In one preferred embodiment, the first, second and third subpixels are red, green and blue subpixels, respectively.

In another preferred embodiment, if the average luminance of the respective first subpixels of the first and second pixels in one situation where the input signal indicates that each of the first and second pixels should represent another chromatic color is equal to that of the respective first subpixels of the first and second pixels in another situation where the input signal indicates that each of the first and second pixels should represent an achromatic color, the luminances of the respective first subpixels of the first and second pixels in the former situation are different from those of the respective first subpixels of the first and second pixels in the latter situation.

In still another preferred embodiment, if the average luminance of the respective second subpixels of the first and second pixels in one situation where the input signal indicates that each of the first and second pixels should represent still another chromatic color is equal to that of the respective second subpixels of the first and second pixels in another situation where the input signal indicates that each of the first and second pixels should represent an achromatic color, the luminances of the respective second subpixels of the first and second pixels in the former situation are different from those of the respective second subpixels of the first and second pixels in the latter situation.

In yet another preferred embodiment, the liquid crystal device further includes: first, second and third subpixel electrodes that define the first, second and third subpixels, respectively; and source bus lines, which are provided for the first, second and third subpixel electrodes, respectively.

In yet another preferred embodiment, each of the first, second and third subpixels has multiple regions that are able to have mutually different luminances.

In this particular preferred embodiment, the liquid crystal device further includes: first, second and third subpixel electrodes, which define the first, second and third subpixels, respectively, and each of which has divided electrodes that define the multiple regions; source bus lines, which are provided for the first, second and third subpixel electrodes, respectively; and storage capacitor bus lines, which are provided for the respective divided electrodes of the first, second and third subpixel electrodes.

In yet another preferred embodiment, either the input signal or a signal obtained by converting the input signal indicates the respective grayscale levels of the multiple subpixels that are included in each of the multiple pixels. And the grayscale levels of the respective third subpixels of the first and second pixels, which are indicated by either the input signal or the converted signal, are corrected according to the hues of the first and second pixels that are also indicated by the input signal.

In yet another preferred embodiment, either the input signal or a signal obtained by converting the input signal indicates the respective grayscale levels of the multiple subpixels that are included in each of the multiple pixels. And the grayscale levels of the respective third subpixels of the first and second pixels, which are indicated by either the input signal or the converted signal, are corrected according to not only the hues of the first and second pixels that are also indicated by the input signal but also a difference in grayscale level between the respective third subpixels of the first and second pixels, which is also indicated by the input signal.

In yet another preferred embodiment, if the input signal indicates that the third subpixel of one of the first and second pixels has a first grayscale level and that the third subpixel of the other pixel has either the first grayscale level or a second grayscale level, which is higher than the first grayscale level, then the luminances of the respective third subpixels of the first and second pixels are different from ones that are associated with the grayscale levels indicated by either the input signal or the signal obtained by converting the input signal. If the input signal indicates that the third subpixel of the one pixel has the first grayscale level and that the third subpixel of the other pixel has a third grayscale level, which is higher than the second grayscale level, then the luminances of the respective third subpixels of the first and second pixels are substantially equal to ones that are associated with the grayscale levels indicated by either the input signal or the signal obtained by converting the input signal.

Another liquid crystal device according to the present invention includes a pixel that has a number of subpixels including first, second and third subpixels. Each of the first, second and third subpixels has a number of regions including first and second regions that are able to have mutually different luminances. If an input signal indicates that the pixel should represent a particular chromatic color, not only at least one of the first and second regions of the third subpixel but also at least one of the respective first and second regions of the first and second subpixels turn ON. If the average luminance of the first and second regions of the third subpixel in one situation where the input signal indicates that the pixel should represent the chromatic color is equal to that of the first and second regions of the third subpixel in another situation where the input signal indicates that the pixel should represent an achromatic color, the respective luminances of the first and second regions of the third subpixel in the former situation are different from those of the first and second regions of the third subpixel in the latter situation.

In one preferred embodiment, the first, second and third subpixels are red, green and blue subpixels, respectively.

In another preferred embodiment, the liquid crystal device further includes: first, second and third subpixel electrodes, which define the first, second and third subpixels, respectively, and each of which has first and second divided electrodes that define the first and second regions, respectively; and source bus lines, which are provided for the first and second divided electrodes of the first, second and third subpixel electrodes, respectively.

In still another preferred embodiment, the liquid crystal device further includes: first, second and third subpixel electrodes, which define the first, second and third subpixels, respectively, and each of which has first and second divided electrodes that define the first and second regions, respectively; source bus lines, which are provided for the first, second and third subpixel electrodes, respectively; and gate bus lines, which are provided for the respective first and second divided electrodes of the first, second and third subpixel electrodes.

Still another liquid crystal display device according to the present invention includes multiple pixels that are arranged in columns and rows to form a matrix pattern. The multiple pixels include first, second, third and fourth pixels, which are arranged in this order along either one of the columns or one of the rows. Each of the pixels has a number of subpixels including first, second and third subpixels. If an input signal indicates that each of the first and third pixels should represent a particular chromatic color, not only the third subpixel of at least one of the first and third pixels but also at least one of the respective first and second subpixels of the first and third pixels turn ON. If the average luminance of the respective third subpixels of the first and third pixels in one situation where the input signal indicates that the first and third pixels should represent the chromatic color is substantially equal to that of the respective third subpixels of the first and third pixels in another situation where the input signal indicates that the first and third pixels should represent an achromatic color, the luminances of the respective third subpixels of the first and third pixels in the former situation are different from those of the respective third subpixels of the first and third pixels in the latter situation.

In one preferred embodiment, the luminance of the respective third subpixels of the second and fourth pixels is substantially equal to a one that is associated with a grayscale level indicated by either the input signal or a signal obtained by converting the input signal.

Advantageous Effects of Invention

The present invention provides a liquid crystal display device that can improve the viewing angle characteristic, and minimize the color shift, when the screen is viewed obliquely.

DESCRIPTION OF EMBODIMENTS

Hereinafter, preferred embodiments of a liquid crystal display device according to the present invention will be described with reference to the accompanying drawings. It should be noted, however, that the present invention is in no way limited to the specific preferred embodiments to be described below.

Embodiment 1

Figure 1:
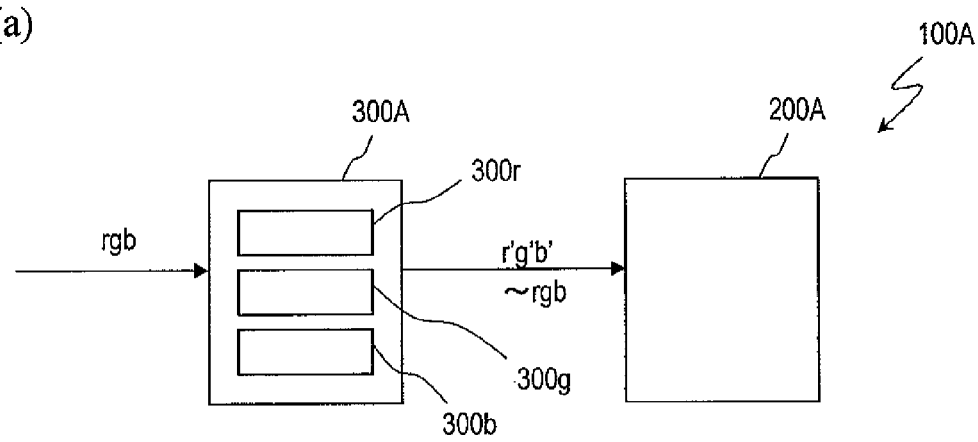
FIG. 1(*a*) is a schematic representation illustrating a liquid crystal display device as a first preferred embodiment of the present invention and FIG. 1(*b*) is a schematic representation illustrating the LCD panel of the liquid crystal display device shown in FIG. 1(*a*).
Figure 1:
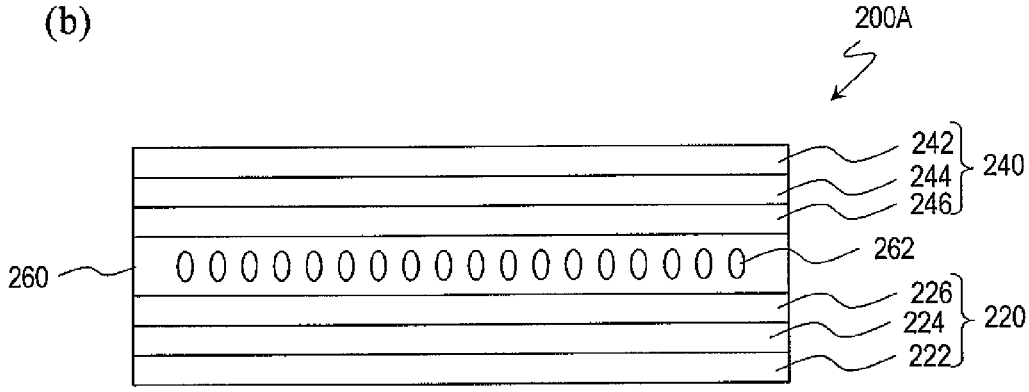

A first specific preferred embodiment of a liquid crystal display device according to the present invention will now be described. FIG. 1(*a*) is a schematic representation illustrating a liquid crystal display device 100A as a first preferred embodiment of the present invention. The liquid crystal display device 100A includes an LCD panel 200A and a correcting section 300A. The LCD panel 200A has a number of pixels that are arranged in columns and rows to form a matrix pattern. In the LCD panel 200A of this preferred embodiment, each of those pixels includes red, green and blue subpixels. In the following description, the liquid crystal display device will sometimes be simply referred to herein as just a "display device".

If necessary, the correcting section 300A makes correction on either the grayscale level or its associated luminance level of at least one of red, green and blue subpixels in accordance with the input signal. In this preferred embodiment, the correcting section 300A includes red, green and blue correcting sections 300*r*, 300*g* and 300*b*.

Specifically, the red correcting section 300*r* receives an input signal, indicating grayscale levels r, g and b for red, green and blue subpixels, and corrects the grayscale level r of the red subpixel into a different grayscale level r'. Likewise, the green correcting section 300*g* also receives the input signal indicating the grayscale levels r, g and b of the red, green and blue subpixels and corrects the grayscale level g of the green subpixel into a different grayscale level g'. In the same way, the blue correcting section 300*b* also receives the input signal indicating the grayscale levels r, g and b of the red, green and blue subpixels and corrects the grayscale level b of the blue subpixel into a different grayscale level b'. It should be noted that at least one of those corrected grayscale levels r', g' and b' to be output from the correcting section 300A could be equal to the original grayscale level r, g or b as input to the correcting section 300A.

The input signal may be compatible with a cathode ray tube (CRT) with a γ value of 2.2 and is compliant with the NTSC (National Television Standards Committee) standard. In general, the grayscale levels r, g and b indicated by the input signal are represented by eight bits. Or the input signal may have a value that can be converted into the grayscale levels r, g and b of red, green and blue subpixels and that is represented as a three-dimensional value. In FIG. 1(*a*), the grayscale levels r, g and b of the input signal are collectively identified by rgb. It should be noted that if the input signal is compliant with the BT. 709 standard, the grayscale levels r, g and b indicated by the input signal fall within the range of the lowest grayscale level (e.g., grayscale level 0) through the highest grayscale level (e.g., grayscale level 255) and the luminances of the red, green and blue subpixels fall within the range of zero through one. The input signal may be YCrCb signal, for example. The grayscale levels rgb indicated by the input signal are input through the correcting section 300A to the LCD panel 200A, which converts the grayscale levels into luminance levels. As a result, voltages representing the luminance levels are applied to the liquid crystal layer 260 of the LCD panel 200A (see FIG. 1(*b*)).

In a three-primary-color liquid crystal display device, if either the grayscale levels or luminance levels of red, green and blue subpixels are all zero, a pixel displays the color black. On the other hand, if either the grayscale levels or luminance levels of red, green and blue subpixels are all one, then a pixel displays the color white. Optionally, a liquid crystal display device may perform independent gamma correction processing as will be described later. In a liquid crystal display device in which no independent gamma correction is carried out, however, if the highest luminance of red, green and blue subpixels after the color temperatures have been adjusted to the intended ones in a TV set is supposed to be one and if an achromatic color is going to be displayed, then the red, green and blue subpixels have either the same grayscale level or the same maximum luminance ratio of the luminance levels. That is why if the color represented by a pixel changes from black into white while remaining an achromatic color, then the grayscale level of the red, green and blue subpixels or the maximum luminance ratio of the luminance levels does increase but is still the same between those red, green and blue subpixels. In the following description, if the luminance of each subpixel in an LCD panel is the lowest one corresponding to the lowest grayscale level, then that subpixel will be referred to herein as an "OFF-state subpixel". On the other hand, if the luminance of each subpixel is higher than that lowest luminance, then that subpixel will be referred to herein as an "ON-state subpixel".

FIG. 1(*b*) is a schematic representation illustrating the LCD panel 200A, which includes an active-matrix substrate 220 with pixel electrodes 224 and an alignment layer 226 that have been provided on an insulating substrate 222, a counter substrate 240 with a counter electrode 244 and another alignment layer 246 that have also been provided on another insulating substrate 242, and a liquid crystal layer 260, which is interposed between the active-matrix substrate 220 and the counter substrate 240. Although not shown, two polarizers are provided for the active-matrix substrate 220 and the counter substrate 240, respectively, and are arranged so that their polarization axes satisfy the crossed Nicols relation. Although not shown in FIG. 1(*b*), lines, insulating layers, etc. are actually assembled on the active-matrix substrate 220, while a color filter layer etc. are actually provided for the counter substrate 240. The liquid crystal layer 260 has a substantially uniform thickness. In the LCD panel 200A, a number of pixels are arranged in columns and rows to form a matrix pattern. Each of those pixels is defined by an associated pixel electrode 224 and the red, green and blue subpixels are defined by divided subpixel electrodes of the pixel electrode 224.

This LCD panel 200A operates in the VA mode, for example. Thus, the alignment layers 226 and 246 are vertical alignment layers and the liquid crystal layer 260 is a vertical alignment liquid crystal layer. As used herein, the "vertical alignment liquid crystal layer" refers to a liquid crystal layer in which the axis of its liquid crystal molecules (which will be sometimes referred to herein as an "axial direction") defines an angle of approximately 85 degrees or more with respect to the surface of the vertical alignment layers 226 and 246. The liquid crystal layer 260 includes a nematic liquid crystal material with negative dielectric anisotropy. Using such a liquid crystal material along with two polarizers that are arranged as crossed Nicols, this device conducts a display operation in a normally black mode. Specifically, in that mode, when no voltage is applied to the liquid crystal layer 260, the liquid crystal molecules 262 in the liquid crystal layer 260 are aligned substantially parallel to a normal to the principal surface of the alignment layers 226 and 246. On the other hand, when a voltage that is higher than a predetermined voltage is applied to the liquid crystal layer 260, the liquid crystal molecules 262 in the liquid crystal layer 260 are aligned substantially parallel to the principal surface of the alignment layers 226 and 246. Also, when a high voltage is applied to the liquid crystal layer 260, the liquid crystal molecules 262 will be aligned symmetrically either within a subpixel or within a particular region of the subpixel, thus contributing to improving the viewing angle characteristic. In this example, each of the active-matrix substrate 220 and the counter substrate 240 has its alignment layer 226, 246. However, according to the present invention, at least one of the active-matrix substrate 220 and the counter substrate 240 needs to have its alignment layer 226 or 246. Nevertheless, in order to stabilize the alignments, it is still preferred that both of the active-matrix substrate 220 and the counter substrate 240 have their own alignment layer 226, 246.

Figure 2:
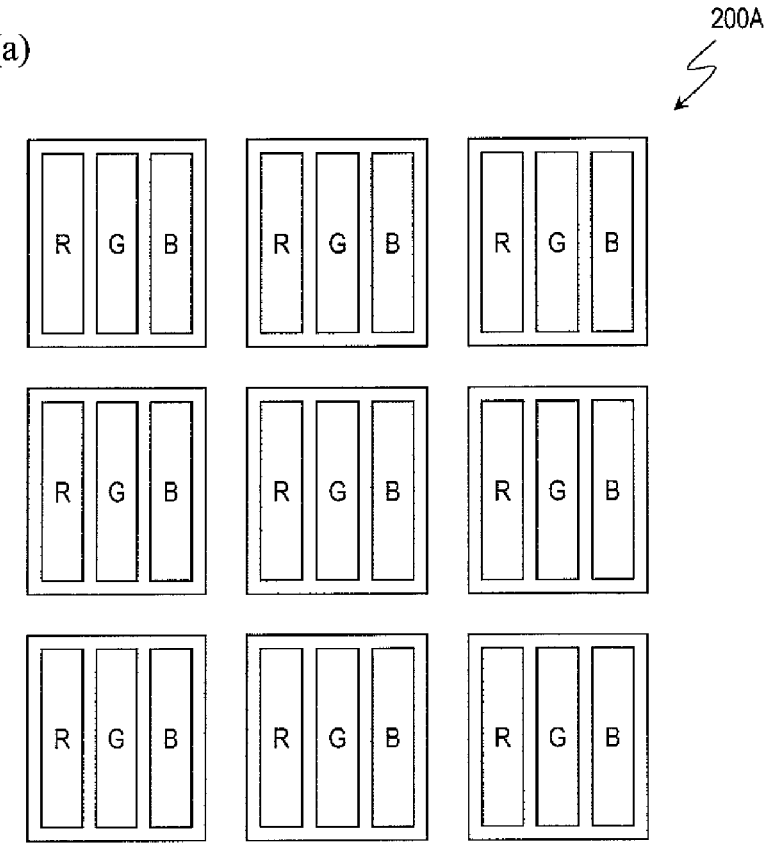
FIG. 2(*a*) is a schematic representation illustrating how respective pixels may be arranged in the liquid crystal display device shown in FIG. 1, and FIG. 2(*b*) is a circuit diagram illustrating the active-matrix substrate of its LCD panel.
Figure 2:
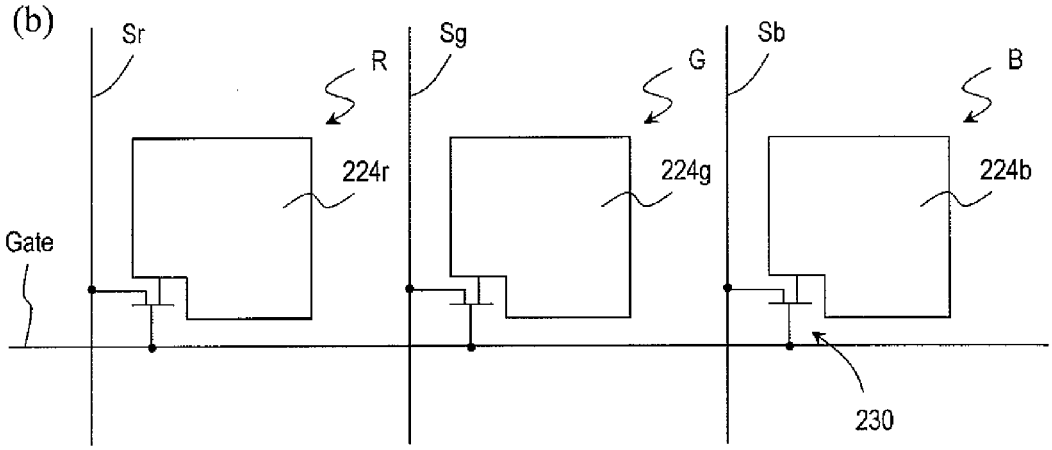

FIG. 2(*a*) illustrates how pixels and subpixels, included in each of those pixels, may be arranged in this LCD panel 200A. As an example, FIG. 2(*a*) illustrates an arrangement of pixels in three columns and three rows. Each of those pixels includes three subpixels, which are red, green and blue subpixels R, G and B that are arranged in the row direction. The luminances of these subpixels can be controlled independently of each other. The arrangement of color filters in this LCD panel 200A corresponds to the arrangement shown in FIG. 2(*a*).

In the following description, a subpixel's luminance level corresponding to the lowest grayscale level (e.g., grayscale level 0) will be represented herein as "0" and a subpixel's luminance level corresponding to the highest grayscale level (e.g., grayscale level 255) will be represented herein as "1" for convenience sake. Even if their luminance levels are equal to each other, the red, green and blue subpixels may actually have mutually different luminances because the "luminance level" herein means the ratio of the luminance of each subpixel to its highest luminance. For example, if the input signal indicates that a pixel should represent the color black, all of the grayscale levels r, g and b indicated by the input signal are the lowest grayscale level (e.g., grayscale level 0). On the other hand, if the input signal indicates that a pixel should represent the color white, all of the grayscale levels r, g and b are the highest grayscale level (e.g., grayscale level 255). In the following description, the grayscale level will sometimes be normalized with the highest grayscale level and the grayscale level will be represented as a ratio of zero through one.

FIG. 2(*b*) illustrates an equivalent circuit diagram of one pixel in this liquid crystal display device 100A. A TFT 230 is connected to a subpixel electrode 224*b* that is provided for a blue subpixel B. The TFT 230 has its gate electrode connected to a gate bus line Gate and its source electrode connected to a source bus line Sb. The other red and green subpixels R and G also have the same configuration.

Figure 3:
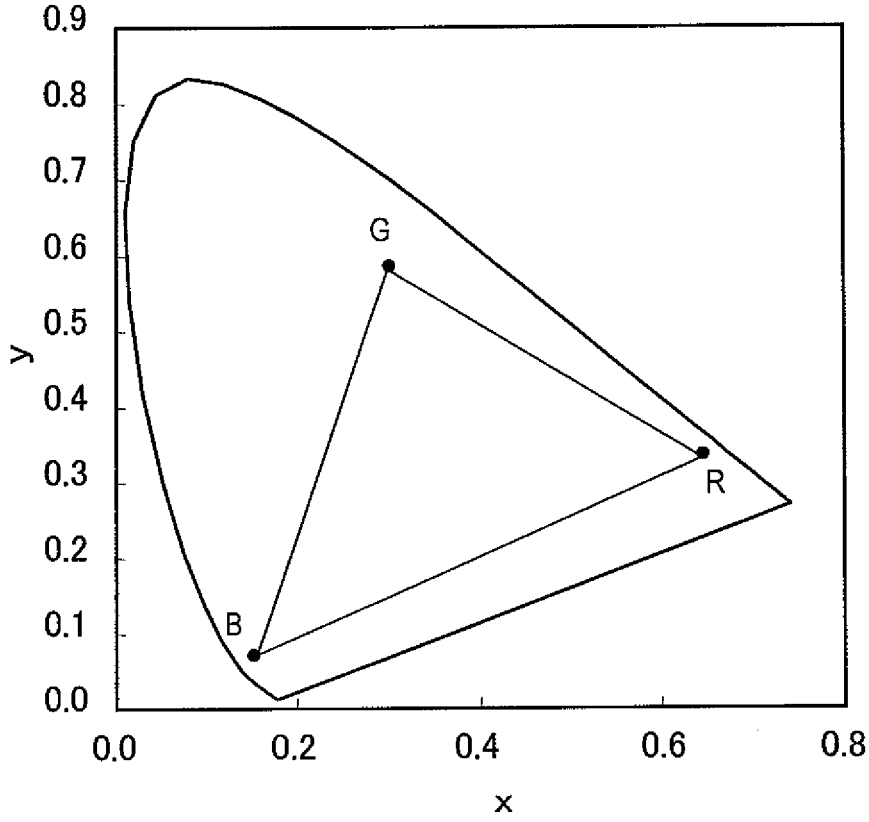
FIG. 3 is a chromaticity diagram of the LCD panel in the liquid crystal display device shown in FIG. 1.

FIG. 3 is a chromaticity diagram of the LCD panel 200A. If the grayscale level of a red subpixel is the highest one and if that of green and blue subpixels is the lowest one, then the LCD panel 200A has the R chromaticity shown in FIG. 3. On the other hand, if the grayscale level of the green subpixel is the highest one and if that of red and blue subpixels is the lowest one, then the LCD panel 200A has the G chromaticity shown in FIG. 3. And if the grayscale level of a blue subpixel is the highest one and if that of red and green subpixels is the lowest one, then the LCD panel 200A has the B chromaticity shown in FIG. 3. The color reproduction range of the liquid crystal display device 100A is represented by the triangle, of which the vertices are defined by R, G and B coordinates shown in FIG. 3.

Hereinafter, it will be outlined with reference to FIGS. 1 and 4 how the liquid crystal display device 100A of this preferred embodiment operates in principle. In the example to be described below, the input signal is supposed to indicate that each and every pixel should represent the same color for the sake of simplicity. Also, the grayscale levels of respective subpixels indicated by the input signal will be identified by r, g and b, which will sometimes be referred to herein as "reference grayscale levels".

Figure 4:
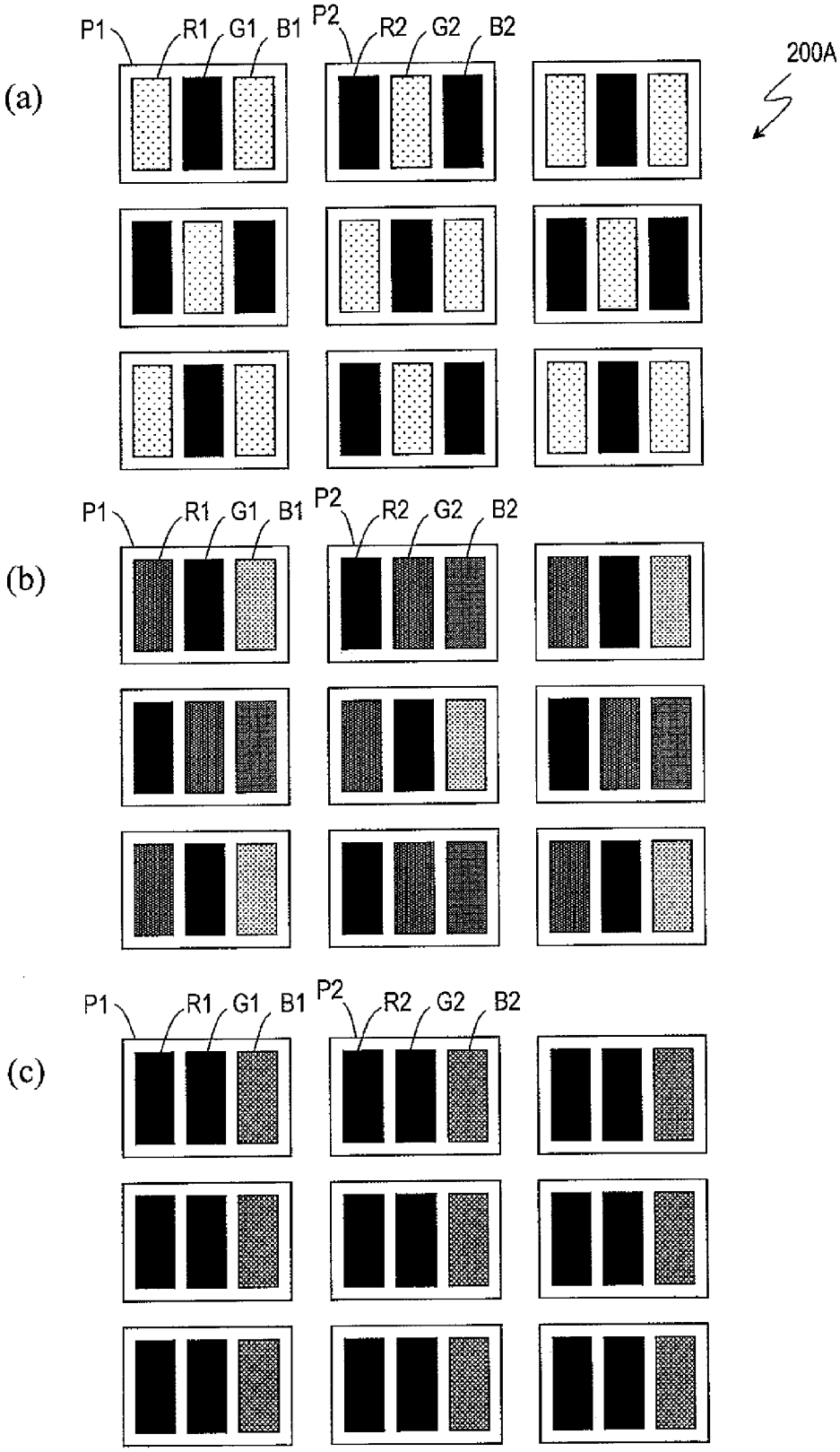
FIGS. 4(*a*), 4(*b*) and 4(*c*) are schematic representations illustrating roughly how the liquid crystal display device shown in FIG. 1 works.

FIGS. 4(*a*), 4(*b*) and 4(*c*) illustrate the appearance of the LCD panel 200A of this liquid crystal display device 100A. In FIG. 4(*a*), the input signal indicates that every pixel should represent the same achromatic color. On the other hand, in FIGS. 4(*b*) and 4(*c*), the input signal indicates that every pixel should represent the same chromatic color.

In each of FIGS. 4(*a*), 4(*b*) and 4(*c*), two pixels that are adjacent to each other in the row direction are taken as an example. One of those two pixels is identified by P1 and its red, green and blue subpixels are identified by R1, G1 and B1, respectively. The other pixel is identified by P2 and its red, green and blue subpixels are identified by R2, G2 and B2, respectively.

First of all, it will be described with reference to FIG. 4(*a*) how the LCD panel 200A looks when the color indicated by the input signal is an achromatic color. In such a situation, the grayscale levels of the red, green and blue subpixels are equal to each other.

The red, green and blue correcting sections 300*r*, 300*g* and 300*b* shown in FIG. 1(*a*) make corrections so that in this LCD panel 200A, the luminances of the red, green and blue subpixels R1, G1 and B1 of one P1 of the two adjacent pixels are different from those of the red, green and blue subpixels R2, G2 and B2 of the other pixel P2. In FIG. 4(*a*), look at any two subpixels that are adjacent to each other in the row direction, and it can be seen that their brightness levels are opposite to each other. And the same can be said about any two subpixels that are adjacent to each other in the column direction, too. Also, look at two subpixels (e.g., red subpixels) belonging to two pixels that are adjacent to each other in the row direction, and it can be seen that their brightness levels are opposite to each other. And the same can be said about any two subpixels (e.g., red subpixels) belonging to two pixels that are adjacent to each other in the column direction, too.

Using two red subpixels belonging to two adjacent pixels as a unit, the red correcting section 300*r* controls the luminances of those red subpixels. That is why even if the input signal indicates that such red subpixels belonging to two adjacent pixels have the same grayscale level, the LCD panel 200A corrects the grayscale level so that those two red subpixels have mutually different luminances. As a result of this correction, one of the two red subpixels belonging to those two adjacent pixels has its luminance increased by the magnitude of shift $\Delta S\alpha$, while the other red subpixel has its luminance decreased by the magnitude of shift $\Delta S\beta$. Consequently, those two red subpixels belonging to the two adjacent pixels have mutually different luminances. In the same way, the green correcting section 300*g* uses two green subpixels belonging to two adjacent pixels as a unit to control the luminances of those two green subpixels, and the blue correcting section 300*b* uses two blue subpixels belonging to two adjacent pixels as a unit to control the luminances of those two blue subpixels.

In two subpixels in the same color that belong to two adjacent pixels, one subpixel with the higher luminance will be referred to herein as a "bright subpixel", while the other subpixel with the lower luminance as a "dark subpixel". In this case, the luminance of the bright subpixel is higher than a luminance corresponding to a reference grayscale level, while that of the dark subpixel is lower than the luminance corresponding to the reference grayscale level. Also, in two sets of red, green and blue subpixels belonging to two adjacent pixels, the red, green and blue subpixels that have the higher luminance will be referred to herein as a "bright red subpixel", a "bright green subpixel" and a "bright blue subpixel", respectively, while the red, green and blue subpixels that have the lower luminance will be referred to herein as a "dark red subpixel", a "dark green subpixel" and a "dark blue subpixel", respectively. For example, the red and blue subpixels R1 and B1 belonging to the pixel P1 are bright subpixels and the green subpixel G1 belonging to the pixel P1 is a dark subpixel. On the other hand, the red and blue subpixels R2 and B2 belonging to the pixel P2 are dark subpixels and the green subpixel G2 belonging to the pixel P2 is a bright subpixel.

Also, when the screen is viewed straight on, the difference between the luminance of the bright subpixel and the luminance corresponding to the reference grayscale level is substantially equal to the difference between the luminance corresponding to the reference grayscale level and the luminance of the dark subpixel, and the magnitude of shift $\Delta S\alpha$ is ideally equal to the magnitude of shift $\Delta S\beta$ for each of the red, green and blue subpixels. That is why the average of the luminances of respective subpixels belonging to two adjacent pixels in this LCD panel 200A as viewed straight on is substantially equal to that of the luminances corresponding to the grayscale levels of two adjacent subpixels as indicated by the input signal. In this preferred embodiment, the red, green and blue correcting sections 300*r*, 300*g* and 300*b* make corrections on the grayscale levels of subpixels belonging to two pixels that are adjacent to each other in the row direction.

If the red, green and blue correcting sections 300*r*, 300*g* and 300*b* make such corrections, the two subpixels of the same color belonging to two adjacent pixels have mutually different grayscale-luminance characteristics (i.e., different gamma characteristics). As a result, the viewing angle characteristic when the screen is viewed obliquely can be improved. In that case, the colors represented by those two adjacent pixels are strictly different from each other. However, if the LCD panel 200A has a sufficiently high resolution, the color sensed by a human viewer with his or her eyes will be the average of those two colors represented by the two adjacent pixels.

For example, if the input signal indicates that the grayscale levels (r, g, b) of the red, green and blue subpixels should be (100, 100, 100), the liquid crystal display device 100A corrects the grayscale levels of those subpixels into either 137 ($=(2\times(100/255)^{2.2})^{1/2.2}\times255$) or zero. As a result, in the LCD panel 200A, the red, green and blue subpixels R1, G1 and B1 belonging to the pixel P1 come to have luminances corresponding to the grayscale levels (137, 0, 137), while the red, green and blue subpixels P2, G2 and B2 belonging to the pixel P2 come to have luminances corresponding to the grayscale levels (0, 137, 0).

Next, it will be described with reference to FIG. 4(*b*) how the LCD panel 200A looks when the input signal indicates that a chromatic color should be represented. In this case, the input signal is supposed to indicate that the blue subpixel should have a higher grayscale level than the red and green subpixels.

For example, if the input signal indicates that the grayscale levels of the red, green and blue subpixels should be (50, 50, 100), the liquid crystal display device 100A corrects the grayscale levels of the red and green subpixels into either 69 ($=(2\times(50/255)^{2.2})^{1/2.2}\times255$) or zero. As a result, the bright red subpixel and the bright green subpixel do turn ON but the dark red subpixel and the dark green subpixel are OFF. On the other hand, the grayscale level of the blue subpixel is corrected differently from the red and green subpixels. Specifically, the grayscale level of 100 of the blue subpixel indicated by the input signal is corrected into either 121 or 74. It should be noted that $2\times(100/255)^{2.2}=(121/255)^{2.2}+(74/255)^{2.2}$. As a result, the bright blue subpixel and the dark blue subpixel both turn ON. Consequently, the red, green and blue subpixels R1, G1 and B1 belonging to the pixel P1 in this LCD panel 200A come to have luminances corresponding to the grayscale levels (69, 0, 121) and the red, green and blue subpixels R2, G2 and B2 belonging to the pixel P2 come to have luminances corresponding to the grayscale levels (0, 69, 74).

When the input signal indicates that a chromatic color should be represented, this liquid crystal display device 100A corrects the grayscale level of a blue subpixel differently from when the input signal indicates that a achromatic color should be represented. If in a situation where the input signal indicates that the red, green and blue subpixels have grayscale levels (50, 50, 100), the grayscale level of the blue subpixel were corrected in the same way as in a situation where an achromatic color should be represented, then the difference $\Delta u'v'$ between the chromaticity when the screen is viewed obliquely and the chromaticity when the screen is viewed straight on (which will be referred to herein as a "chromaticity difference") would be 0.047. If the chromaticity difference $\Delta u'v'$ were relatively big in this manner, the color would look different depending on whether the screen is viewed obliquely or straight on. To avoid such an unwanted situation, when a chromatic color should be represented, this liquid crystal display device 100A corrects the grayscale level of the blue subpixel differently from when an achromatic color should be represented. As a result, the difference $\Delta u'v'$ between the chromaticity when the screen is viewed obliquely and the chromaticity when the screen is viewed straight on becomes 0.026. Consequently, the liquid crystal display device 100A can reduce the chromaticity difference Δu'v' significantly and minimize the color shift. In the example that has just been described with reference to FIG. 4(*b*), when the input signal indicates that a chromatic color should be represented, the luminance of the blue subpixel is corrected into a different value. However, the luminance of the blue subpixel may remain the same.

Next, it will be described with reference to FIG. 4(*c*) how the LCD panel 200A looks when the input signal indicates that another chromatic color should be represented. For example, if the input signal indicates that the grayscale levels of the red, green and blue subpixels should be (0, 0, 100), the red and green subpixels do not have their grayscale levels changed but have a luminance corresponding to the grayscale level of 0 in this liquid crystal display device 100A. On the other hand, this liquid crystal display device 100A changes the grayscale level of the blue subpixel differently from when an achromatic color should be represented. Specifically, the blue subpixel does not have its grayscale level changed but has a grayscale level corresponding to the grayscale level of 100 as indicated by the input signal. Consequently, the red, green and blue subpixels R1, G1 and B1 belonging to the pixel P1 in this LCD panel 200A come to have luminances corresponding to the grayscale levels (0, 0, 100), so do the red, green and blue subpixels R2, G2 and B2 belonging to the pixel P2.

Hereinafter, advantages of the liquid crystal display device 100A of this preferred embodiment over its counterparts as Comparative Examples 1 and 2 will be described. In the example to be described below, the input signal is supposed to indicate that every pixel should represent the same color to avoid complicating the description overly.

First of all, a liquid crystal display device will be described as Comparative Example 1 with reference to FIG. 5. In the liquid crystal display device of this Comparative Example 1, the grayscale levels never change, no matter what grayscale levels are indicated by the input signal for respective subpixels.

Figure 5:
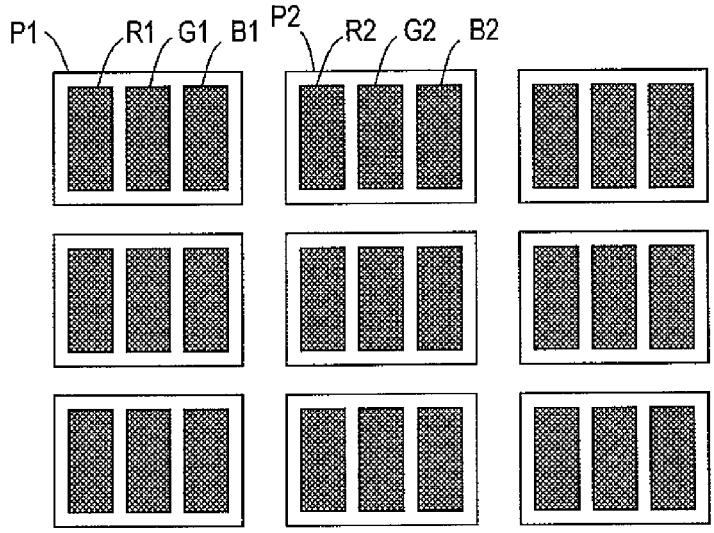
FIGS. 5(*a*) and 5(*b*) are schematic representations illustrating the appearance of the LCD panel of a liquid crystal display device as Comparative Example 1 and FIG. 5(*c*) is a graph showing how the obliquely viewing grayscale varies with the reference grayscale level in the liquid crystal display device of Comparative Example 1.
Figure 5:
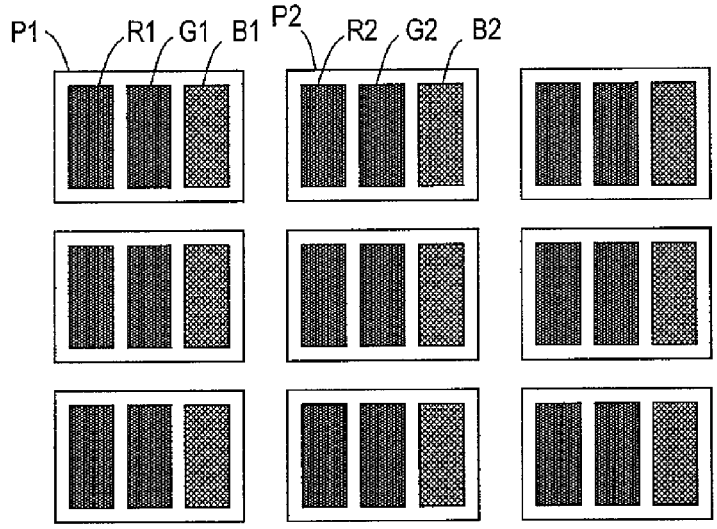
Figure 5:
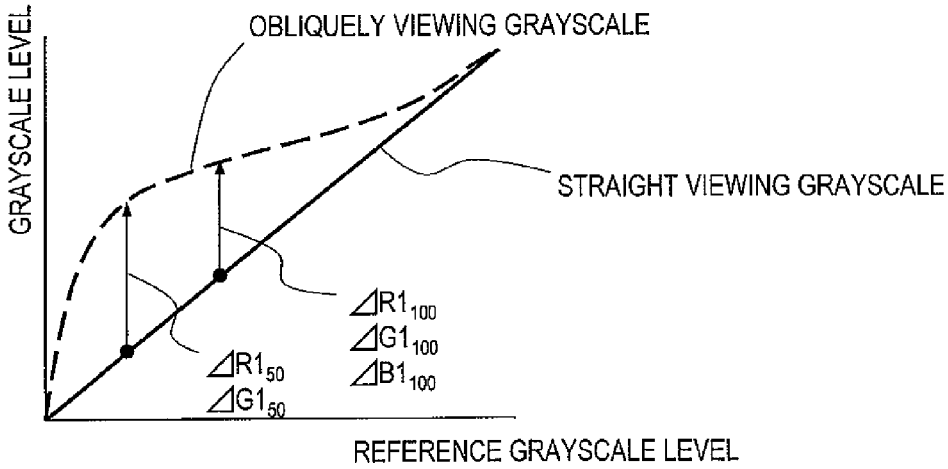

FIG. 5(*a*) is a schematic representation illustrating how the LCD panel of the liquid crystal display device of Comparative Example 1 looks when the input signal indicates that every pixel should represent an achromatic color. For example, if the highest grayscale level is supposed to be 255, the grayscale levels of red, green and blue subpixels as indicated by the input signal are (100, 100, 100).

If the input signal indicates that the grayscale levels of red, green and blue subpixels should be (100, 100, 100), the grayscale levels never change in this liquid crystal display device as Comparative Example 1. That is why the luminances of the respective subpixels correspond to the grayscale levels (100, 100, 100).

FIG. 5(*b*) is a schematic representation illustrating how the LCD panel of the liquid crystal display device of Comparative Example 1 looks when the input signal indicates that every pixel should represent the same chromatic color. For example, if the highest grayscale level is supposed to be 255, the grayscale levels of red, green and blue subpixels as indicated by the input signal are (50, 50, 100).

If the input signal indicates that the grayscale levels of red, green and blue subpixels should be (50, 50, 100), the grayscale levels never change. That is why the luminances of the respective subpixels correspond to the grayscale levels (50, 50, 100).

FIG. 5(*c*) shows how the grayscale when the screen is viewed straight on (which will be referred to herein as "straight viewing grayscale") and the grayscale when the screen is viewed obliquely (which will be referred to herein as "obliquely viewing grayscale") change with respect to the reference grayscale level in the liquid crystal display device of Comparative Example 1. In this case, the straight viewing grayscale and the obliquely viewing grayscale are relative grayscale levels representing relative luminances by grayscales. Also, in this example, the obliquely viewing grayscale is a relative grayscale level when the viewing direction defines an angle of 60 degrees with respect to a normal to the display screen.

The straight viewing grayscale increases proportionally to the reference grayscale level. On the other hand, as the reference grayscale level increases, the obliquely viewing grayscale increases monotonically. At low grayscales, however, the higher the reference grayscale level, the greater the difference between the obliquely viewing and straight viewing grayscales and the more noticeable the whitening phenomenon gets. But at middle to high grayscales, the higher the reference grayscale level, the smaller the difference between the obliquely viewing and straight viewing grayscales and the less perceptible the whitening phenomenon gets.

In FIG. 5(*c*), the differences between the obliquely viewing and straight viewing grayscales when the grayscale levels of red, green and blue subpixels in the liquid crystal display device of Comparative Example 1 are 100 are identified by $\Delta R1_{100}$, $\Delta G1_{100}$ and $\Delta B1_{100}$, respectively. On the other hand, the differences between the obliquely viewing and straight viewing grayscales when the reference grayscale levels of red and green subpixels are 50 are identified by $\Delta R1_{50}$ and $\Delta G1_{50}$, respectively. Generally speaking, when an achromatic color is going to be represented, settings are usually determined so that there is only little difference in the color represented depending on whether the screen is viewed obliquely or straight on. And these differences $\Delta R1_{100}$, $\Delta G1_{100}$ and $\Delta B1_{100}$ are equal to each other. Also, in the liquid crystal display device of Comparative Example 1, $\Delta R1_{100}$, $\Delta G1_{100}$, $\Delta B1_{100}$, $\Delta R1_{50}$ and $\Delta G1_{50}$ are so large that the whitening phenomenon arises to a significant degree.

Next, a liquid crystal display device will be described as Comparative Example 2. The liquid crystal display device of this Comparative Example 2 makes correction using necessary one(s) of the grayscale levels that are indicated by the input signal for red, green and blue subpixels, thereby trying to improve the viewing angle characteristic.

Figure 6:
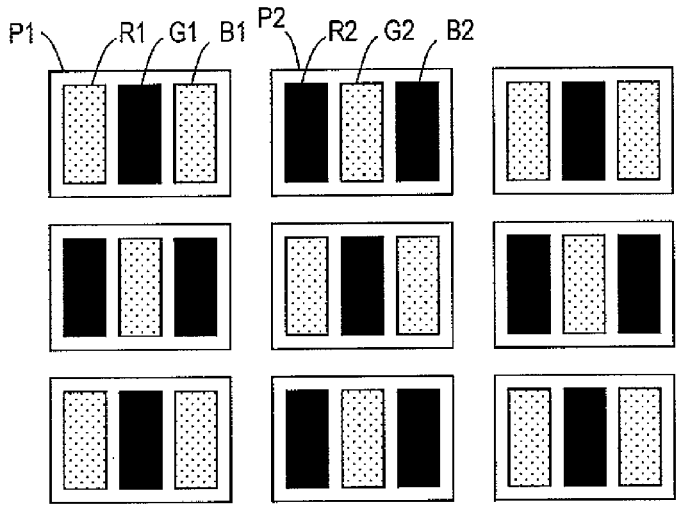
FIGS. 6(*a*) and 6(*b*) are schematic representations illustrating the appearance of the LCD panel of a liquid crystal display device as Comparative Example 2 and FIG. 6(*c*) is a graph showing how the obliquely viewing grayscale varies with the reference grayscale level in the liquid crystal display device of Comparative Example 2.
Figure 6:
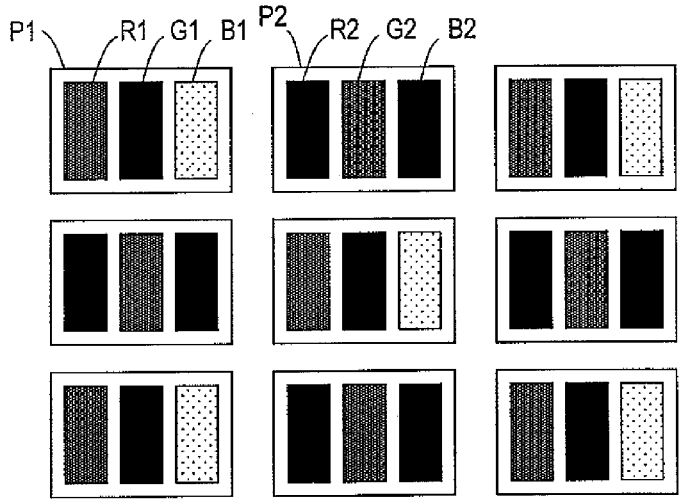
Figure 6:
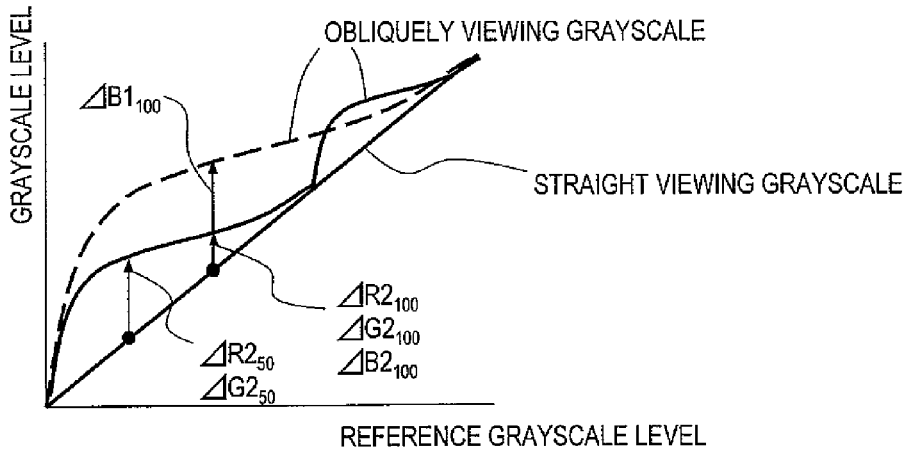

FIG. 6(*a*) is a schematic representation illustrating how the LCD panel of the liquid crystal display device of Comparative Example 2 looks when the input signal indicates that every pixel should represent an achromatic color. For example, if the highest grayscale level is supposed to be 255, the grayscale levels of red, green and blue subpixels as indicated by the input signal are (100, 100, 100).

If the input signal indicates that the grayscale levels of the red, green and blue subpixels should be (100, 100, 100), the liquid crystal display device of this Comparative Example 2 corrects the grayscale levels of the red, green and blue subpixels into either 137 ($=(2\times(100/255)^{2.2})^{1/2.2}\times255$) or zero. As a result, in the liquid crystal display device of this Comparative Example 2, the red, green and blue subpixels R1, G1 and B1 belonging to the pixel P1 come to have luminances corresponding to the grayscale levels (137, 0, 137), while the red, green and blue subpixels R2, G2 and B2 belonging to the pixel P2 come to have luminances corresponding to the grayscale levels (0, 137, 0). In the liquid crystal display device of Comparative Example 2, any two subpixels that are adjacent to each other in the row or column direction have opposite brightness levels and any two subpixels that are diagonally adjacent to each other have the same luminance. Also, if attention is paid to two subpixels of the same color (e.g., red subpixels) that belong to two different pixels, two subpixels of two pixels that are adjacent to each other in the row or column direction have opposite brightness levels and two subpixels of two pixels that are diagonally adjacent to each other have the same luminance.

FIG. 6(*b*) is a schematic representation illustrating how the LCD panel of the liquid crystal display device of Comparative Example 2 looks when the input signal indicates that every pixel should represent the same chromatic color. For example, if the highest grayscale level is supposed to be 255, the grayscale levels of red, green and blue subpixels as indicated by the input signal are (50, 50, 100).

If the input signal indicates that the grayscale levels of the red, green and blue subpixels should be (50, 50, 100), the grayscale levels of the red and green subpixels are corrected into either 69 ($=(2\times(50/255)^{2.2})^{1/2.2}\times255$) or zero. On the other hand, the blue subpixel comes to have a luminance corresponding to a grayscale level of 137 ($=(2\times(100/255)^{2.2})^{1/2.2}\times255$) or zero. As a result, in the liquid crystal display device of this Comparative Example 2, the red, green and blue subpixels R1, G1 and B1 belonging to the pixel P1 come to have luminances corresponding to the grayscale levels (69, 0, 137), while the red, green and blue subpixels R2, G2 and B2 belonging to the pixel P2 come to have luminances corresponding to the grayscale levels (0, 69, 0). In this case, the whitening phenomenon to arise when the screen is viewed obliquely can also be minimized.

FIG. 6(*c*) shows how the straight viewing and obliquely viewing grayscales change with respect to the reference grayscale level in the liquid crystal display device of Comparative Example 2. In FIG. 6(*c*), also indicated by the dashed curve for your reference is the obliquely viewing grayscale of the liquid crystal display device of Comparative Example 1 shown in FIG. 5(*c*). Compared to the obliquely viewing grayscales of the liquid crystal display device of Comparative Example 1, those of the liquid crystal display device of this Comparative Example 2 are much lower particularly at low to middle grayscales. Consequently, in the liquid crystal display device of this Comparative Example 2, the degree of whitening observed is generally lower than in the counterpart of Comparative Example 1 described above.

In FIG. 6(*c*), the differences between the obliquely viewing and straight viewing grayscales when the grayscale levels of red, green and blue subpixels in the liquid crystal display device of Comparative Example 2 are 100 (i.e., when the average luminance of the red subpixels R1 and R2, that of the green subpixels G1 and G2, and that of the blue subpixels B1 and B2 all correspond to the grayscale level of 100) are identified by $\Delta R2_{100}$, $\Delta G2_{100}$ and $\Delta B2_{100}$, respectively. On the other hand, the differences between the obliquely viewing and straight viewing grayscales when the reference grayscale levels of red and green subpixels are 50 are identified by $\Delta R2_{50}$ and $\Delta G2_{50}$, respectively. Generally speaking, when an achromatic color is going to be represented, settings are usually determined so that there is only little difference in the color represented depending on whether the screen is viewed obliquely or straight on. And $\Delta R2_{100}$, $\Delta G2_{100}$ and $\Delta B2_{100}$ are equal to each other. Also shown in FIG. 6(*c*) for your reference is $\Delta B1_{100}$ mentioned above. Since $\Delta B2_{100}$ is smaller than $\Delta B1_{100}$ as shown in FIG. 6(*c*), it can be seen that the whitening phenomenon has been reduced in this comparative example.

Nonetheless, $\Delta B2_{100}$ is smaller than $\Delta R2_{50}$ or $\Delta G2_{50}$. That is why if the input signal indicates that the red, green and blue subpixels should have grayscale levels (50, 50, 100), the color as viewed obliquely will look a bit more yellowish than the color as viewed straight on in this liquid crystal display device. Consequently, in the liquid crystal display device of this Comparative Example 2, the color shift increases when a chromatic color is going to be represented.

Next, a liquid crystal display device 100A according to this preferred embodiment will be described with reference to FIG. 7. The liquid crystal display device 100A of this preferred embodiment corrects the grayscale level of a blue subpixel based on not only the grayscale level of the blue subpixel itself but also those of red and green subpixels as well, which is a major difference from the liquid crystal display device of Comparative Example 2.

Figure 7:
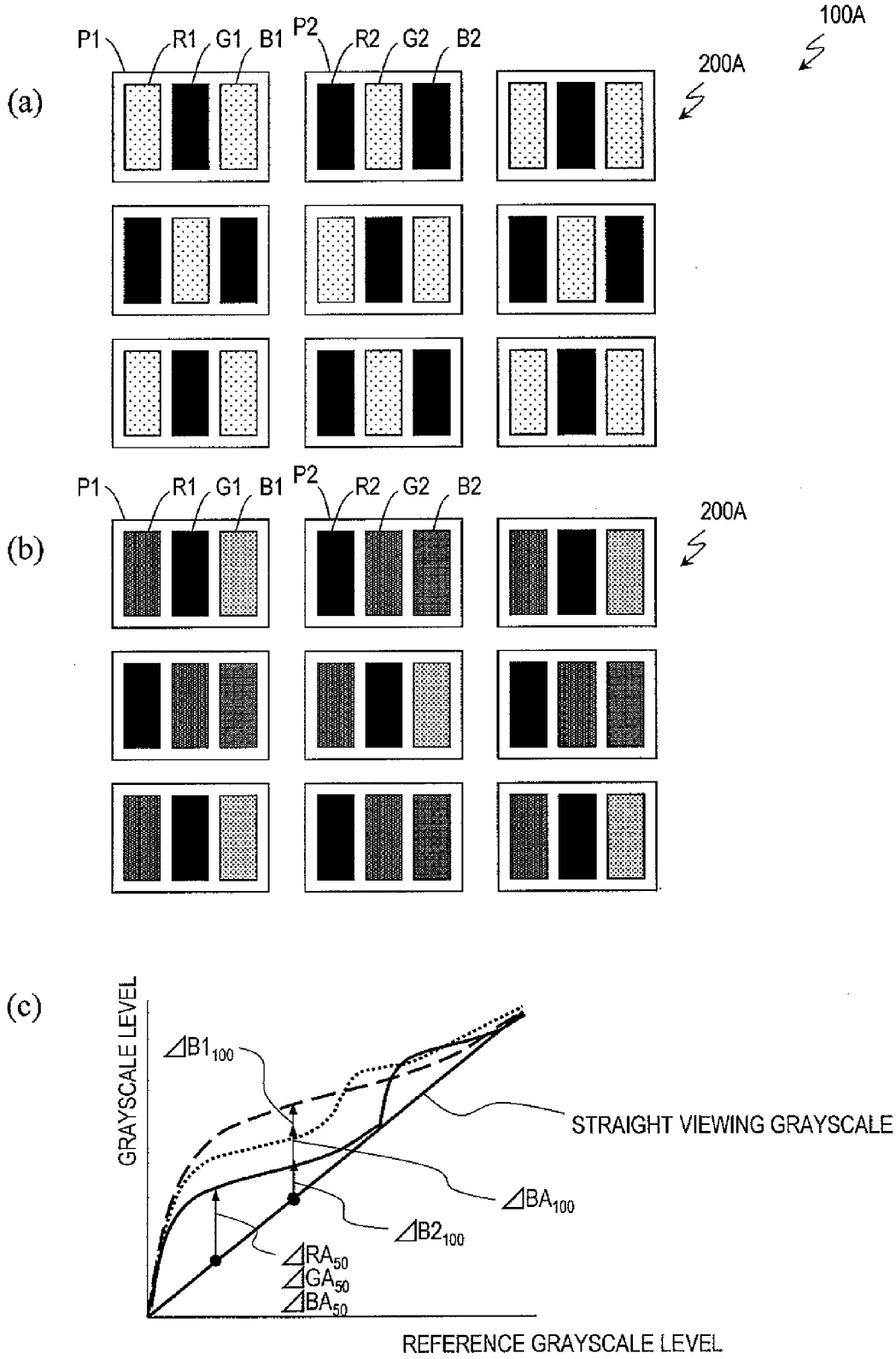
FIGS. 7(*a*) and 7(*b*) are schematic representations illustrating the appearance of the LCD panel of the liquid crystal display device shown in FIG. 1 and FIG. 7(*c*) is a graph showing how the obliquely viewing grayscale varies with the reference grayscale level in the liquid crystal display device shown in FIG. 1.

FIG. 7(*a*) is a schematic representation illustrating how the LCD panel 200A of this liquid crystal display device 100A looks when the input signal indicates that every pixel should represent an achromatic color. For example, if the highest grayscale level is supposed to be 255, the grayscale levels of red, green and blue subpixels as indicated by the input signal are (100, 100, 100).

If the input signal indicates that the grayscale levels of the red, green and blue subpixels should be (100, 100, 100), the liquid crystal display device 100A corrects the grayscale levels of the red, green and blue subpixels into either 137 ($=(2\times(100/255)^{2.2})^{1/2.2}\times255$) or zero. As a result, in the liquid crystal display device 100A, the red, green and blue subpixels R1, G1 and B1 belonging to the pixel P1 come to have luminances corresponding to the grayscale levels (137, 0, 137), while the red, green and blue subpixels R2, G2 and B2 belonging to the pixel P2 come to have luminances corresponding to the grayscale levels (0, 137, 0). In this case, the degree of whitening to arise when the screen is viewed obliquely has been reduced.

FIG. 7(*b*) is a schematic representation illustrating how the LCD panel 200A of this liquid crystal display device 100A looks when the input signal indicates that every pixel should represent the same chromatic color. For example, the grayscale levels of red, green and blue subpixels as indicated by the input signal may be (50, 50, 100).

If the input signal indicates that the grayscale levels of the red, green and blue subpixels should be (50, 50, 100), the liquid crystal display device 100A corrects the grayscale levels of the red and green subpixels into either 69 ($=(2\times(50/255)^{2.2})^{1/2.2}\times255$) or zero. On the other hand, the grayscale level of the blue subpixel is corrected differently from the red and green subpixels. Specifically, the grayscale level of 100 of the blue subpixel is corrected into either 121 or 74. It should be noted that $2\times(100/255)^{2.2}=((121/255)^{2.2}+(74/255)^{2.2})$. Consequently, the red, green and blue subpixels R1, G1 and B1 belonging to the pixel P1 in this liquid crystal display device 100A come to have luminances corresponding to the grayscale levels (69, 0, 121) and the red, green and blue subpixels R2, G2 and B2 belonging to the pixel P2 come to have luminances corresponding to the grayscale levels (0, 69, 74).

FIG. 7(*c*) shows how the obliquely viewing grayscale changes with respect to the reference grayscale level in this liquid crystal display device 100A. In FIG. 7(*c*), also shown for your reference are the obliquely viewing grayscales of the liquid crystal display devices of Comparative Examples 1 and 2 shown in FIGS. 5(*c*) and 6(*c*) and indicated by the dashed curve and the solid curve, respectively.

As already described with reference to FIG. 7(*b*), if the input signal indicates that the grayscale levels of the red, green and blue subpixels should be (50, 50, 100), the liquid crystal display device 100A of this preferred embodiment corrects the grayscale level of the blue subpixel differently from the red and green subpixels, and therefore, the obliquely viewing grayscale of the blue subpixel changes differently from that of the red or green subpixel. In FIG. 7(*c*), the differences between the obliquely viewing grayscales of the red and green subpixels as indicated by the solid curve and the straight viewing grayscale are identified by $\Delta RA_{50}$ and $\Delta GA_{50}$, respectively. On the other hand, the difference between the obliquely viewing grayscale of the blue subpixel as indicated by the dotted curve and the straight viewing grayscale is identified by $\Delta BA_{100}$. Also, in FIG. 7(*c*), the differences between the obliquely viewing and straight viewing grayscales of the liquid crystal display devices of Comparative Examples 1 and 2 when the blue subpixel has a reference grayscale level of 100 are identified by $\Delta B\mathbf{1}_{100}$ and $\Delta B\mathbf{2}_{100}$, respectively.

As described above, if the input signal indicates that the red, green and blue subpixels should have grayscale levels (50, 50, 100), the color as viewed obliquely will look a bit more yellowish in the liquid crystal display device of Comparative Example 2 than the color as viewed straight on because $\Delta B\mathbf{2}_{100}$ is smaller than $\Delta R\mathbf{2}_{50}$ or $\Delta G\mathbf{2}_{50}$. On the other hand, the grayscale level difference $\Delta BA_{100}$ from the grayscale levels of 121 and 74 of the blue subpixel in the liquid crystal display device 100A of this preferred embodiment is smaller than the grayscale level difference $\Delta B\mathbf{1}_{100}$ from the grayscale level of 100, 100 of the blue subpixel in the liquid crystal display device of Comparative Example 1 and larger than the grayscale level difference $\Delta B\mathbf{2}_{100}$ from the grayscale levels of 137 and 0 of the blue subpixel in the liquid crystal display device of Comparative Example 2. And the grayscale level difference $\Delta BA_{100}$ is closer to the grayscale level differences $\Delta RA_{50}$ and $\Delta GA_{50}$ rather than the grayscale level differences $\Delta B\mathbf{1}_{100}$ and $\Delta B\mathbf{2}_{100}$. Consequently, this liquid crystal display device 100A can reduce the color shift.

The following table 1 shows x, y and Y values that are obtained by viewing the liquid crystal display device of Comparative Example 1 straight on and obliquely from a viewing angle of 60 degrees and the chromaticity difference Δu'v' between the straight viewing and obliquely viewing directions when the input signal indicates that red, green and blue subpixels should have grayscale levels (150, 0, 50):

TABLE 1

| | x | y | Y | Δu'v' |
|---|---|---|---|---|
| Viewed straight on | 0.610 | 0.301 | 0.116 | — |
| Viewed obliquely (60°) | 0.424 | 0.208 | 0.134 | 0.133 |

For example, if the input signal indicates that the red, green and blue subpixels should have grayscale levels (150, 0, 50), the grayscale levels b1' and b2' become 69 and 0, respectively, in the liquid crystal display device 100A of this preferred embodiment. The following table 2 shows x, y and Y values that are obtained in such a situation by viewing the device straight on and obliquely from a viewing angle of 60 degrees and the chromaticity difference Δu'v' between the straight viewing and obliquely viewing directions:

TABLE 2

| | x | y | Y | Δu'v' |
|---|---|---|---|---|
| Viewed straight on | 0.610 | 0.301 | 0.116 | — |
| Viewed obliquely (60°) | 0.483 | 0.239 | 0.127 | 0.078 |

Compare Table 2 to Table 1, and it can be seen easily that this liquid crystal display device 100A can reduce the color shift when the screen is viewed obliquely. In the liquid crystal display device of Comparative Example 2, not just the grayscale levels b1' and b2' of the blue subpixels but also those r1' and r2' of the red subpixels are corrected into level 69, level 0, level 205 $(=(2\times(150/255)^{2.2})^{1/2.2}\times 255)$ and level 0, respectively. The following table 3 shows x, y and Y values that are obtained in such a situation by viewing the device straight on and obliquely from a viewing angle of 60 degrees and the chromaticity difference Δu'v' between the straight viewing and obliquely viewing directions:

TABLE 3

| | X | Y | Y | Δu'v' |
|---|---|---|---|---|
| Viewed straight on | 0.610 | 0.301 | 0.116 | — |
| Viewed obliquely (60°) | 0.441 | 0.219 | 0.095 | 0.119 |

Comparing Table 3 to Tables 1 and 2, it can be seen that since the liquid crystal display device of Comparative Example 2 makes correction on each subpixel based on only the grayscale level of that subpixel, color shift is produced more significantly when the screen is viewed obliquely than in the liquid crystal display device 100A of this preferred embodiment. Consequently, by making correction on each subpixel based on its hue and other factors, the color shift can be reduced.

Figure 8:
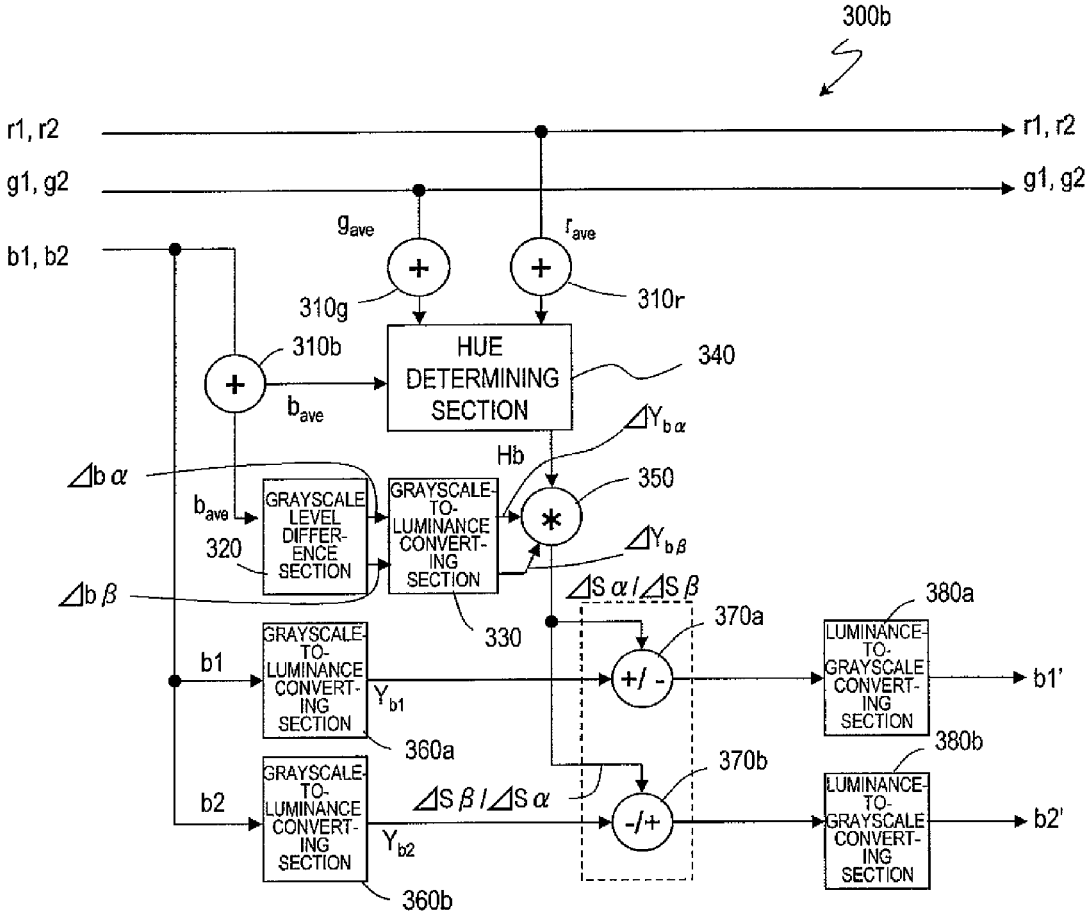
FIG. 8 is a schematic representation illustrating a configuration for a blue correcting section in the liquid crystal display device shown in FIG. 1.

Hereinafter, the blue correcting section 300*b* will be described with reference to FIGS. 8 and 9. FIG. 8 is a schematic representation illustrating the configuration of the blue correcting section 300*b*. In FIG. 8, the grayscale levels r1, g1 and b1 are indicated by the input signal for the respective subpixels R1, G1 and B1 of the pixel P1 shown in FIGS. 7(*a*) and 7(*b*), while the grayscale levels r2, g2 and b2 are indicated by the input signal for the respective subpixels R2, G2 and B2 of the pixel P2. The red correcting section 300*r* for correcting the grayscale levels r1 and r2 and the green correcting section 300*g* for correcting the grayscale levels g1 and g2 have the same configuration as this blue correcting section 300*b* and description thereof will be omitted herein.

First of all, the average of the grayscale levels b1 and b2 is calculated by using an adding section 310*b*. In the following description, the average of the grayscale levels b1 and b2 will be referred to herein as an average grayscale level $b_{ave}$. Next, a grayscale level difference section 320 calculates two grayscale level differences Δbα and Δbβ with respect to the single average grayscale level $b_{ave}$. The grayscale level differences Δbα and Δbβ are associated with a bright blue subpixel and a dark blue subpixel, respectively.

In this manner, the grayscale level difference section 320 calculates two grayscale level differences Δbα and Δbβ with respect to the single average grayscale level $b_{ave}$. In this case, the average grayscale level $b_{ave}$ and the grayscale level differences Δbα and Δbβ may satisfy the predetermined relation shown in FIG. 9(*a*), for example. As the average grayscale level $b_{ave}$ increases from a low grayscale toward a predetermined middle grayscale, the grayscale level differences Δbα and Δbβ both increase. On the other hand, as the average grayscale level $b_{ave}$ increases from the predetermined middle grayscale toward a high grayscale, the grayscale level differences Δbα and Δbβ both decrease. The grayscale level difference section 320 may determine the grayscale level differences Δbα and Δbβ with respect to the average grayscale level $b_{ave}$ by reference to a lookup table. Alternatively, the grayscale level difference section 320 may also determine the grayscale level differences Δbα and Δbβ by performing predetermined computations on the average grayscale level $b_{ave}$.

Next, a grayscale-to-luminance converting section 330 converts the grayscale level differences $\Delta b\alpha$ and $\Delta b\beta$ into luminance level differences $\Delta Y_b\alpha$ and $\Delta Y_b\beta$, respectively. In this case, the greater the luminance level difference $\Delta Y_b\alpha$, $\Delta Y_b\beta$, the greater the magnitude of shift $\Delta S\alpha$, $\Delta S\beta$. Ideally, the magnitude of shift $\Delta S\alpha$ is equal to the magnitude of shift $\Delta S\beta$. That is why the grayscale level difference section 320 may give only one of the grayscale level differences $\Delta b\alpha$ and $\Delta b\beta$ to calculate only one of the magnitudes of shift $\Delta S\alpha$ and $\Delta S\beta$.

Meanwhile, the average of the grayscale levels r1 and r2 is calculated by another adding section 310*r* and that of the grayscale levels g1 and g2 is calculated by still another adding section 310*g*. In the following description, the average of the grayscale levels r1 and r2 will be referred to herein as an average grayscale level $r_{ave}$ and that of the grayscale levels g1 and g2 will be referred to herein as an average grayscale level $g_{ave}$.

The hue determining section 340 determines the hue of the color represented by the input signal. Specifically, the hue determining section 340 determines the hue by using average grayscale levels $r_{ave}$, $g_{ave}$ and $b_{ave}$. For example, if one of $r_{ave}>b_{ave}$, $g_{ave}>b_{ave}$ and $b_{ave}=0$ is satisfied, then the hue determining section 340 determines that the hue is not blue. Also, if $b_{ave}>0$ and $r_{ave}=g_{ave}=0$ are satisfied, then the hue determining section 340 determines that the hue is blue.

For example, the hue determining section 340 determines the hue coefficient Hb using the average grayscale levels $r_{ave}$, $g_{ave}$ and $b_{ave}$. The hue coefficient Hb is a function that varies according to the hue. Specifically, the hue coefficient Hb is a function that decreases as the blue component of the color to represent increases. Supposing function Max is a function representing the highest one of multiple variables, function Second is a function representing the second highest one of the multiple variables, M=MAX ($r_{ave}$, $g_{ave}$, $b_{ave}$) and S=Second ($r_{ave}$, $g_{ave}$, $b_{ave}$), the hue coefficient Hb can be represented as Hb=S/M ($b_{ave}\geq r_{ave}$, $b_{ave}\geq r_{ave}$ and $b_{ave}>0$). More specifically, if $b_{ave}\geq g_{ave}\geq r_{ave}$ and $b_{ave}>0$, then $Hb=g_{ave}/b_{ave}$. Also, if $b_{ave}\geq r_{ave}\geq g_{ave}$ and $b_{ave}>0$, then $Hb=r_{ave}/b_{ave}$. Furthermore, if at least one of $b_{ave}<r_{ave}$, $b_{ave}<g_{ave}$ and $b_{ave}=0$ is satisfied, then Hb=1.

Next, the magnitudes of shift $\Delta S\alpha$ and $\Delta S\beta$ are calculated. In this case, the magnitude of shift $\Delta S\alpha$ is obtained as the product of $\Delta Y_b\alpha$ and the hue coefficient Hb, while the magnitude of shift $\Delta S\beta$ is obtained as the product of $\Delta Y_b\beta$ and the hue coefficient Hb. A multiplying section 350 multiplies the luminance level differences $\Delta Y_b\alpha$ and $\Delta Y_b\beta$ by the hue coefficient Hb, thereby obtaining the magnitudes of shift $\Delta S\alpha$ and $\Delta S\beta$.

Meanwhile, a grayscale-to-luminance converting section 360*a* carries out a grayscale-to-luminance conversion on the grayscale level b1, thereby obtaining a luminance level $Y_{b1}$, which can be calculated by the following equation:

$$Y_{b1}=b1^{2.2} \text{ (where } 0\leq b1\leq 1)$$

In the same way, another grayscale-to-luminance converting section 360*b* carries out a grayscale-to-luminance conversion on the grayscale level b2, thereby obtaining a luminance level $Y_{b2}$.

Next, an adding and subtracting section 370*a* adds the luminance level $Y_{b1}$ and the magnitude of shift $\Delta S\alpha$ together, and then the sum is subjected to luminance-to-grayscale conversion by a luminance-to-grayscale converting section 380*a*, thereby obtaining a grayscale level b1'. On the other hand, another adding and subtracting section 370*b* subtracts the magnitude of shift $\Delta S\beta$ from the luminance level $Y_{b2}$, and then the remainder is subjected to luminance-to-grayscale conversion by another luminance-to-grayscale converting section 380*b*, thereby obtaining a grayscale level b2'. In general, if the input signal indicates that a pixel should represent an achromatic color at a middle grayscale, then the grayscale levels r, g and b indicated by the input signal are equal to each other. Consequently, in this LCD panel 200A, the luminance level $Y_{b1}'$ is higher than the luminance levels $Y_r$ and $Y_g$ but the luminance level $Y_{b2}'$ is lower than the luminance levels $Y_r$ and $Y_g$. Also, the average of the luminance levels $Y_{b1}'$ and $Y_{b2}'$ is almost equal to the luminance levels $Y_r$ and $Y_g$.

Figure 9:
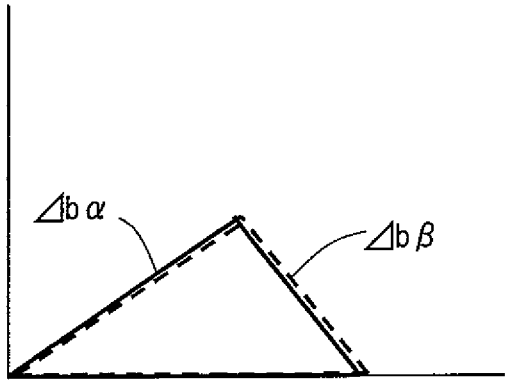
FIG. 9(*a*) is a graph showing the grayscale level difference and FIG. 9(*b*) is a graph showing the grayscale level to be input to an LCD panel.
Figure 9:
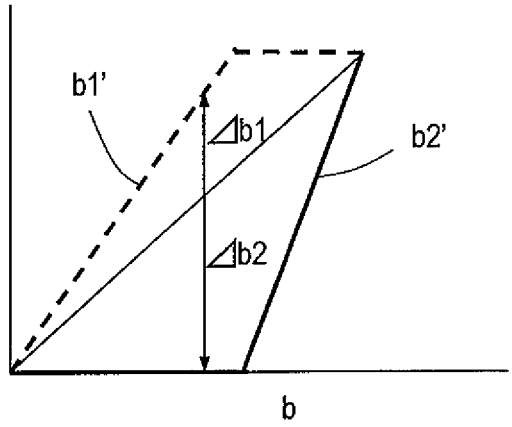

FIG. 9(*b*) shows a relation between the grayscale level of a blue subpixel as indicated by the input signal and that of the blue subpixel to be entered into the LCD panel 200A. In this case, the input signal indicates that an achromatic color should be represented and the hue coefficient Hb may be equal to one, for example. As the grayscale level difference section 320 gives the grayscale level differences $\Delta b\alpha$ and $\Delta b\beta$, the grayscale level b1' is given by b1+$\Delta$b1 and the grayscale level b2' is given by b2−$\Delta$b2. As described above, using the grayscale levels b1' and b2', the blue subpixel B1 comes to have a luminance corresponding to the sum of the luminance level $Y_{b1}$ and the magnitude of shift $\Delta S\alpha$ and the blue subpixel B2 comes to have a luminance corresponding to the difference between the luminance level $Y_{b2}$ and the magnitude of shift $\Delta S\beta$.

In this manner, the grayscale levels b1 and b2 of the blue subpixels are changed based on the decision made by the hue determining section 340. If the hue determining section 340 has determined that the hue is not blue, the grayscale levels b1 and b2 of the blue subpixels are changed into different grayscale levels so that their relative luminance as viewed obliquely becomes closer to their relative luminance as viewed straight on. On the other hand, if the hue coefficient Hb is zero, the grayscale levels b1 and b2 of the blue subpixels as indicated by the input signal are output as the grayscale levels b1' and b2'.

Thus, if the hue determining section 340 has determined that the hue is blue, the grayscale levels b1 and b2 of the blue subpixels are output as they are without being changed. In that case, the grayscale level b1 is equal to the grayscale level b2. In the LCD panel 200A, the average straight viewing luminance corresponding to the grayscale levels b1' and b2' is substantially equal to the one corresponding to the grayscale levels b1 and b2.

As described above, the magnitudes of shift $\Delta S\alpha$ and $\Delta S\beta$ are represented by a function that includes the hue coefficient Hb as a parameter and change as the hue coefficient Hb varies.

Figure 10:
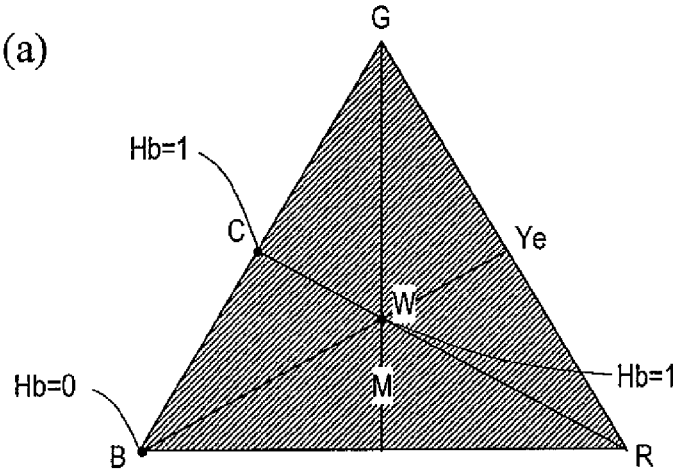
FIG. 10(*a*) is a schematic representation illustrating the hue of the LCD panel of the liquid crystal display device shown in FIG. 1, and FIGS. 10(*b*) and 10(*c*) are graphs showing how the grayscale level of a blue subpixel changes in one situation and in a different situation, respectively.
Figure 10:
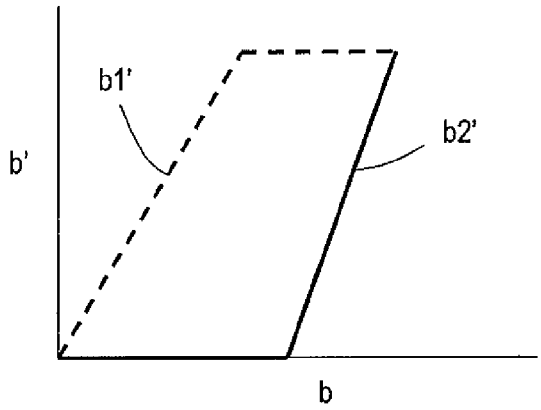
Figure 10:
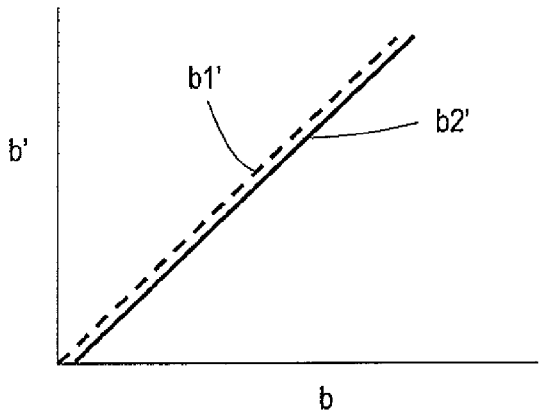

Hereinafter, it will be described with reference to FIG. 10 how the blue correcting section 300*b* changes the hue coefficient. FIG. 10(*a*) is a schematic hue diagram and represents the color reproduction range of the LCD panel 200A as a regular triangle. For example, if the grayscale level as indicated by the input signal satisfies $r_{ave}=g_{ave}=b_{ave}$, the hue coefficient Hb becomes one. Likewise, if the grayscale level as indicated by the input signal satisfies $0=r_{ave}<g_{ave}=b_{ave}$, then the hue coefficient Hb also becomes one. On the other hand, if $0=r_{ave}=g_{ave}<b_{ave}$, then the hue coefficient Hb becomes zero.

FIG. 10(*b*) shows a relation between the grayscale level b as indicated by the input signal and the corrected grayscale level b' of the blue subpixel in a situation where the hue coefficient Hb=1. In this case, the grayscale level b1' indicates that of the bright blue subpixel of one of two adjacent pixels (e.g., the blue subpixel B1 of the pixel P1 shown in FIGS. 7(*a*) and 7(*b*)), while the grayscale level b2' indicates that of the dark blue subpixel of the other pixel (e.g., the blue subpixel B2 of the pixel P2 shown in FIGS. 7(*a*) and 7(*b*)).

As the grayscale level b increases, the grayscale level b1' increases but the grayscale level b2' remains zero when the grayscale level b is relatively low. But once the grayscale level b1' has reached the highest grayscale level with the increase in the grayscale level b, the grayscale level b2' starts to increase soon. As can be seen, unless the grayscale level b is the lowest grayscale level or the highest grayscale level, the grayscale level b1' is different from the grayscale level b2'. By having the correcting section 300A make such a correction, the viewing angle characteristic as viewed obliquely can be improved.

FIG. 10(*c*) shows a relation between the grayscale level b as indicated by the input signal and the corrected grayscale level b' of the blue subpixel when the hue coefficient Hb=0. In a situation where the hue of the color indicated by the input signal is on the line WB shown in FIG. 10(*a*), if the blue correcting section 300*b* shown in FIG. 1(*a*) has made a correction, the viewer may sense that the luminance of the bright blue subpixel belonging to one pixel is different from that of the dark blue subpixel belonging to the other pixel. That is why the blue correcting section 300*b* does not make any correction. In that case, the grayscale levels b1' and b2' of the respective blue subpixels of one of two adjacent pixels (e.g., the pixel P1 shown in FIGS. 7(*a*) and 7(*b*)) and the other pixel (e.g., the pixel P2 shown in FIGS. 7(*a*) and 7(*b*)) are equal to the grayscale level b as indicated by the input signal.

For example, if the grayscale levels ($r_{ave}$, $g_{ave}$, $b_{ave}$) of red, green and blue subpixels are (128, 128, 128) with respect to the highest grayscale level of 255, the hue coefficient Hb is one, and therefore, the magnitudes of shift $\Delta S\alpha$ and $\Delta S\beta$ become $\Delta Y_b\alpha$ and $\Delta Y_b\beta$, respectively. On the other hand, if ($r_{ave}$, $g_{ave}$, $b_{ave}$) are (0, 0, 128), the hue coefficient Hb becomes zero, and therefore, the magnitudes of shift $\Delta S\alpha$ and $\Delta S\beta$ become zero. Furthermore, if ($r_{ave}$, $g_{ave}$, $b_{ave}$) are (64, 64, 128), which are halfway between these two situations, then Hb=0.5, and the magnitudes of shift $\Delta S\alpha$ and $\Delta S\beta$ become $0.5\times\Delta Y_b\alpha$ and $0.5\times\Delta Y_b\beta$, respectively, which are half as large as when Hb=1.0. In this manner, the magnitudes of shift $\Delta S\alpha$ and $\Delta S\beta$ change continuously according to the hue indicated by the input signal, and a sudden change of the display characteristic can be minimized. As described above, the blue correcting section 300*b* changes the magnitude of shift according to the color indicated by the input signal. As a result, not only can the viewing angle characteristic be improved but also can the decrease in resolution be minimized as well. In the blue correcting section 300*b* shown in FIG. 8, the grayscale level section 320 calculates a grayscale level difference corresponding to the average grayscale level $b_{ave}$, and the magnitude of shift can be changed easily according to the hue by using the grayscale level difference. FIG. 9(*b*) is a graph showing a result obtained when the hue coefficient Hb is one. If the hue coefficient Hb is zero, on the other hand, then the grayscale level b1(=b2) as indicated by the input signal becomes equal to the output grayscale levels b1' and b2'.

Thus, the liquid crystal display device 100A of this preferred embodiment can minimize the color shift by changing the hue coefficient Hb in this manner. As for the relation between the hue coefficients and the liquid crystal display devices of Comparative Examples 1 and 2, the hue coefficient Hb=0 is associated with the liquid crystal display device of Comparative Example 1, while the hue coefficient Hb=1 is associated with the liquid crystal display device of Comparative Example 2.

Figure 11:
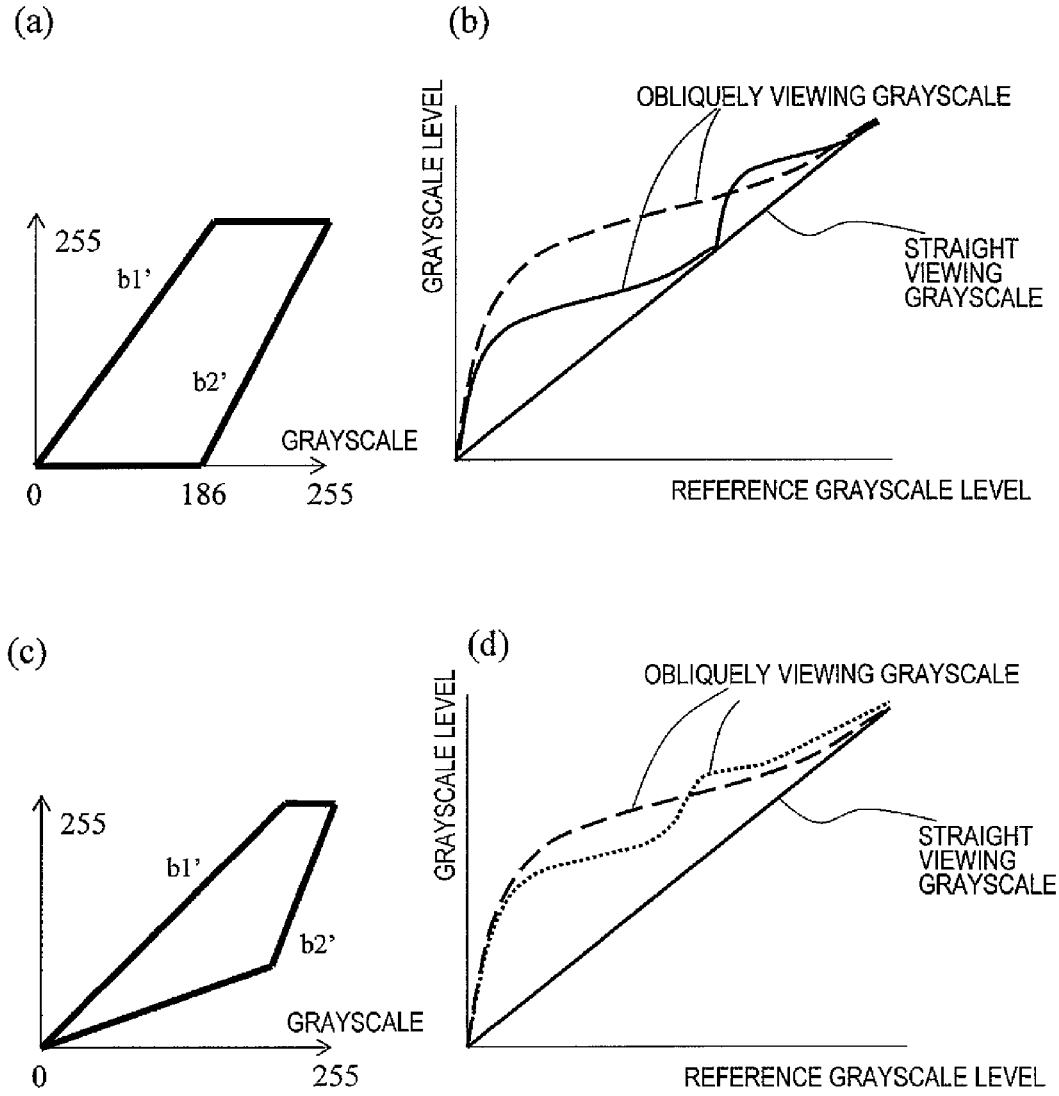
FIGS. 11(*a*) and 11(*b*) are graphs showing the corrected grayscale level and a variation in obliquely viewing grayscale in a situation where the hue coefficient Hb=1, and FIGS. 11(*c*) and 11(*d*) are graphs showing the corrected grayscale level and a variation in obliquely viewing grayscale in a situation where the hue coefficient Hb=0.5.

Hereinafter, it will be described with reference to FIG. 11 how the obliquely viewing grayscale changes with the hue coefficient Hb. FIG. 11(*a*) shows a relation between the grayscale level (i.e., reference grayscale level) b of a blue subpixel as indicated by the input signal and corrected grayscale levels b1' and b2' thereof when the hue coefficient Hb is one. For example, if the grayscale level b is grayscale level 186(=$0.5^{1/2.2}\times255$) that corresponds to a half of the highest luminance, then the corrected grayscale levels b1' and b2' are grayscale levels 255 and 0, respectively. On the other hand, if the grayscale level b exceeds 186, then the grayscale level b1' becomes 255 and the grayscale level b2' increases so that the average luminance of the blue subpixels B1 and B2 corresponds to the grayscale level b. FIG. 11(*b*) shows how the obliquely viewing grayscale changes with the reference grayscale level. In FIG. 11(*b*), the obliquely viewing grayscale obtained by correcting the grayscale level with a hue coefficient Hb=1 is indicated by the solid curve, and the obliquely viewing grayscale when the grayscale level is not corrected (i.e., when the hue coefficient Hb=0) is indicated by the dashed curve for your reference. As can be seen from FIG. 11(*b*), by correcting the grayscale level with the hue coefficient Hb=1, the whitening phenomenon can be reduced significantly. FIG. 11(*b*) corresponds to FIG. 6(*c*).

On the other hand, FIG. 11(*c*) shows a relation between the grayscale level (i.e., reference grayscale level) b of a blue subpixel as indicated by the input signal and corrected grayscale levels b1' and b2' thereof when the hue coefficient Hb is 0.5. In this case, as the grayscale level b increases, not only the grayscale level b1' but also the grayscale level b2' increase as well. However, the grayscale level b1' is greater than the grayscale level b2'. Also, the grayscale levels b1' and b2' are proportional to the grayscale level b.

If the hue coefficient Hb is 0.5, the grayscale level b when the grayscale level b1' reaches the highest grayscale level 255 is greater than 186. Once the grayscale level b1' has reached the highest grayscale level 255, the grayscale level b2' starts to increase at an even higher rate so that the average luminance of the blue subpixels B1 and B2 corresponds to the grayscale level b. FIG. 11(*d*) shows how the obliquely viewing grayscale changes with the reference grayscale level. In FIG. 11(*d*), the obliquely viewing grayscale obtained by correcting the grayscale level with a hue coefficient Hb=0.5 is indicated by the dotted curve, and the obliquely viewing grayscale when the grayscale level is not corrected (i.e., when the hue coefficient Hb=0) is indicated by the dashed curve for your reference. As can be seen from FIG. 11(*d*), by correcting the grayscale level with the hue coefficient Hb=0.5, the whitening phenomenon can be reduced to a certain degree. FIG. 11(*d*) corresponds to FIG. 7(*c*). In conclusion, it can be said that by changing the hue coefficient Hb within the range of 0 to 1, the obliquely viewing grayscale of the liquid crystal display device 100A can be an arbitrary value between those of the liquid crystal display devices of Comparative Examples 1 and 2 as can be seen from FIGS. 7(*c*), 11(*b*) and 11(*d*).

Although the configuration of the blue correcting section 300*b* has been described, the red correcting section 300*r* and the green correcting section 300*g* also have a similar configuration. In the red correcting section 300*r*, for example, the hue determining section 340 also determines the hue of the color indicated by the input signal. Specifically, the hue determining section 340 determines a hue coefficient Hr by using the average grayscale levels $r_{ave}$, $g_{ave}$ and $b_{ave}$. The hue coefficient Hr is a function that varies according to the hue. The hue coefficient Hr can be represented as Hr=S/M ($r_{ave}\geq g_{ave}$, $r_{ave}\geq b_{ave}$ and $r_{ave}>0$). Specifically, if $r_{ave}\geq g_{ave}\geq b_{ave}$ and $r_{ave}>0$, then $Hr=g_{ave}/r_{ave}$. Also, if $r_{ave}\geq b_{ave}\geq g_{ave}$ and $r_{ave}>0$, then $Hr=b_{ave}/r_{ave}$. Furthermore, if at least one of $r_{ave}<b_{ave}$, $r_{ave}<b_{ave}$ and $r_{ave}=0$ is satisfied, then Hr=1.

Likewise, in the green correcting section 300*g*, the hue determining section 340 also determines the hue of the color indicated by the input signal. The hue determining section 340 determines a hue coefficient Hg by using the average grayscale levels $r_{ave}$, $g_{ave}$ and $b_{ave}$. The hue coefficient Hg is a function that varies according to the hue. The hue coefficient Hg can be represented as Hg=S/M ($g_{ave} \geq r_{ave}$, $g_{ave} \geq b_{ave}$ and $g_{ave}>0$). Specifically, if $g_{ave} \geq r_{ave} \geq b_{ave}$ and $g_{ave}>0$, then $Hg=r_{ave}/g_{ave}$. Also, if $g_{ave} \geq b_{ave} \geq r_{ave}$ and $g_{ave}>0$, then $Hg=b_{ave}/g_{ave}$. Furthermore, if at least one of $g_{ave}<r_{ave}$, $g_{ave}<b_{ave}$ and $g_{ave}=0$ is satisfied, then Hg=1.

As described above, in the correcting section 300A, the red, green and blue correcting sections 300*r*, 300*g* and 300*b* make corrections using the hue coefficients Hr, Hg and Hb, respectively. If the grayscale levels of red, green and blue subpixels as indicated by the input signal satisfy $r_{ave}=g_{ave}=b_{ave}=0$, corrections are made on the grayscale levels of all of the red, green and blue subpixels. However, if the grayscale levels of red, green and blue subpixels as indicated by the input signal satisfy $r_{ave}=g_{ave}=h_{ave}=0$, correction is not made on the grayscale level of any of the red, green and blue subpixels. Furthermore, if the grayscale levels of red, green and blue subpixels as indicated by the input signal satisfy $r_{ave}=g_{ave}>b_{ave} \neq 0$, corrections are made on the grayscale levels of all of the red, green and blue subpixels. Also, if the grayscale levels of the red, green and blue subpixels satisfy $r_{ave}=g_{ave}>b_{ave}=0$, corrections are made on the grayscale levels of the red and green subpixels. Furthermore, if the grayscale levels of red, green and blue subpixels as indicated by the input signal satisfy $0 \neq r_{ave}=g_{ave}<b_{ave}$, corrections are made on the grayscale levels of all of the red, green and blue subpixels. On the other hand, if the grayscale levels of red, green and blue subpixels as indicated by the input signal satisfy $0=r_{ave}=g_{ave}<b_{ave}$, corrections are not made on the grayscale level of any of the red, green and blue subpixels. As can be seen, if at least two of the grayscale levels of red, green and blue subpixels as indicated by the input signal are not equal to zero, at least one of the red, green and blue correcting sections 300*r*, 300*g* and 300*b* makes a correction.

Figure 12:
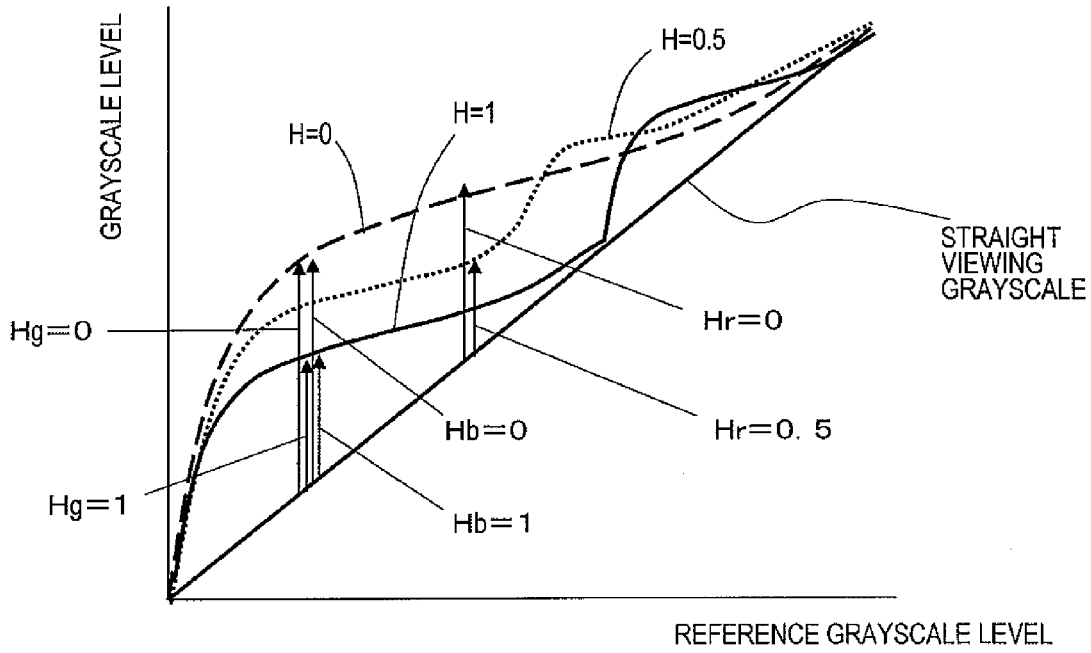
FIG. 12 is a graph showing how the obliquely viewing grayscale changes with the reference grayscale level in the liquid crystal display device shown in FIG. 1.

For example, if $r_{ave}>g_{ave}=b_{ave}>0$, then the hue coefficient Hr=S/M and the hue coefficients Hg and Hb are one. Specifically, if ($r_{ave}$, $g_{ave}$, $b_{ave}$)=(100, 50, 50), the hue coefficients Hr, Hg and Hb become 0.5, 1 and 1 as shown in FIG. 12. As a result, the difference in grayscale level between the respective subpixels can be almost ironed out and the chromaticity difference can be minimized.

The following Table 4 shows the average grayscale level of red subpixels (with the grayscale levels of bright and dark red subpixels) and the hue coefficient Hr, that of green subpixels (with the grayscale levels of bright and dark green subpixels) and the hue coefficient Hg, that of blue subpixels (with the grayscale levels of bright and dark blue subpixels) and the hue coefficient Hb, viewing angle directions, chromaticity coordinates x and y, luminances Y and chromaticity differences Δu'v'.

TABLE 4

| R | | Hr | G | | Hg | B | | Hb | Viewing angle direction | x | y | Y | Δu'v' |
|---|---|---|---|---|---|---|---|---|---|---|---|---|---|
| 100 | | | 50 | | | 50 | | | Straight | 0.446 | 0.309 | 0.050 | — |
| 100 | 100 | 0 | 50 | 50 | 0 | 50 | 50 | 0 | Obliquely 60° | 0.318 | 0.278 | 0.176 | 0.092 |
| 120 | 73 | 0.5 | 69 | 0 | 1 | 69 | 0 | 1 | Obliquely 60° | 0.376 | 0.290 | 0.139 | 0.050 |

In the same way, if $g_{ave}>r_{ave}=b_{ave}>0$ (e.g., if ($r_{ave}$, $g_{ave}$, $b_{ave}$)=(50, 100, 50)), the chromaticity difference can be minimized by setting the hue coefficients Hr, Hg and Hb to be 1, 0.5 and 1, respectively. Also, if $b_{ave>rave}=g_{ave}>0$ (e.g., if ($r_{ave}$, $g_{ave}$, $b_{ave}$)=(50, 50, 100)), the chromaticity difference can be minimized by setting the hue coefficients Hr, Hg and Hb to be 1, 1, and 0.5, respectively. In this manner, by using the functions Max and Second, the color shift can be reduced easily. As described above, the liquid crystal display device 100A of this preferred embodiment includes the red, green and blue correcting sections 300*r*, 300*g* and 300*b* and controls the luminances of the respective subpixels based on the grayscale levels of red, green and blue subpixels, thereby improving the viewing angle characteristic and minimizing the color shift at the same time.

In the foregoing description, the hue coefficients Hr, Hg and Hb for use in the red, green and blue correcting sections 300*r*, 300*g* and 300*b*, respectively, are continuously variable within the range of zero to one. For example, if MAX ($r_{ave}$, $g_{ave}$, $b_{ave}$)=$b_{ave}$, then the hue coefficient Hb can be represented as Hb=SECOND ($r_{ave}$, $g_{ave}$, $b_{ave}$)/MAX ($r_{ave}$, $g_{ave}$, $b_{ave}$). However, this is only an example of the present invention. Optionally, at least one of the hue coefficients Hr, Hg and Hb may be binarized. For example, if the hue coefficient Hb is binarized into zero or one, at least one of the hue coefficients Hr and Hg of the red and green correcting sections 300*r* and 300*g* may be variable within the range of zero to one.

Alternatively, at least one of the hue coefficients Hr, Hg and Hb may be fixed at one. For example, the hue coefficient Hb may be fixed at one, while at least one of the hue coefficients Hr and Hg for use in the red and green correcting sections 300*r* and 300*g* may vary within the range of zero to one.

Still alternatively, the hue coefficient Hb may have a binarized value of zero or one according to the hue, while the hue coefficients Hr and Hg may be fixed at zero.

Hereinafter, a relation between the hue of the color represented by a pixel and the hue coefficient Hb will be described with reference to FIG. 13 and Table 5. In the following example, the hue coefficient Hb is variable in the blue correcting section 300*b* into zero or one according to the hue, but the hue coefficients Hr and Hg are fixed at zero in the red and green correcting sections 300*r* and 300*g*.

Figure 13:
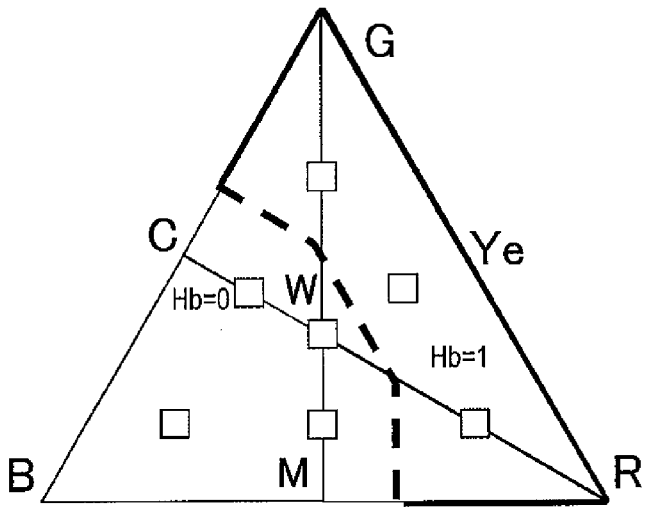
FIG. 13(*a*) is a schematic representation illustrating the hue of the LCD panel of the liquid crystal display device shown in FIG. 1 in a situation where the grayscale level of a blue subpixel is corrected and FIGS. 13(*b*) and 13(*c*) are graphs showing how the grayscale level of the blue subpixel changes when the hue coefficient Hb=0 and when the hue coefficient Hb=1, respectively.
Figure 13:
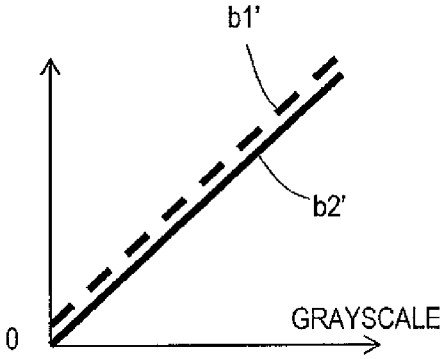
Figure 13:
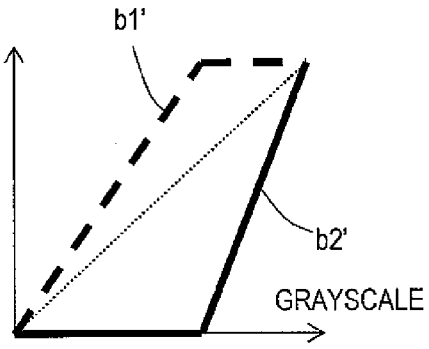

FIG. 13(*a*) schematically illustrates the hues of the LCD panel 200A. As shown in FIG. 13(*a*), the hue coefficient Hb varies with the hue.

If the input signal indicates that a pixel should represent the color blue, the chromaticity difference when the hue coefficient Hb is zero is smaller than the one when the hue coefficient Hb is one. On the other hand, if the input signal indicates that a pixel should represent the color magenta or cyan, the chromaticity difference when the hue coefficient Hb is zero is also smaller than the one when the hue coefficient Hb is one. That is why if the input signal indicates that a pixel should represent the color blue, magenta or cyan, the hue coefficient Hb becomes equal to zero. For example, if the average grayscale levels ($r_{ave}$, $g_{ave}$, $b_{ave}$) of red, green and blue subpixels are (64, 64, 128), (128, 64, 128) or (64, 128, 128), then the hue coefficient Hb becomes equal to zero. FIG. 13(*b*) shows how the grayscale levels b1' and b2' change if the hue coefficient Hb is equal to zero. In that case, the grayscale level b1' is equal to the grayscale level b2'. By setting the hue coefficient Hb to be zero in this manner if a pixel should represent the color blue, magenta or cyan, the chromaticity difference Δu'v' can be minimized.

On the other hand, if the input signal indicates that a pixel should represent the color red, the chromaticity difference when the hue coefficient Hb is one is smaller than the one when the hue coefficient Hb is zero. On the other hand, if the input signal indicates that a pixel should represent the color yellow or green, the chromaticity difference when the hue coefficient Hb is one is also smaller than the one when the hue coefficient Hb is zero. That is why if the input signal indicates that a pixel should represent the color red, yellow or green, the hue coefficient Hb becomes equal to one. For example, if the average grayscale levels ($r_{ave}$, $g_{ave}$, $b_{ave}$) of red, green and blue subpixels are (255, 128, 128), (255, 255, 128) or (128, 255, 128), then the hue coefficient Hb becomes equal to one. FIG. 13(*c*) shows how the grayscale levels b1' and b2' change if the hue coefficient Hb is equal to one. In that case, the grayscale level b1' is different from the grayscale level b2'. By setting the hue coefficient Hb to be one this manner if a pixel should represent the color red, yellow or green, the chromaticity difference Δu'v' can be minimized.

For example, if the average grayscale level $b_{ave}$ is equal to MAX ($r_{ave}$, $g_{ave}$, $b_{ave}$) and if the difference between MAX ($r_{ave}$, $g_{ave}$, $b_{ave}$) and $b_{ave}$ is smaller than a predetermined value, then the hue coefficient Hb may be set to be zero. On the other hand, if the average grayscale level $b_{ave}$ is smaller than MAX ($r_{ave}$, $g_{ave}$, $b_{ave}$) and if the difference between MAX ($r_{ave}$, $g_{ave}$, $b_{ave}$) and $b_{ave}$ is greater than the predetermined value, then the hue coefficient Hb may be set to be one.

The following Table 5 shows the colors to be represented by a pixel, the average grayscale levels of red and green subpixels, the average grayscale levels of blue subpixels (with the grayscale levels of bright and dark blue subpixels), the hue coefficient Hb, viewing angle directions, chromaticity coordinates x and y, luminances Y and chromaticity differences Δu'v'. In this case, the average grayscale level $b_{ave}$ of the input signal is 128. If the hue coefficient Hb is zero, then the grayscale levels of the bright and dark blue subpixels both become 128. On the other hand, if the hue coefficient Hb is one, the grayscale levels of the bright and dark blue subpixels become 175(=$(2\times(128/255)^{2.2})^{1/2.2}\times255$) and 0, respectively.

TABLE 5

| | R | G | B | | Hb | Viewing angle direction | x | y | Y | Δ u'v' |
|---|---|---|---|---|---|---|---|---|---|---|
| Blue | 64 | 64 | 128 | | | Straight | 0.197 | 0.158 | 0.069 | — |
| | | | 128 | 128 | 0 | Obliquely 60° | 0.233 | 0.216 | 0.203 | 0.063 |
| | | | 175 | 0 | 1 | Obliquely 60° | 0.259 | 0.260 | 0.190 | 0.102 |
| Magenta | 128 | 64 | 128 | | | Straight | 0.296 | 0.194 | 0.107 | — |
| | | | 128 | 128 | 0 | Obliquely 60° | 0.294 | 0.231 | 0.253 | 0.040 |
| | | | 175 | 0 | 1 | Obliquely 60° | 0.331 | 0.271 | 0.240 | 0.070 |
| Red | 255 | 128 | 128 | | | Straight | 0.445 | 0.309 | 0.394 | — |
| | | | 128 | 128 | 0 | Obliquely 60° | 0.388 | 0.303 | 0.539 | 0.043 |
| | | | 175 | 0 | 1 | Obliquely 60° | 0.422 | 0.336 | 0.525 | 0.035 |
| Yellow | 255 | 255 | 128 | | | Straight | 0.377 | 0.429 | 0.905 | — |
| | | | 128 | 128 | 0 | Obliquely 60° | 0.358 | 0.387 | 0.932 | 0.019 |
| | | | 175 | 0 | 1 | Obliquely 60° | 0.379 | 0.419 | 0.919 | 0.006 |
| Green | 128 | 255 | 128 | | | Straight | 0.281 | 0.465 | 0.730 | — |
| | | | 128 | 128 | 0 | Obliquely 60° | 0.285 | 0.402 | 0.784 | 0.028 |
| | | | 175 | 0 | 1 | Obliquely 60° | 0.302 | 0.444 | 0.770 | 0.017 |
| Cyan | 64 | 128 | 128 | | | Straight | 0.219 | 0.293 | 0.181 | — |
| | | | 128 | 128 | 0 | Obliquely 60° | 0.240 | 0.292 | 0.340 | 0.015 |
| | | | 175 | 0 | 1 | Obliquely 60° | 0.262 | 0.344 | 0.326 | 0.038 |

By changing the hue coefficient Hb according to the hue of the color to be represented by a pixel in this manner, the color shift can be minimized.

In the example described above, the hue coefficients Hr and Hg are fixed at zero in the red and green correcting sections 300*r* and 300*g*, while the hue coefficient Hb changes into zero or one according to the hue in the blue correcting section 300*b*. However, the present invention is in no way limited to that specific preferred embodiment. Alternatively, the hue coefficients Hg and Hb may be fixed at zero in the green and blue correcting sections 300*g* and 300*b*, while the hue coefficient Hr may change into zero or one according to the hue in the red correcting section 300*r*.

Hereinafter, a relation between the hue of the color represented by a pixel and the hue coefficient Hr will be described with reference to FIG. 14 and Table 6.

Figure 14:
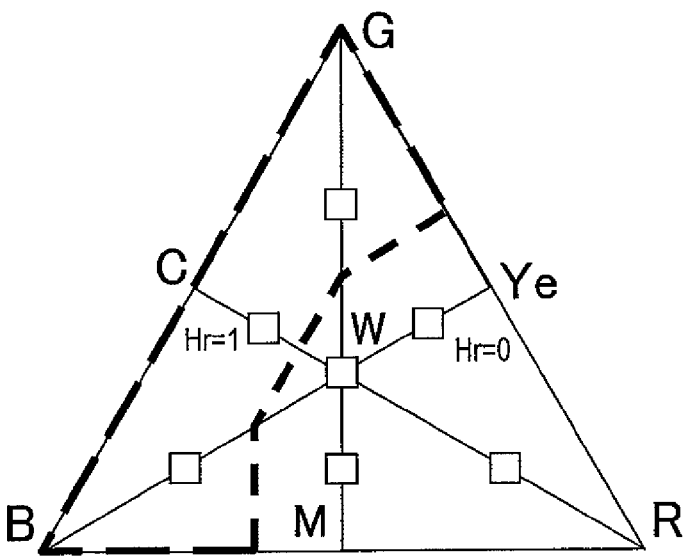
FIG. 14(*a*) is a schematic representation illustrating the hue of the LCD panel of the liquid crystal display device shown in FIG. 1 in a situation where the grayscale level of a red subpixel is corrected and FIGS. 14(*b*) and 14(*c*) are graphs showing how the grayscale level of the red subpixel changes when the hue coefficient Hr=0 and when the hue coefficient Hr=1, respectively.
Figure 14:
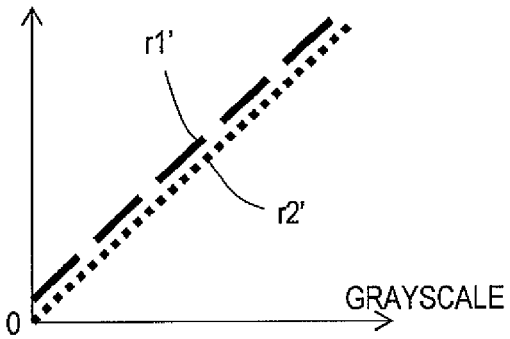
Figure 14:
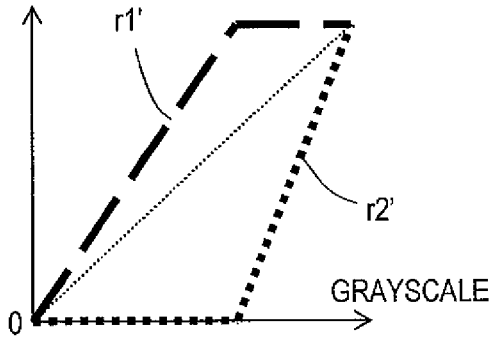

FIG. 14(*a*) schematically illustrates the hues of the LCD panel 200A. As shown in FIG. 14(*a*), the hue coefficient Hr varies with the hue.

If the input signal indicates that a pixel should represent the color red, the chromaticity difference when the hue coefficient Hr is zero is smaller than the one when the hue coefficient Hr is one. On the other hand, if the input signal indicates that a pixel should represent the color magenta or yellow, the chromaticity difference when the hue coefficient Hr is zero is also smaller than the one when the hue coefficient Hr is one. That is why if the input signal indicates that a pixel should represent the color red, magenta or yellow, the hue coefficient Hr becomes equal to zero. For example, if the average grayscale levels ($r_{ave}$, $g_{ave}$, $b_{ave}$) of red, green and blue subpixels are (128, 64, 64), (128, 64, 128) or (128, 128, 64), then the hue coefficient Hr becomes equal to zero. FIG. 14(*b*) shows how the grayscale levels r1' and r2' change if the hue coefficient Hr is equal to zero. In that case, the grayscale level r1' is equal to the grayscale level r2'. By setting the hue coefficient Hr to be zero in this manner if a pixel should represent the color red, magenta or yellow, the chromaticity difference Δu'v' can be minimized.

On the other hand, if the input signal indicates that a pixel should represent the color blue, the chromaticity difference when the hue coefficient Hr is one is smaller than the one when the hue coefficient Hr is zero. On the other hand, if the input signal indicates that a pixel should represent the color green or cyan, the chromaticity difference when the hue coefficient Hr is one is also smaller than the one when the hue coefficient Hr is zero. That is why if the input signal indicates that a pixel should represent the color blue, green or cyan, the hue coefficient Hr becomes equal to one. For example, if the average grayscale levels ($r_{ave}$, $g_{ave}$, $b_{ave}$) of red, green and blue subpixels are (128, 128, 255), (128, 255, 128) or (128, 255, 255), then the hue coefficient Hr becomes equal to one. FIG. 14(*c*) shows how the grayscale levels r1' and r2' change if the hue coefficient Hr is equal to one. In that case, the grayscale level r1' is different from the grayscale level r2'. By setting the hue coefficient Hr to be one this manner if a pixel should represent the color blue, green or cyan, the chromaticity difference Δu'v' can be minimized.

For example, if the average grayscale level $r_{ave}$ is equal to MAX ($r_{ave}$, $g_{ave}$, $b_{ave}$) and if the difference between MAX ($r_{ave}$, $g_{ave}$, $b_{ave}$) and $r_{ave}$ is smaller than a predetermined value, then the hue coefficient Hr may be set to be zero. On the other hand, if the average grayscale level $r_{ave}$ is smaller than MAX ($r_{ave}$, $g_{ave}$, $b_{ave}$) and if the difference between MAX ($r_{ave}$, $g_{ave}$, $b_{ave}$) and $r_{ave}$ is greater than the predetermined value, then the hue coefficient Hr may be set to be one.

The following Table 6 shows the colors to be represented by a pixel, the average grayscale levels of red subpixels (with the grayscale levels of bright and dark red subpixels), the hue coefficient Hr, the average grayscale levels of green and blue subpixels, viewing angle directions, chromaticity coordinates x and y, luminances Y and chromaticity differences Δu'v'. In this case, the average grayscale level $r_{ave}$ of the input signal is 128. If the hue coefficient Hr is zero, then the grayscale levels of the bright and dark red subpixels both become 128. On the other hand, if the hue coefficient Hr is one, the grayscale levels of the bright and dark red subpixels become 175 and 0, respectively.

TABLE 6

| | R | | Hr | G | B | Viewing angle direction | x | y | Y | Δ u'v' |
|---|---|---|---|---|---|---|---|---|---|---|
| Blue | 128 | | | 128 | 255 | Straight | 0.197 | 0.159 | 0.315 | — |
| | 128 | 128 | 0 | | | Obliquely 60° | 0.237 | 0.220 | 0.447 | 0.067 |
| | 175 | 0 | 1 | | | Obliquely 60° | 0.222 | 0.216 | 0.424 | 0.061 |
| Magenta | 128 | | | 64 | 128 | Straight | 0.296 | 0.194 | 0.107 | — |
| | 128 | 128 | 0 | | | Obliquely 60° | 0.294 | 0.231 | 0.253 | 0.040 |
| | 175 | 0 | 1 | | | Obliquely 60° | 0.269 | 0.225 | 0.231 | 0.048 |
| Red | 128 | | | 64 | 64 | Straight | 0.446 | 0.309 | 0.086 | — |
| | 128 | 128 | 0 | | | Obliquely 60° | 0.349 | 0.287 | 0.232 | 0.070 |
| | 175 | 0 | 1 | | | Obliquely 60° | 0.319 | 0.283 | 0.210 | 0.092 |
| Yellow | 128 | | | 128 | 64 | Straight | 0.377 | 0.358 | 0.199 | — |
| | 128 | 128 | 0 | | | Obliquely 60° | 0.332 | 0.358 | 0.369 | 0.037 |
| | 175 | 0 | 1 | | | Obliquely 60° | 0.308 | 0.361 | 0.346 | 0.044 |
| Green | 128 | | | 255 | 128 | Straight | 0.281 | 0.465 | 0.730 | — |
| | 128 | 128 | 0 | | | Obliquely 60° | 0.285 | 0.402 | 0.784 | 0.028 |
| | 175 | 0 | 1 | | | Obliquely 60° | 0.271 | 0.405 | 0.761 | 0.025 |
| Cyan | 128 | | | 255 | 255 | Straight | 0.220 | 0.293 | 0.826 | — |
| | 128 | 128 | 0 | | | Obliquely 60° | 0.246 | 0.316 | 0.840 | 0.021 |
| | 175 | 0 | 1 | | | Obliquely 60° | 0.234 | 0.316 | 0.818 | 0.016 |

By changing the hue coefficient Hr according to the hue of the color to be represented by a pixel in this manner, the color shift can be minimized.

Although it will not be described in detail herein to avoid redundancies, the hue coefficients Hr and Hb may be fixed at zero in the red and blue correcting sections 300*r* and 300*b*, while the hue coefficient Hg may change into zero or one according to the hue in the green correcting section 300*g*. In that case, if a pixel should represent the color green, yellow or cyan, the color shift can be minimized by setting the hue coefficient Hg to be zero. On the other hand, if a pixel should represent the color blue, magenta or red, the color shift can be minimized by setting the hue coefficient Hg to be one.

In the examples described above, the hue coefficient is supposed to change in one of the red, green and blue correcting sections 300*r*, 300*g* and 300*b*. However, the present invention is in no way limited to that specific preferred embodiment. Optionally, the hue coefficients may also change in two of the red, green and blue correcting sections 300*r*, 300*g* and 300*b*.

Hereinafter, a relation between the hue of the color represented by a pixel and the hue coefficients Hr and Hb will be described with reference to FIG. 15 and Table 7. In the following example, the hue coefficients Hr and Hb change into zero or one according to the hue in the red and blue correcting sections 300*r* and 300*b*, but the hue coefficient Hg is fixed at zero in the green correcting section 300*g*.

Figure 15:
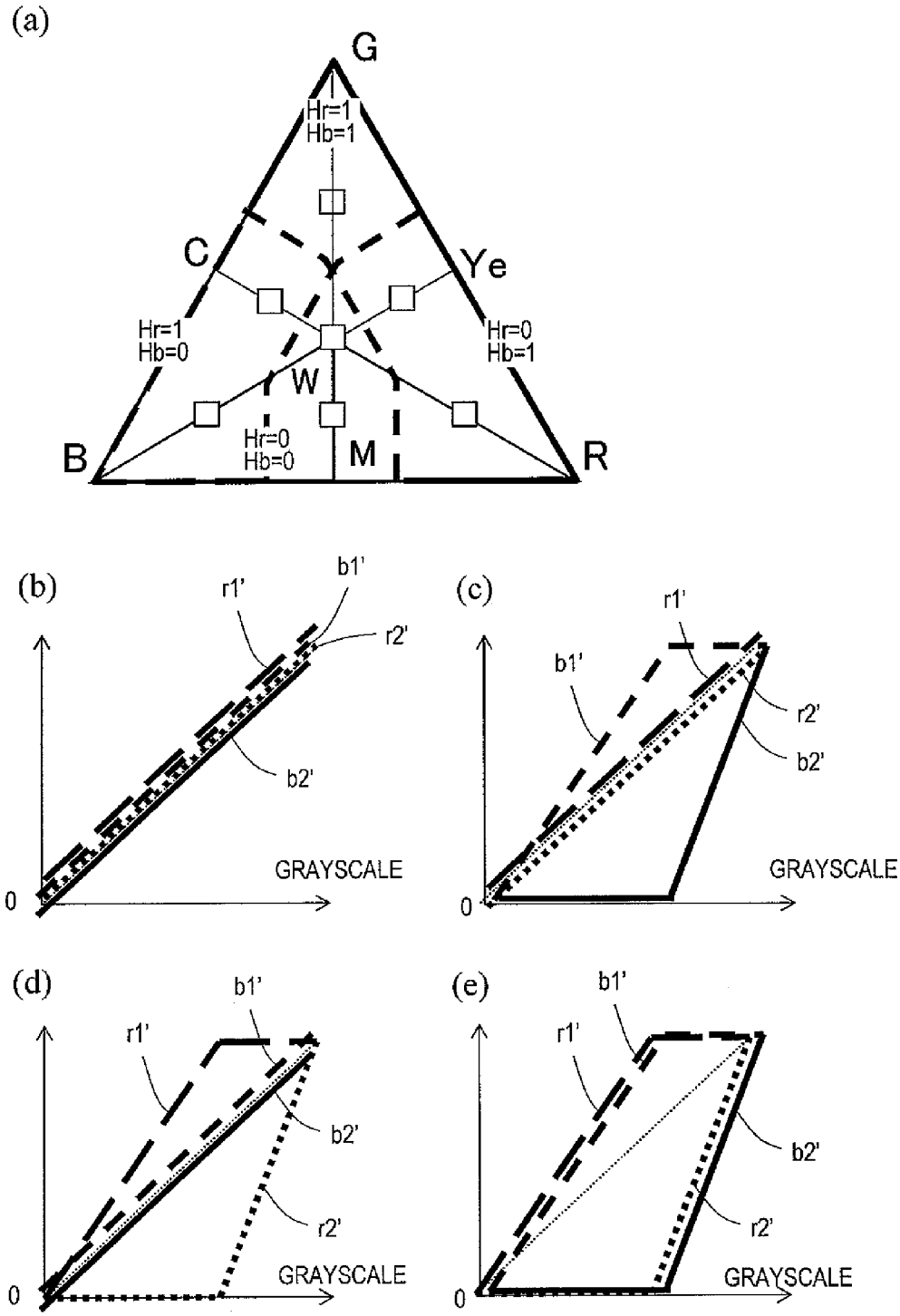
FIG. 15(*a*) is a schematic representation illustrating the hue of the LCD panel of the liquid crystal display device shown in FIG. 1 in a situation where the grayscale levels of red and blue subpixels are corrected and FIGS. 15(*b*), 15(*c*), 15(*d*) and 15(*e*) are graphs showing how the grayscale levels of the red and blue subpixels change when the hue coefficients Hr and Hb are both equal to zero, when the hue coefficients Hr and Hb are zero and one, respectively, when the hue coefficients Hr and Hb are one and zero, respectively, and when the hue coefficients Hr and Hb are both equal to one.

FIG. 15(*a*) schematically illustrates the hues of the LCD panel 200A. As shown in FIG. 15(*a*), the hue coefficients Hr and Hb vary with the hue.

Specifically, if the input signal indicates that a pixel should represent the color magenta, the chromaticity difference when the hue coefficients Hr and Hb are both zero is smaller than the one when the hue coefficients Hr and Hb are any other combination. That is why the hue coefficients Hr and Hb are both equal to zero, the grayscale level r1' is equal to the grayscale level r2', and the grayscale level b1' is equal to the grayscale level b2'. FIG. 15(*b*) shows how the grayscale levels r1', r2', b1' and b2' change if the hue coefficients Hr and Hb are both equal to zero. For example, if the average grayscale levels ($r_{ave}$, $g_{ave}$, $b_{ave}$) of red, green and blue subpixel are (128, 64, 128), the chromaticity difference can be minimized by setting both of the hue coefficients Hr and Hb to be zero.

On the other hand, if the input signal indicates that a pixel should represent the color red or yellow, the chromaticity difference when the hue coefficients Hr and Hb are zero and one, respectively, is smaller than the one when the hue coefficients Hr and Hb are any other combination. That is why the hue coefficients Hr and Hb are equal to zero and one, respectively, the grayscale level r1' is equal to the grayscale level r2', and the grayscale level b1' is different from the grayscale level b2'. FIG. 15(*c*) shows how the grayscale levels r1', r2', b1' and b2' change if the hue coefficients Hr and Hb are equal to zero and one, respectively. For example, if the average grayscale levels ($r_{ave}$, $g_{ave}$, $b_{ave}$) of red, green and blue subpixel are (128, 64, 64) or (128, 128, 64), the chromaticity difference can be minimized by setting the hue coefficients Hr and Hb to be zero and one, respectively.

Furthermore, if the input signal indicates that a pixel should represent the color blue or cyan, the chromaticity difference when the hue coefficients Hr and Hb are one and zero, respectively, is smaller than the one when the hue coefficients Hr and Hb are any other combination. That is why the hue coefficients Hr and Hb are equal to one and zero, respectively, the grayscale level r1' is different from the grayscale level r2', and the grayscale level b1' is equal to the grayscale level b2'. FIG. 15(*d*) shows how the grayscale levels r1', r2', b1' and b2' change if the hue coefficients Hr and Hb are equal to one and zero, respectively. For example, if the average grayscale levels ($r_{ave}$, $g_{ave}$, $b_{ave}$) of red, green and blue subpixel are (64, 64, 128) or (64, 128, 128), the chromaticity difference can be minimized by setting the hue coefficients Hr and Hb to be one and zero, respectively.

Furthermore, if the input signal indicates that a pixel should represent the color green, the chromaticity difference when the hue coefficients Hr and Hb are both one is smaller than the one when the hue coefficients Hr and Hb are any other combination. That is why the hue coefficients Hr and Hb are both equal to one, the grayscale level r1' is different from the grayscale level r2', and the grayscale level b1' is different from the grayscale level b2'. FIG. 15(*e*) shows how the grayscale levels r1', r2', b1' and b2' change if the hue coefficients Hr and Hb are both one. For example, if the average grayscale levels ($r_{ave}$, $g_{ave}$, $b_{ave}$) of red, green and blue subpixel are (64, 128, 64), the chromaticity difference can be minimized by setting both of the hue coefficients Hr and Hb to be one.

For example, if the average grayscale level $r_{ave}$ is equal to MAX ($r_{ave}$, $g_{ave}$, $b_{ave}$) and if the difference between MAX ($r_{ave}$, $g_{ave}$, $b_{ave}$) and $r_{ave}$ is smaller than a predetermined value, then the hue coefficient Hr may be set to be zero. On the other hand, if the average grayscale level $r_{ave}$ is smaller than MAX ($r_{ave}$, $g_{ave}$, $b_{ave}$) and if the difference between MAX ($r_{ave}$, $g_{ave}$, $b_{ave}$) and $r_{ave}$ is greater than the predetermined value, then the hue coefficient Hr may be set to be one. Also, if the average grayscale level $b_{ave}$ is equal to MAX ($r_{ave}$, $g_{ave}$, $b_{ave}$) and if the difference between MAX ($r_{ave}$, $g_{ave}$, $b_{ave}$) and $b_{ave}$ is smaller than a predetermined value, then the hue coefficient Hb may be set to be zero. On the other hand, if the average grayscale level $b_{ave}$ is smaller than MAX ($r_{ave}$, $g_{ave}$, $b_{ave}$) and if the difference between MAX ($r_{ave}$, $g_{ave}$, $b_{ave}$) and $b_{ave}$ is greater than the predetermined value, then the hue coefficient Hb may be set to be one.

The following Table 7 shows the colors to be represented by a pixel, the grayscale levels of red subpixels (with the grayscale levels of bright and dark red subpixels), the hue coefficient Hr, the average grayscale levels of a green subpixel, the average grayscale levels of blue subpixels (with the grayscale levels of bright and dark blue subpixels), the hue coefficient Hb, viewing angle directions, chromaticity coordinates x and y, luminances Y and chromaticity differences Δu'v'. In this case, the average grayscale levels $r_{ave}$ and $b_{ave}$ of the input signal are 64 or 128. If the hue coefficients Hr and Hb are zero, then the grayscale levels of the bright and dark subpixels both become 64 or 128. On the other hand, if the hue coefficients Hr and Hb are one, the grayscale levels of the bright and dark subpixels become $88(=(2\times(64/255)^{2.2})^{1/2.2}\times 255)$ and zero when the average grayscale level is 64 and the grayscale levels of the bright and dark subpixels become $175(=(2\times(128/255)^{2.2})^{1/2.2}\times 255)$ and zero when the average grayscale level is 128.

TABLE 7

| | R | | Hr | G | B | | Hb | Viewing angle direction | x | y | Y | Δ u'v' |
|---|---|---|---|---|---|---|---|---|---|---|---|---|
| Blue | 64 | | | 64 | 128 | | | Straight | 0.197 | 0.159 | 0.069 | — |
| | 64 | 64 | 0 | | 128 | 128 | 0 | Obliquely | 0.233 | 0.216 | 0.203 | 0.063 |
| | | | | | 175 | 0 | 1 | 60° | 0.259 | 0.260 | 0.190 | 0.102 |
| | 88 | 0 | 1 | | 128 | 128 | 0 | Obliquely | 0.213 | 0.211 | 0.190 | 0.056 |
| | | | | | 175 | 0 | 1 | 60° | 0.235 | 0.256 | 0.177 | 0.096 |
| Magenta | 128 | | | 64 | 128 | | | Straight | 0.296 | 0.194 | 0.107 | — |
| | 128 | 128 | 0 | | 128 | 128 | 0 | Obliquely | 0.294 | 0.231 | 0.253 | 0.040 |
| | | | | | 175 | 0 | 1 | 60° | 0.331 | 0.271 | 0.240 | 0.070 |

TABLE 7-continued

| | R | Hr | G | B | Hb | Viewing angle direction | x | y | Y | Δu'v' |
|---|---|---|---|---|---|---|---|---|---|---|
| | 175 0 | 1 | | 128 128 | 0 | Obliquely | 0.269 | 0.225 | 0.231 | 0.048 |
| | | | | 175 0 | 1 | 60° | 0.302 | 0.267 | 0.217 | 0.070 |
| Red | 128 | | 64 | 64 | | Straight | 0.446 | 0.309 | 0.086 | — |
| | 128 128 | 0 | | 64 64 | 0 | Obliquely | 0.349 | 0.287 | 0.232 | 0.070 |
| | | | | 88 0 | 1 | 60° | 0.391 | 0.333 | 0.223 | 0.055 |
| | 175 0 | 1 | | 64 64 | 0 | Obliquely | 0.319 | 0.283 | 0.210 | 0.092 |
| | | | | 88 0 | 1 | 60° | 0.360 | 0.334 | 0.201 | 0.078 |
| Yellow | 128 | | 128 | 64 | | Straight | 0.377 | 0.429 | 0.199 | — |
| | 128 128 | 0 | | 64 64 | 0 | Obliquely | 0.332 | 0.358 | 0.369 | 0.037 |
| | | | | 88 0 | 1 | 60° | 0.362 | 0.404 | 0.360 | 0.012 |
| | 175 0 | 1 | | 64 64 | 0 | Obliquely | 0.308 | 0.361 | 0.346 | 0.044 |
| | | | | 88 0 | 1 | 60° | 0.336 | 0.411 | 0.338 | 0.023 |
| Green | 64 | | 128 | 64 | | Straight | 0.281 | 0.466 | 0.160 | — |
| | 64 64 | 0 | | 64 64 | 0 | Obliquely | 0.273 | 0.364 | 0.319 | 0.046 |
| | | | | 88 0 | 1 | 60° | 0.297 | 0.421 | 0.310 | 0.024 |
| | 88 0 | 1 | | 64 64 | 0 | Obliquely | 0.254 | 0.366 | 0.306 | 0.044 |
| | | | | 88 0 | 1 | 60° | 0.276 | 0.426 | 0.297 | 0.016 |
| cyan | 64 | | 128 | 128 | | Straight | 0.219 | 0.293 | 0.181 | — |
| | 64 64 | 0 | | 128 128 | 0 | Obliquely | 0.240 | 0.292 | 0.340 | 0.015 |
| | | | | 175 0 | 1 | 60° | 0.262 | 0.344 | 0.326 | 0.038 |
| | 88 0 | 1 | | 128 128 | 0 | Obliquely | 0.224 | 0.291 | 0.327 | 0.004 |
| | | | | 175 0 | 1 | 60° | 0.244 | 0.345 | 0.313 | 0.033 |

As described above, if a pixel should represent the color magenta, the chromaticity difference Δu'v' can be minimized by setting both of the hue coefficients Hr and Hb to be zero. On the other hand, if a pixel should represent the color red or yellow, the chromaticity difference Δu'v' can be minimized by setting the hue coefficients Hr and Hb to be zero and one, respectively.

Also, if a pixel should represent the color blue or cyan, the chromaticity difference Δu'v' can be minimized by setting the hue coefficients Hr and Hb to be one and zero, respectively. Furthermore, if a pixel should represent the color green, the chromaticity difference Δu'v' can be minimized by setting both of the hue coefficients Hr and Hb to be one. By changing the hue coefficients Hr and Hb according to the hue of the color to be represented by a pixel in this manner, the color shift can be minimized. As already mentioned, at least one of the hue coefficients Hr, Hg and Hb may be binarized.

If subpixels, other than the subpixel to turn ON, are in OFF state and if there is a significant difference in luminance between those OFF-state subpixels and the subpixel that has been turned ON, a decrease in resolution is easily sensible. In this liquid crystal display device 100A, however, if the grayscale levels of red, green and blue subpixels as indicated by the input signal are (0, 0, 128), for example, then the hue coefficient Hb is zero, the grayscale level of the blue subpixel as indicated by the input signal does not change, and the luminances of the blue subpixels B1 and B2 become equal to each other. By preventing the correcting section 300A from changing the grayscale levels in this manner when a decrease in resolution is easily sensible, a substantial decrease in resolution can be avoided.

In the example described above, the grayscale level b1 indicated by the input signal is equal to the grayscale level b2. However, the present invention is in no way limited to that specific preferred embodiment. Alternatively, the grayscale level b1 indicated by the input signal may be different from the grayscale level b2. Nevertheless, if the grayscale level b1 is different from the grayscale level b2, then the luminance level $Y_{b1}$ that has been subjected to the grayscale-luminance conversion by the grayscale-to-luminance converting section 360*a* shown in FIG. 8 is different from the luminance level $Y_{b2}$ that has been subjected to the grayscale-luminance conversion by the grayscale-to-luminance converting section 360*b*. If there is a great difference in luminance level between adjacent pixels (particularly when a text is displayed), the difference between those luminance levels $Y_{b1}$ and $Y_{b2}$ is even more significant.

Figure 16:
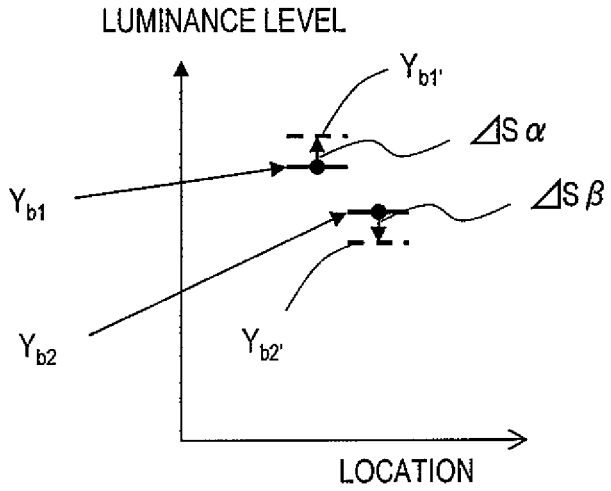
FIG. 16 is a schematic representation showing how the luminance level changes in a situation where blue subpixels belonging to adjacent pixels have mutually different grayscale levels in the liquid crystal display device shown in FIG. 1.

Specifically, if the grayscale level b1 is higher than the grayscale level b2, the luminance-to-grayscale converting sections 380*a* and 380*b* perform luminance-to-grayscale conversion based on the sum of the luminance level $Y_{b1}$ and the magnitude of shift ΔSα and the difference between the luminance level $Y_{b2}$ and the magnitude of shift ΔSβ, respectively. In that case, as shown in FIG. 16, the luminance level $Y_{b1}'$ corresponding to the grayscale level b1' will be higher by the magnitude of shift ΔSα than the luminance level $Y_{b1}$ corresponding to the grayscale level b1. The luminance level $Y_{b2}'$ corresponding to the grayscale level b2' will be lower by the magnitude of shift ΔSβ than the luminance level $Y_{b2}$ corresponding to the grayscale level b2. As a result, the difference between the respective luminances corresponding to the grayscale levels b1' and b2' will be bigger than the difference between the respective luminances corresponding to the grayscale levels b1 and b2.

Now take a look at four pixels, which are arranged in upper left, upper right, lower left and lower right portions of a matrix and will be referred to herein as pixels P1 through P4, respectively. Also, the grayscale levels of respective blue subpixels as indicated by the input signal with respect to those pixels P1 through P4 will be identified herein by b1 through b4, respectively. As already described with reference to FIG. 7, if the input signal indicates that the respective subpixels should represent the same color (i.e., the grayscale levels b1 through b4 are equal to each other), the grayscale level b1' is higher than the grayscale level b2' and the grayscale level b4' is higher than the grayscale level b3'.

Also, suppose the input signal indicates that the pixels P1 and P3 should have high grayscales, the pixels P2 and P4 should have low grayscales, there is a display boundary between the pixels P1 and P3 and between the pixels P2 and P4, the grayscale levels b1 and b2 satisfy b1>b2, and the grayscale levels b3 and b4 satisfy b3>b4. In that case, the difference between the respective luminances corresponding to the grayscale levels b1' and b2' will be bigger than the difference between the respective luminances corresponding to the grayscale levels b1 and b2. On the other hand, the difference between the respective luminances corresponding to the grayscale levels b3' and b4' will be smaller than the difference between the respective luminances corresponding to the grayscale levels b3 and b4.

Also, as described above, if the color indicated by the input signal is a single color (such as the color blue), then the hue coefficient Hb is either equal to, or close to, zero. In that case, the magnitude of shift decreases, the input signal is output as it is, and therefore, the resolution can be maintained. On the other hand, if the color indicated by the input signal is an achromatic color, then the hue coefficient Hb is either equal to, or close to, one. In that case, the luminance difference in a corrected image will increase and decrease from one column of pixels to another compared to the original image, thus making the edges look uneven and causing a decrease in resolution. Furthermore, if the grayscale levels b1 and b2 are either equal to, or close to, each other, such unevenness is not so noticeable considering the human visual sense. However, the bigger the difference between the grayscale levels b1 and b2, the more noticeable such unevenness gets.

Hereinafter, a specific example will be described with reference to FIG. 17. In this example, the input signal is supposed to indicate that a line in an achromatic color with a relatively high luminance (i.e., a light gray line) should be displayed with a line width of one pixel on the background in an achromatic color with a relatively low luminance (i.e., a dark gray background). In that case, ideally, the viewer should sense that light gray line.

Figure 17:
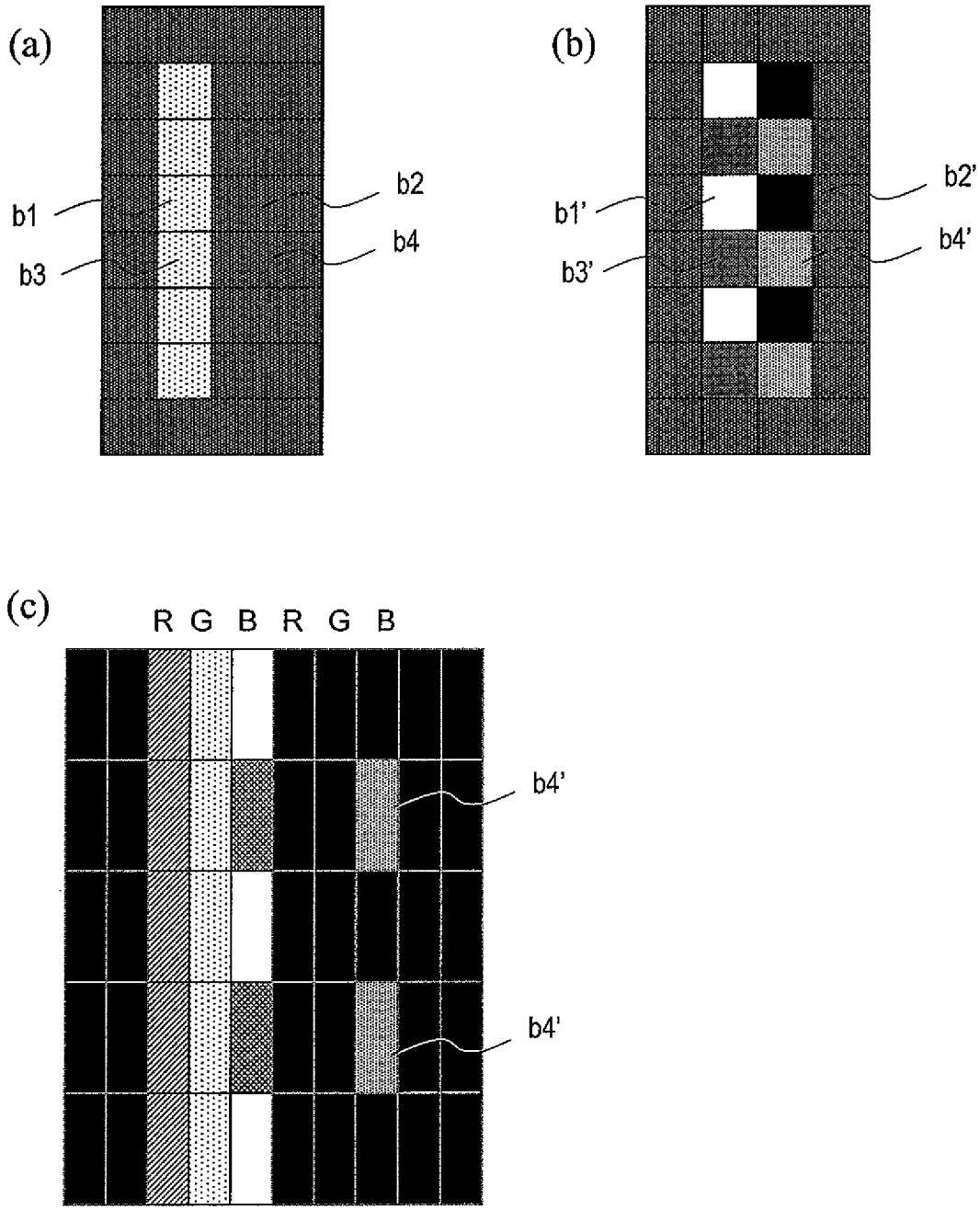
FIG. 17(*a*) is a schematic representation illustrating the liquid crystal display device of Comparative Example 1 and FIGS. 17(*b*) and 17(*c*) are schematic representations illustrating the liquid crystal display device of the present embodiment.

FIG. 17(*a*) shows the luminances of blue subpixels in the liquid crystal display device of Comparative Example 1. Only blue subpixels are shown in FIG. 17(*a*). Also, as for the grayscale levels b1 through b4 of the blue subpixels as indicated by the input signal with respect to the four pixels P1 through P4, the grayscale levels b1 and b2 satisfy b1>b2 and the grayscale levels b3 and b4 satisfy b3>b4. In that case, in the liquid crystal display device of Comparative Example 1, the blue subpixels of those four pixels P1 through P4 have luminances corresponding to the grayscale levels b1 through b4 indicated by the input signal.

FIG. 17(*b*) shows the luminances of blue subpixels in the liquid crystal display device 100A. In this liquid crystal display device 100A, the grayscale level b1' of the blue subpixel of the pixel P1 is higher than the grayscale level b1, the grayscale level b2' of the blue subpixel of the pixel P2 is lower than the grayscale level b2, the grayscale level b3' of the blue subpixel of the pixel P3 is lower than the grayscale level b3, and the grayscale level b4' of the blue subpixel of the pixel P4 is higher than the grayscale level b4. In this manner, in any two pixels that are adjacent to each other in either the row direction or the column direction, the grayscale level (luminance) alternately increases and decreases with respect to the one indicated by the input signal. That is why comparing FIGS. 17(*a*) and 17(*b*) to each other, it can be seen that in this liquid crystal display device 100A, the difference between the grayscale levels b1' and b2' becomes greater than the difference between the grayscale levels b1 and b2 as indicated by the input signal. On the other hand, the difference between the grayscale levels b3' and b4' becomes smaller than the difference between the grayscale levels b3 and b4 as indicated by the input signal. As a result, in this liquid crystal display device 100A, not only the column including the pixels P1 and P3 that are associated with the relatively high grayscale levels b1 and b3 in the input signal but also the pixel P4 that is associated with the relatively low grayscale level b4 in the input signal have blue subpixels with relatively high luminances. In that case, even if the input signal indicates that a light gray line should be represented in the image displayed, this liquid crystal display device 100A will display not only the light gray line but also blue dotted lines adjacent to that line as shown in FIG. 17(*c*). Consequently, the display quality decreases significantly in the contours of the gray line.

In the example described above, the magnitude of shift $\Delta S\alpha$ is obtained as the product of the luminance level difference $\Delta Y_b\alpha$ and the hue coefficient Hb and the magnitude of shift $\Delta S\beta$ is obtained as the product of the luminance level difference $\Delta Y_b\beta$ and the hue coefficient Hb. To avoid that, however, a different parameter may be used in determining the magnitudes of shift $\Delta S\alpha$ and $\Delta S\beta$. In general, when a text image is displayed, for example, the grayscale levels b1 and b2 are significantly different from each other in edges between a line of pixels that are displayed in the column direction and their adjacent pixels that are displayed in the background. That is why if the hue coefficient Hb is close to one, the difference between the grayscale levels b1' and b2' may further increase and the image quality may decrease as a result of the correction. To avoid such a situation, a continuous coefficient representing the degree of color continuity between adjacent pixels as indicated by the input signal may also be used as an additional parameter to calculate the magnitudes of shift $\Delta S\alpha$ and $\Delta S\beta$. If there is a relatively big difference between the grayscale levels b1 and b2, the magnitudes of shift $\Delta S\alpha$ and $\Delta S\beta$ may vary according to the continuous coefficient so as to be decreased either to zero or significantly. As a result, the decrease in image quality can be minimized. For example, if there is a relatively small difference between the grayscale levels b1 and b2, then the continuous coefficient increases and the luminances of blue subpixels belonging to adjacent pixels are controlled. However, if there is a relatively big difference between the grayscale levels b1 and b2 in the image boundary area, then the continuous coefficient may decrease and the luminances of the blue subpixels need not be controlled.

Figure 18:
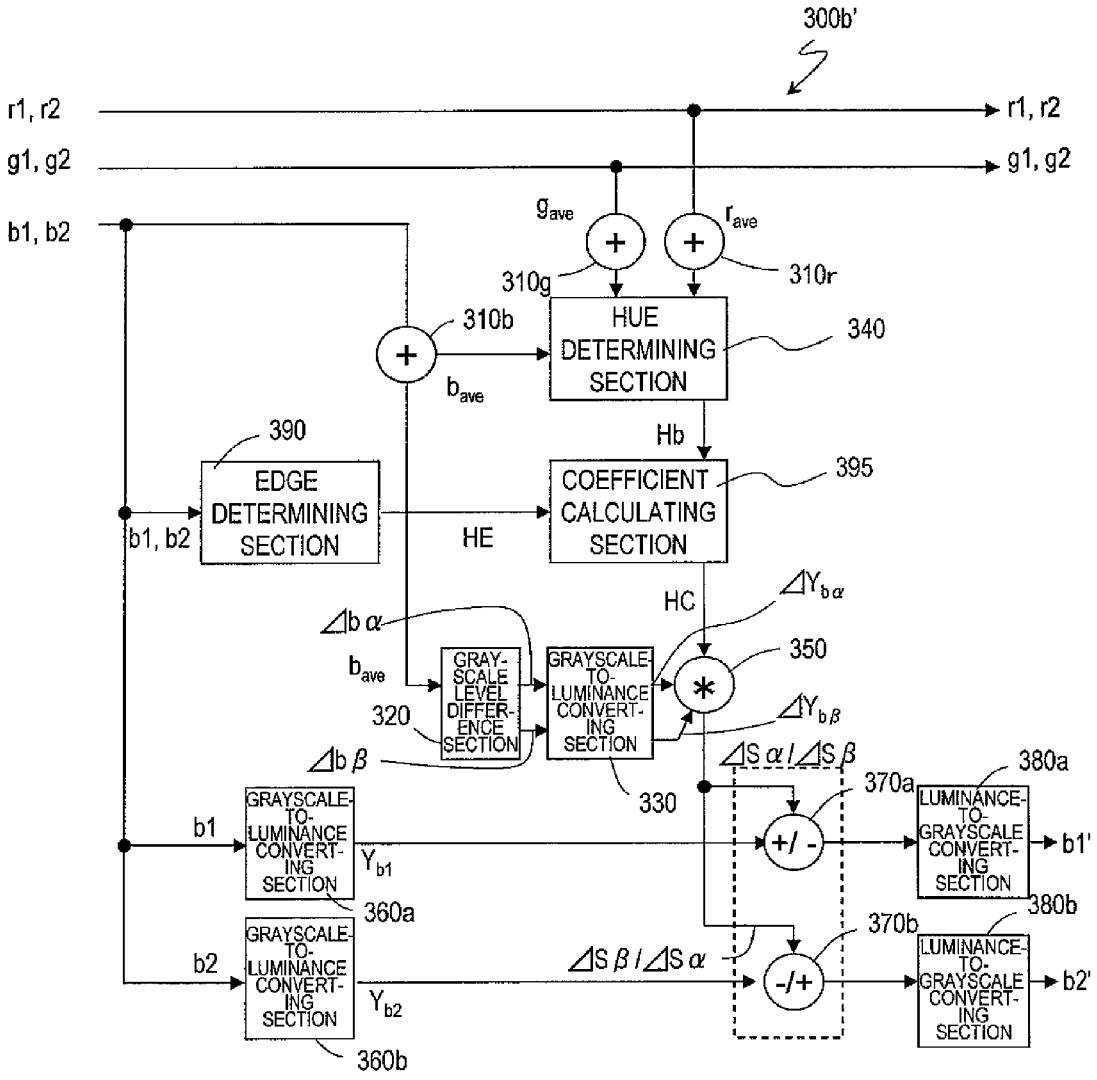
FIG. 18 is a schematic representation illustrating a configuration for a blue correcting section in a liquid crystal display device as a modified example of the first preferred embodiment.

Hereinafter, a blue correcting section 300*b'* for controlling the luminances of blue subpixels as described above will be described with reference to FIG. 18. In the following example, edge coefficients are used in place of the continuous coefficients. This blue correcting section 300*b'* has the same configuration as the blue correcting section 300*b* that has already been described with reference to FIG. 8 except that this blue correcting section 300*b'* further includes an edge determining section 390 and a coefficient calculating section 395. And description of their common features will be omitted herein to avoid redundancies. Although not shown in FIG. 18, the red correcting section 300*r'* and the green correcting section 300*g'* also have the same configuration as this blue correcting section 300*b'*.

The edge determining section 390 obtains an edge coefficient HE based on the grayscale levels b1 and b2 that are indicated by the input signal. The edge coefficient HE is a function that increases as the difference in grayscale level between the blue subpixels of two adjacent pixels increases. If there is a relatively big difference between the grayscale levels b1 and b2 (i.e., if there is a low degree of continuity between the grayscale levels b1 and b2), then the edge coefficient HE is high. On the other hand, if there is a relatively small difference between the grayscale levels b1 and b2 (i.e., if there is a high degree of continuity between the grayscale levels b1 and b2), then the edge coefficient HE is low. In this manner, the lower the continuity in grayscale level between the blue subpixels of two adjacent pixels (i.e., the smaller the continuous coefficient described above), the higher the edge coefficient HE. And the higher the continuity in grayscale level between them (i.e., the greater the continuous coefficient described above), the lower the edge coefficient HE.

Also, the edge coefficient HE changes continuously according to the difference in grayscale level between the blue subpixels of two adjacent pixels. For example, if the absolute value of the difference in grayscale level between the blue subpixels of two adjacent pixels is |b1−b2| and if MAX=MAX (b1, b2), then the edge coefficient HE can be represented as HE=|b1−b2|/MAX. However, if MAX=0, then HE=0.

Next, the coefficient calculating section 395 calculates a correction coefficient HC based on the hue coefficient Hb that has been obtained by the hue determining section 340 and the edge coefficient HE that has been obtained by the edge determining section 390. The correction coefficient HC may be represented as HC=Hb−HE, for example. Optionally, clipping may be carried out so that the correction coefficient HC falls within the range of 0 to 1 in the coefficient calculating section 395. Subsequently, the multiplying section 350 multiplies the correction coefficient HC and the luminance level differences $\Delta Y_B\alpha$ and $\Delta Y_B\beta$ together, thereby obtaining the magnitudes of shift $\Delta S\alpha$ and $\Delta S\beta$.

In this manner, the blue correcting section 300*b*' obtains the magnitudes of shift $\Delta S\alpha$ and $\Delta S\beta$ by multiplying together the correction coefficient HC, which has been obtained based on the hue coefficient Hb and the edge coefficient HE, and the luminance level differences $\Delta Y_B\alpha$ and $\Delta Y_B\beta$. As described above, the edge coefficient HE is a function that increases as the difference in grayscale level between the blue subpixels of two adjacent pixels increases. That is why the greater the edge coefficient HE, the smaller the correction coefficient HC that regulates the distribution of luminances and the less uneven the edges can get. As also described above, the hue coefficient Hb is a function that changes continuously and the edge coefficient HE is also a function that changes continuously according to the difference in grayscale level between the blue subpixels of two adjacent pixels. For that reason, the correction coefficient HC also changes continuously and a sudden change on the display can be minimized.

In the example described above, the hue and the level difference are supposed to be determined based on the average grayscale level. However, this is only an example of the present invention. Alternatively, the hue and the level difference may also be determined based on the average luminance level. Nevertheless, since the luminance level is obtained by raising the grayscale level to the $2.2^{th}$ power, the precision required also needs to be increased to the same degree. For that reason, the lookup table that stores the luminance level difference needs a huge circuit size, while the lookup table that stores the grayscale level difference can be implemented in a small circuit size.

As described above, the red, green and blue correcting sections 300*r*, 300*g* and 300*b* appropriately control their associated hue coefficients Hr, Hg and Hb, thereby minimizing the color shift.

As can be seen from FIG. 7, if the red, green and blue correcting sections 300*r*, 300*g* and 300*b* correct the grayscale levels, then two subpixels belonging to two pixels will have mutually different luminances. And if those subpixels have different luminances, then a decrease in resolution may be sensed. Particularly, the greater the difference in luminance (i.e., the greater the hue coefficients Hr, Hg and Hb), the more easily the decrease in resolution is sensible.

In that case, it is preferred that the hue coefficients Hr and Hg be smaller than the hue coefficient Hb. If the hue coefficient Hb is relatively large, then there will be a relatively big difference in luminance level between the blue subpixels. However, it is known that to the human eye, the resolution of the color blue is lower than that of any other color. Particularly when the red and green subpixels of the same pixel as the blue subpixel are turned ON, even if there is a relatively big difference in luminance between the blue subpixels, the decrease in the substantial resolution of the color blue is hardly sensible. In view of this consideration, it is more effective to correct the grayscale level of the blue subpixels than doing the same for subpixels of any other color. Also, as for colors other than the color blue, it is also known that the color red also has a relatively low resolution. That is why even if the subpixel, of which the nominal resolution will decrease in an achromatic color with a middle grayscale, is a red subpixel, a decrease in substantial resolution is no more easily sensible to the eye than the blue subpixel is. Consequently, the same effect can be achieved even for the color red, too.

Furthermore, in the example described above, the correcting section 300A is supposed to include the red, green and blue correcting sections 300*r*, 300*g* and 300*b*. However, the present invention is in no way limited to that specific preferred embodiment.

Figure 19:
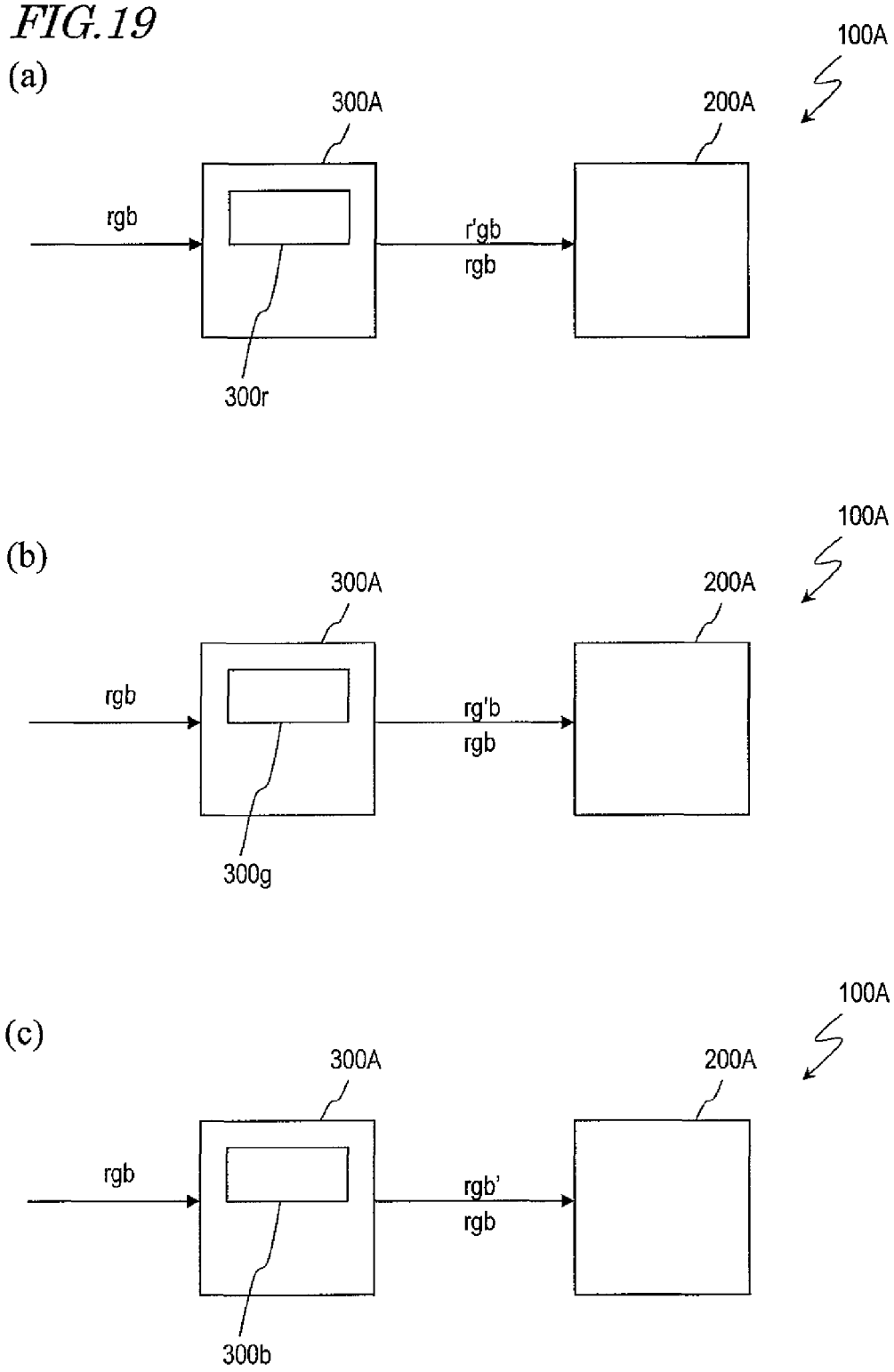
FIGS. 19(*a*), 19(*b*) and 19(*c*) are schematic representations illustrating a liquid crystal display device as a modified example of the first preferred embodiment when its correcting section includes only a red correcting section, only a green correcting section, and only a blue correcting section, respectively.

That is to say, the correcting section 300A may have only the red correcting section 300*r* with no green correcting section or blue correcting section as shown in FIG. 19(*a*). Alternatively, the correcting section 300A may have only the green correcting section 300*g* with no red correcting section or blue correcting section as shown in FIG. 19(*b*). Still alternatively, the correcting section 300A may have only the blue correcting section 300*b* with no red correcting section or green correcting section as shown in FIG. 19(*c*). Or the correcting section 300A may have any two of the red, green and blue correcting sections 300*r*, 300*g* and 300*b*.

Also, as described above, the LCD panel 200A operates in the VA mode. Hereinafter, a specific exemplary configuration for the LCD panel 200A will be described. The LCD panel 200A may operate in the MVA mode. A configuration for such an MVA mode LCD panel 200A will be described with reference to FIG. 20(*a*) to 20(*c*).

The LCD panel 200A includes pixel electrodes 224, a counter electrode 244 that faces the pixel electrodes 224, and a vertical alignment liquid crystal layer 260 that is interposed between the pixel electrodes 224 and the counter electrode 244. No alignment layers are shown in FIG. 20.

Slits 227 or ribs 228 are arranged on the pixel electrodes 224 in contact with the liquid crystal layer 260. On the other hand, slits 247 or ribs 248 are arranged on the counter electrode 244 in contact with the liquid crystal layer 260. The former group of slits 227 or ribs 228 on the pixel electrodes 224 will be referred to herein as "first alignment control means", while the latter group of slits 247 or ribs 248 on the counter electrode 244 as "second alignment control means".

Figure 20:
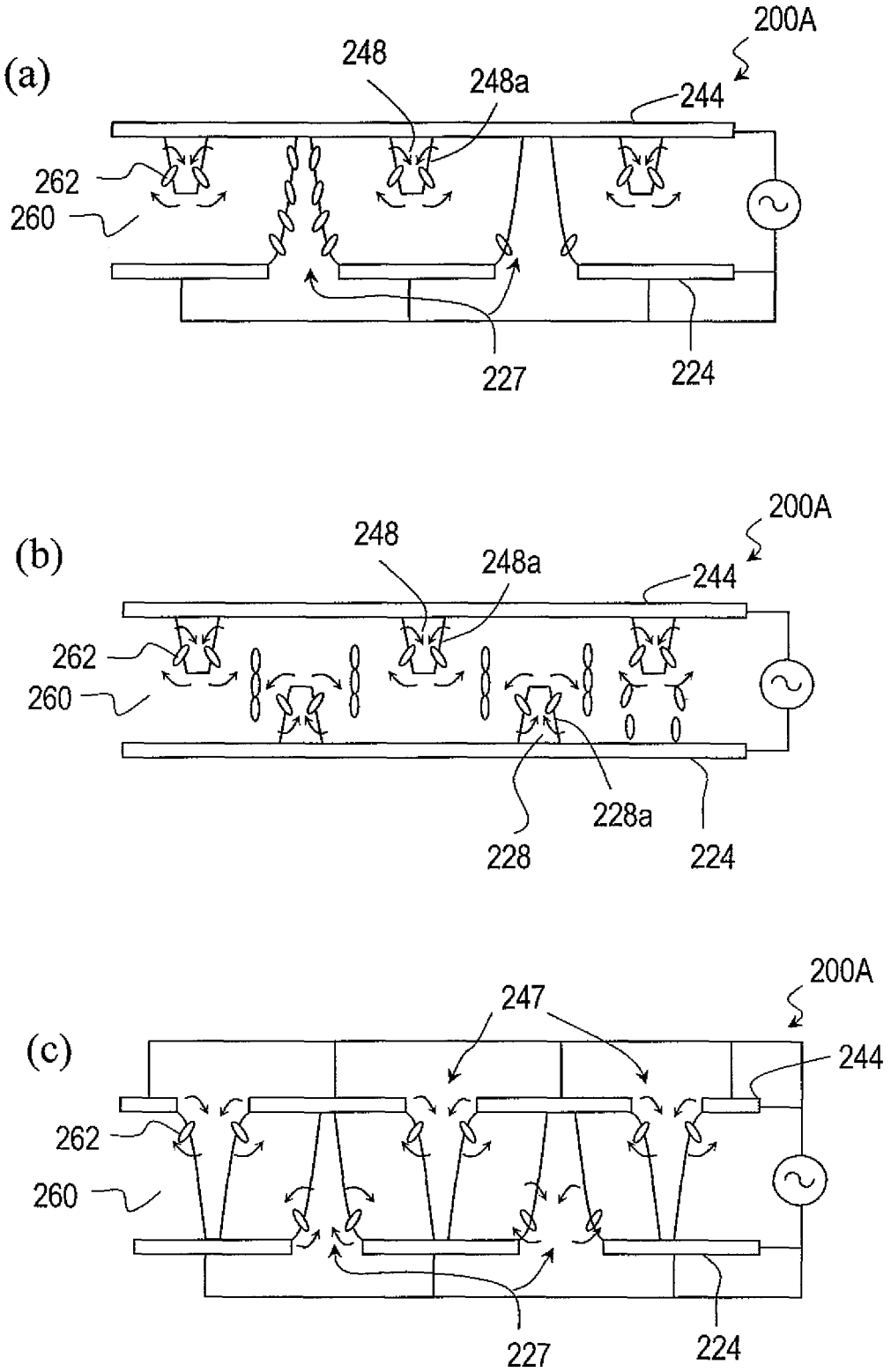
FIGS. 20(*a*), 20(*b*) and 20(*c*) are schematic representations illustrating configurations for the LCD panel of the liquid crystal display device shown in FIG. 1.

In each liquid crystal region defined between the first and second alignment control means, liquid crystal molecules 262 are given alignment control force by the first and second alignment control means and will fall (or tilt) in the direction indicated by the arrows in FIG. 20 when a voltage is applied to between the pixel electrodes 224 and the counter electrode 244. That is to say, since the liquid crystal molecules 262 fall in the same direction in each liquid crystal region, such a region can be regarded as a liquid crystal domain.

The first and second alignment control means (which will sometimes be collectively referred to herein as "alignment control means") are arranged in stripes in each subpixel. FIGS. 20(*a*) to 20(*c*) are cross-sectional views as viewed on a plane that intersects at right angles with the direction in which those striped alignment control means runs. On two sides of each alignment control means, produced are two liquid crystal domains, in one of which liquid crystal molecules 262 fall in a particular direction and in the other of which liquid crystal molecules 262 fall in another direction that defines an angle of 180 degrees with respect to that particular direction. As the alignment control means, any of various alignment control means (domain regulating means) as disclosed in Japanese Patent Application Laid-Open Publication No. 11-242225 may be used, for example.

In FIG. 20(*a*), slits 227 (where there is no conductive film) are provided as the first alignment control means, and ribs (i.e., projections) 248 are provided as the second alignment control means. These slits 227 and ribs 248 are extended so as to run in stripes (or strips). When a potential difference is produced between one pixel electrode 224 and the counter electrode 244, each slit 227 generates an oblique electric field in a region of the liquid crystal layer 260 around the edges of the slit 227 and induces alignments of the liquid crystal molecules 262 perpendicularly to the direction in which the slit 227 runs. On the other hand, each rib 248 induces alignments of the liquid crystal molecules 262 substantially perpendicularly to its side surface 248*a*, and eventually, perpendicularly to the direction in which the rib 248 runs. Each slit 227 and its associated rib 248 are arranged parallel to each other with a certain interval left between them. That is to say, a liquid crystal domain is defined between one slit 227 and its associated rib 248 that are adjacent to each other.

Unlike the configuration shown in FIG. 20(*a*), one group of ribs 228 and another group of ribs 248 are provided as the first and second alignment control means, respectively, in the configuration shown in FIG. 20(*b*). Those two groups of ribs 228 and 248 are arranged parallel to each other with a certain gap left between them and induce alignments of the liquid crystal molecules 262 substantially perpendicularly to their side surfaces 228*a* and 248*a*, thereby producing liquid crystal domains between them.

Unlike the configuration shown in FIG. 20(*a*), one group of slits 227 and another group of slits 247 are provided as the first and second alignment control means, respectively, in the configuration shown in FIG. 20(*c*). When a potential difference is produced between the pixel electrodes 224 and the counter electrode 244, those two groups of slits 227 and 247 generate an oblique electric field in a region of the liquid crystal layer 260 around their edges and induce alignments of the liquid crystal molecules 262 perpendicularly to the direction in which the slits 227 and 247 run. Those slits 227 and 247 are also arranged parallel to each other with a certain gap left between them, thereby producing liquid crystal domains between them.

As described above, such ribs and slits may be used in any arbitrary combination as the first and second alignment control means. If the configuration shown in FIG. 20(*a*) is adopted for the LCD panel 200A, then the increase in the number of manufacturing processing steps required can be minimized. Specifically, even if slits need to be cut through the pixel electrodes, no additional process steps have to be done. As for the counter electrode, on the other hand, the number of manufacturing processing steps increases less with the ribs provided than with the slits cut. However, it is naturally possible to adopt a configuration in which only ribs are used as the alignment control means or a configuration in which just slits are used as the alignment control means.

Figure 21:
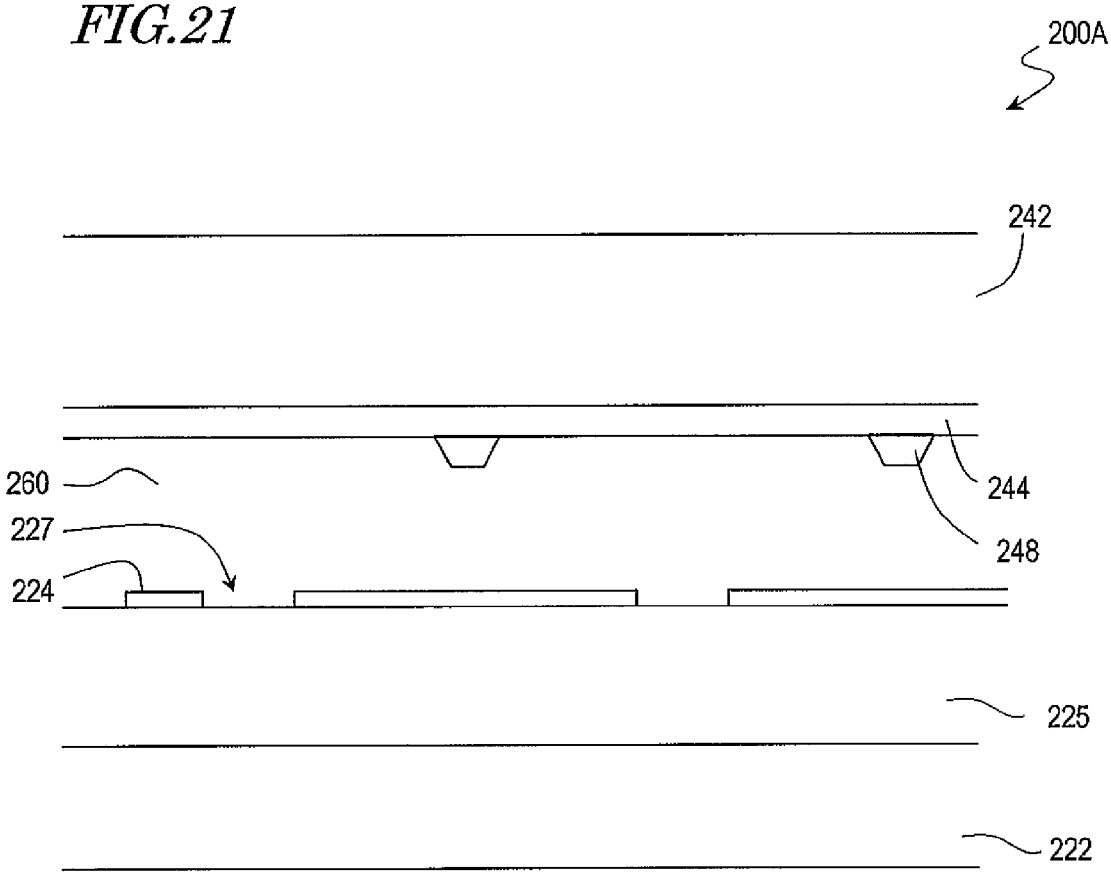
FIG. 21 is a partial cross-sectional view schematically illustrating a cross-sectional structure of the LCD panel of the liquid crystal display device shown in FIG. 1.
Figure 22:
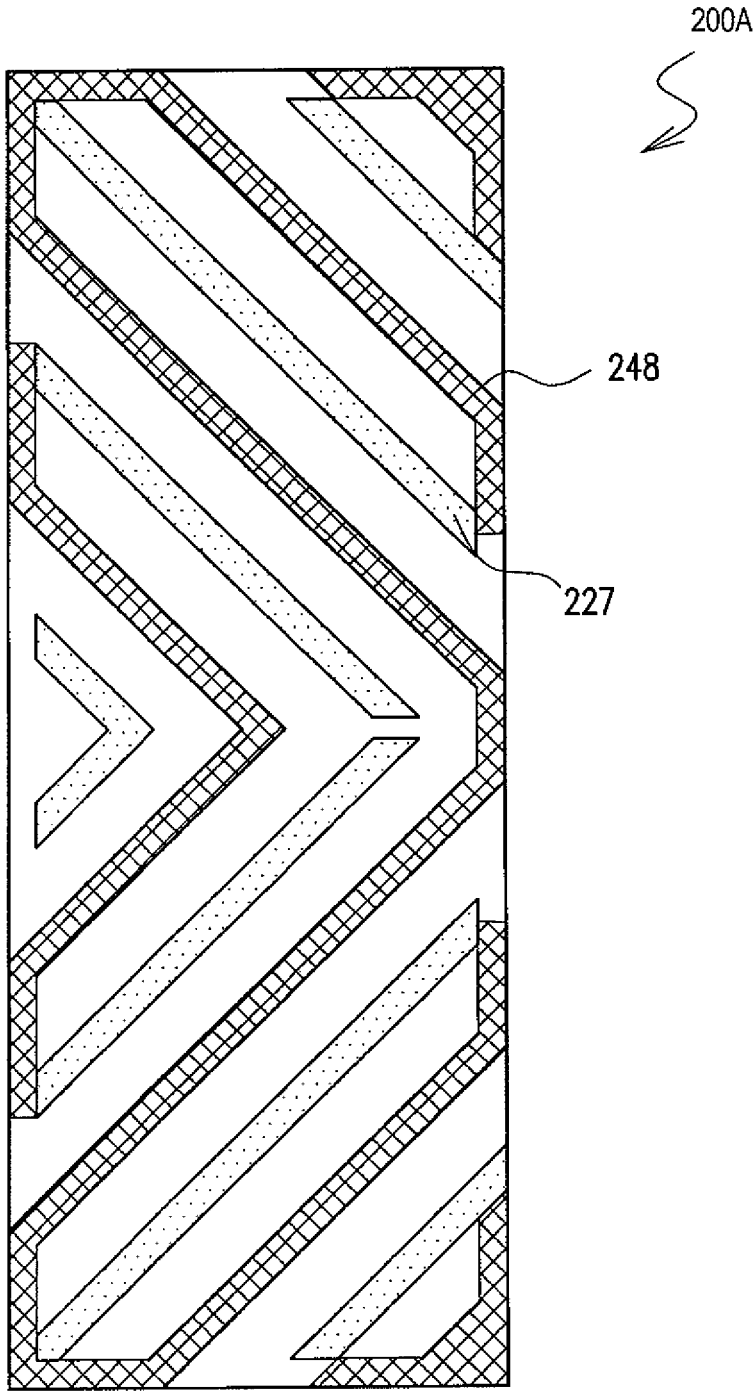
FIG. 22 is a plan view schematically illustrating a region allocated to one subpixel in the LCD panel of the liquid crystal display device shown in FIG. 1.

FIG. 21 is a partial cross-sectional view schematically illustrating a cross-sectional structure for the LCD panel 200A. FIG. 22 is a plan view schematically illustrating a region allocated to one subpixel in the LCD panel 200A. The slits 227 have been cut so as to run in stripes and parallel to their adjacent ribs 248.

On the surface of an insulating substrate 222, arranged in contact with a liquid crystal layer 260 are gate bus lines (scan lines), source bus lines (signal lines) and TFTs (none of which are shown in FIG. 21), and an interlayer insulating film 225 is provided to cover all of those lines and TFTs. And pixel electrodes 224 have been formed on that interlayer insulating film 225. The pixel electrodes 224 and the counter electrode 244 face each other with the liquid crystal layer 260 interposed between them.

Striped slits 227 have been cut through the pixel electrodes 224. And almost the entire surface of the pixel electrodes 224, as well as inside the slits 227, is covered with a vertical alignment layer (not shown). As shown in FIG. 22, those slits 227 run in stripes. Two adjacent slits 227 are arranged parallel to each other so that each slit 227 splits the gap between its adjacent ribs 248 into two substantially evenly.

In the region between a striped slit 227 and its associated rib 248, which are arranged parallel to each other, the alignment direction of liquid crystal molecules 262 is controlled by the slit 227 and the rib 248 that interpose that region. As a result, two domains are produced on both sides of the slit 227 and on both sides of the rib 248 so that the alignment direction of the liquid crystal molecules 262 in one of those two domains is different from that of the liquid crystal molecules 262 in the other domain by 180 degrees. In this LCD panel 200A, the slits 227 are arranged to run in two different directions that define an angle of 90 degrees between them, so are the ribs 248 as shown in FIG. 22. Consequently, four liquid crystal domains, in any of which the alignment direction of the liquid crystal molecules 262 is different by 90 degrees from their counterparts in each of its adjacent domains, are produced in each subpixel.

Also, two polarizers (not shown) to put on the outside of the insulating substrates 222 and 242 are arranged as crossed Nicols so that their transmission axes cross each other substantially at right angles. If the polarizers are arranged so that the alignment direction in each of the four domains, which is different by 90 degrees from the one in any adjacent domain, and the transmission axis of its associated one of the polarizers define an angle of 45 degrees between them, the variation in retardation due to the creation of those domains can be used most efficiently. For that reason, the polarizers are preferably arranged so that their transmission axes define an angle of substantially 45 degrees with respect to the directions in which the slits 227 and the ribs 248 run. Also, in a display device such as a TV to which the viewer often changes his or her viewing direction horizontally, the transmission axis of one of the two polarizers is preferably arranged horizontally with respect to the display screen in order to reduce the viewing angle dependence of the display quality. In the LCD panel 200A with such a configuration, when a predetermined voltage is applied to the liquid crystal layer 260, a number of regions (i.e., domains) where the liquid crystal molecules 262 tilt in mutually different directions are produced in each subpixel, thus realizing a display with a wide viewing angle.

In the preferred embodiment described above, the LCD panel 200A is supposed to operate in the MVA mode. However, this is just an example of the present invention. Alternatively, the LCD panel 200A may also operate in a CPA mode.

Hereinafter, a CPA mode LCD panel 200A will be described with reference to FIGS. 23 and 24. Each subpixel electrode 224*r*, 224*g*, 224*b* of the LCD panel 200A shown in FIG. 23(*a*) has multiple notches 224β at predetermined locations, which divide the subpixel electrode 224*r*, 224*g*, 224*b* into a number of unit electrodes 224α. Each of those unit electrodes 224α has a substantially rectangular shape. In the example shown in FIG. 23, each subpixel electrode 224*r*,

224*g*, 224*b* is supposed to be divided into three unit electrodes 224α. However, the number of divisions does not have to be three.

Figure 23:
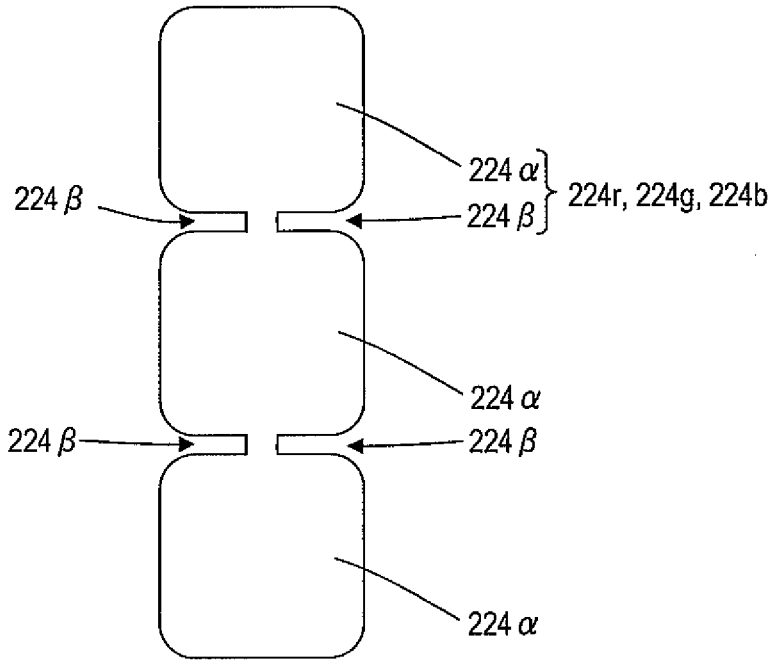
FIGS. 23(*a*) and 23(*b*) are plan views schematically illustrating a region allocated to one subpixel in the LCD panel of the liquid crystal display device shown in FIG. 1.
Figure 23:
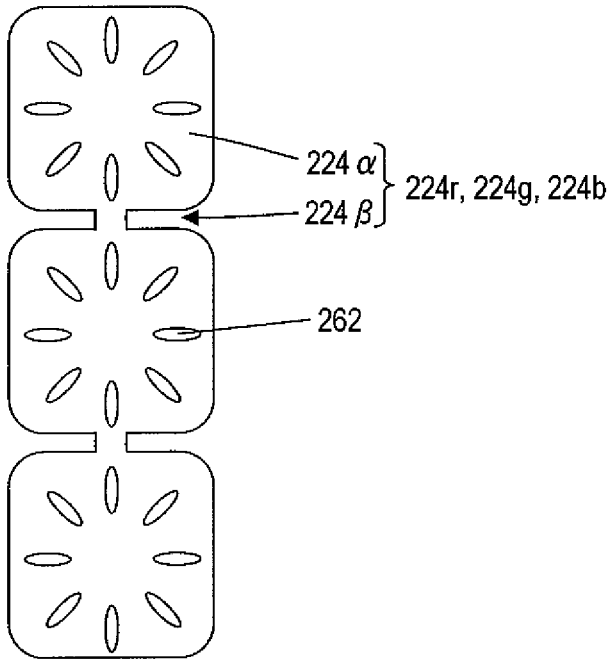

When a voltage is applied to between the subpixel electrode 224*r*, 224*g*, 224*b* with such a configuration and the counter electrode (not shown), an oblique electric field is generated around the outer periphery of the subpixel electrode 224*r*, 224*g*, 224*b* and inside its notches 224β, thereby producing a number of liquid crystal domains in which liquid crystal molecules are aligned axisymmetrically (i.e., have radially tilted orientations) as shown in FIG. 23(*b*). One liquid crystal domain is produced on each unit electrode 224α. And in each liquid crystal domain, the liquid crystal molecules 262 tilt in almost every direction. That is to say, in this LCD panel 200A, there are an infinite number of regions where the liquid crystal molecules 262 tilt in mutually different directions. As a result, a wide viewing angle display is realized.

The subpixel electrode 224*r*, 224*g*, 224*b* shown in FIG. 23 has notches 224β. Alternatively, the notches 224β may be replaced with openings 224γ as shown in FIG. 24. Each subpixel electrode 224*r*, 224*g*, 224*b* shown in FIG. 24 has multiple openings 224γ, which divide the subpixel electrode 224*r*, 224*g*, 224*b* into a number of unit electrodes 224α. When a voltage is applied to between such a subpixel electrode 224*r*, 224*g*, 224*b* and the counter electrode (not shown), an oblique electric field is generated around the outer periphery of the subpixel electrode 224*r*, 224*g*, 224*b* and inside its openings 224γ, thereby producing a number of liquid crystal domains in which liquid crystal molecules are aligned axisymmetrically (i.e., have radially tilted orientations).

Figure 24:
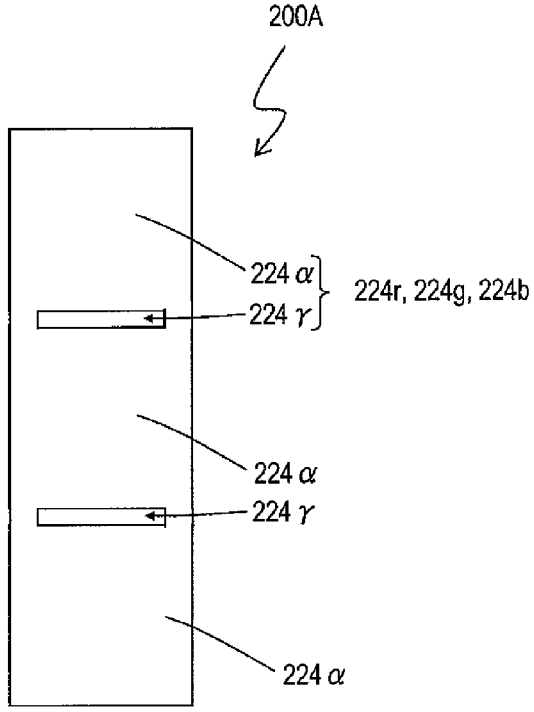
FIG. 24 is a plan view schematically illustrating a region allocated to one subpixel in the LCD panel of the liquid crystal display device shown in FIG. 1.

In the examples illustrated in FIGS. 23 and 24, each single subpixel electrode 224*r*, 224*g*, 224*b* has either multiple notches 224β or multiple openings 224γ. However, if each subpixel electrode 224*r*, 224*g*, 224*b* needs to be split into two, only one notch 224β or opening 224γ may be provided. In other words, by providing at least one notch 224β or opening 224γ for each subpixel electrode 224*r*, 224*g*, 224*b*, multiple axisymmetrically aligned liquid crystal domains can be produced. The subpixel electrode 224*r*, 224*g*, 224*b* may have any of various shapes as disclosed in Japanese Patent Application Laid-Open Publication No. 2003-43525, for example.

Figure 25:
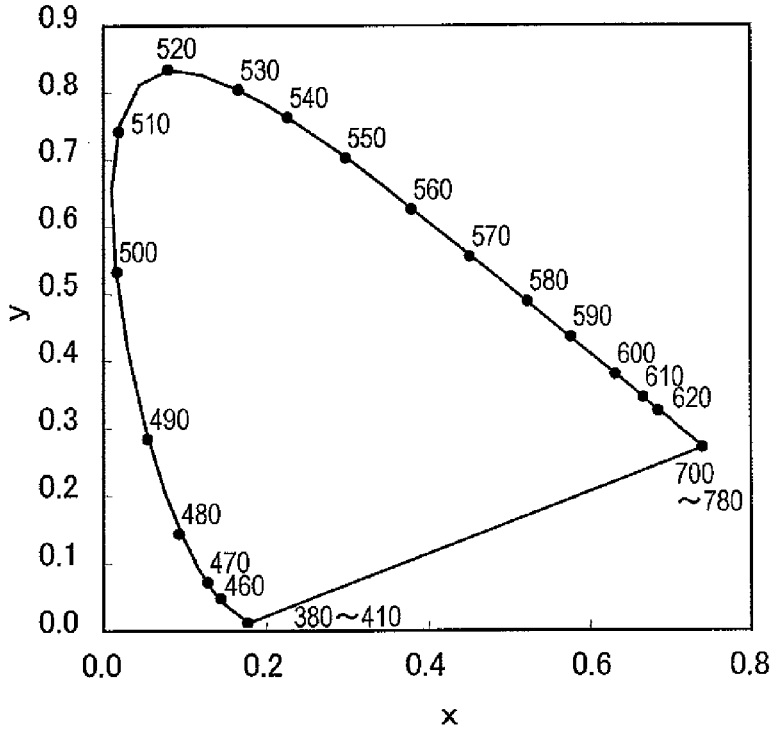
FIG. 25 is a chromaticity diagram of the XYZ color system showing the dominant wavelengths of respective subpixels in the LCD panel of the liquid crystal display device shown in FIG. 1.

FIG. 25 shows the xy chromaticity diagram of the XYZ color system. The spectrum locus and dominant wavelengths are shown in FIG. 25. In the LCD panel 200A, red subpixels have a dominant wavelength of 605 nm to 635 nm, green subpixels have a dominant wavelength of 520 nm to 550 nm, and blue subpixels have a dominant wavelength of 470 nm or less.

In the preferred embodiment described above, the luminances of blue subpixels are supposed to be controlled by using, as a unit, two blue subpixels belonging to two pixels that are arranged adjacent to each other in the row direction. However, the present invention is in no way limited to that specific preferred embodiment. Alternatively, the luminances of blue subpixels may also be controlled by using, as a unit, two blue subpixels belonging to two pixels that are arranged adjacent to each other in the column direction. Nevertheless, if those blue subpixels belonging to two adjacent pixels in the column direction are used as a unit, line memories and other circuit components are needed, thus increasing the circuit size required.

Figure 26:
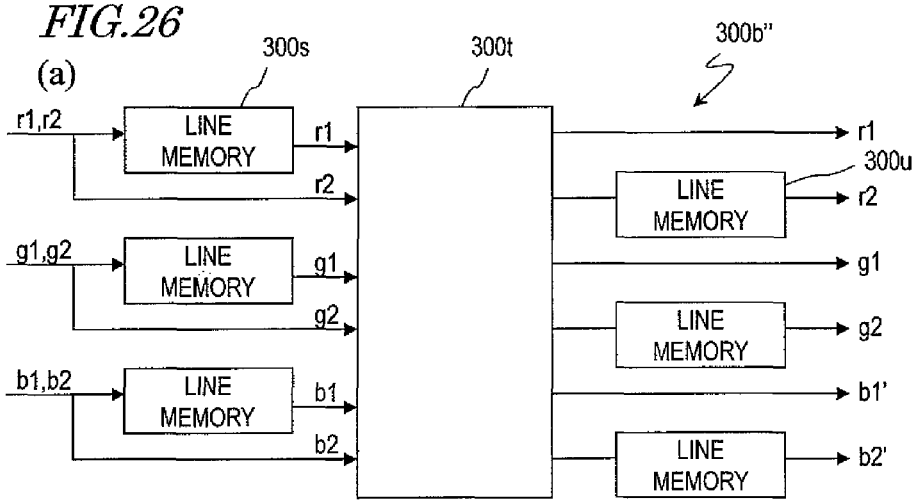
FIG. 26(*a*) is a schematic representation illustrating a configuration for the blue correcting section of a liquid crystal display device as a modified example of the first preferred embodiment, and FIG. 26(*b*) is a schematic representation illustrating a configuration for its grayscale control section.
Figure 26:
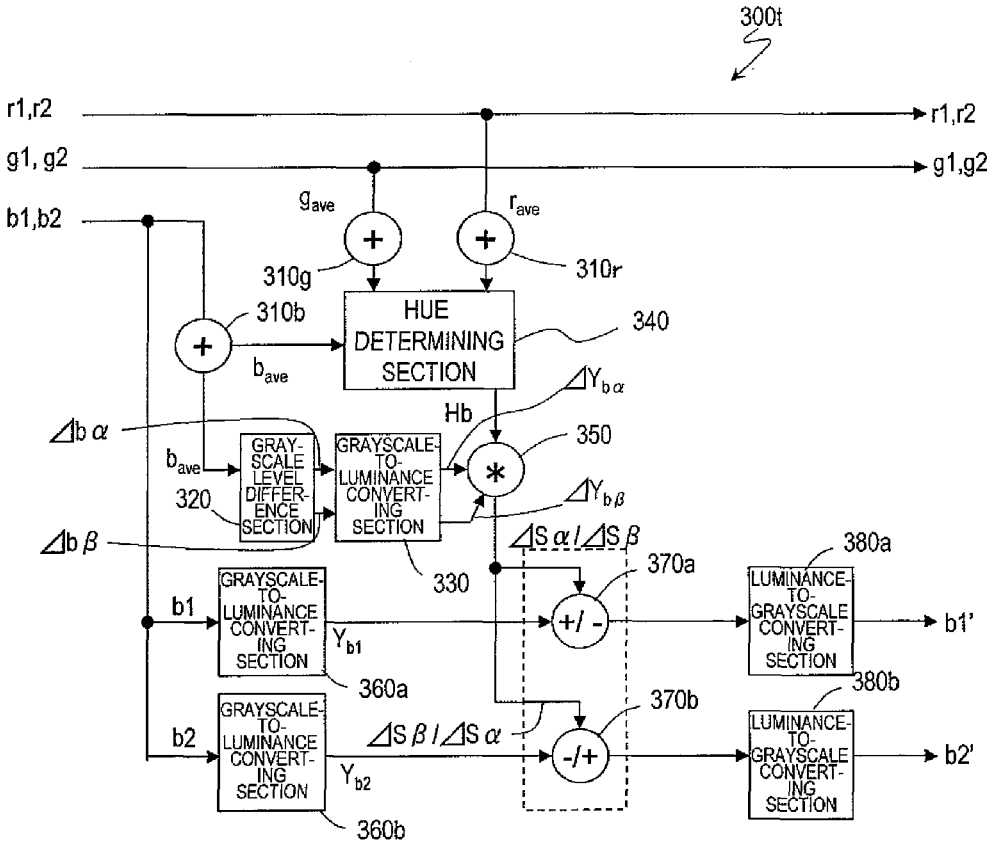

FIG. 26 is a schematic representation illustrating a blue correcting section 300*b*" that is designed to control the luminances using, as a unit, two blue subpixels belonging to two pixels that are adjacent to each other in the column direction. As shown in FIG. 26(*a*), the blue correcting section 300*b*" includes first-stage line memories 300*s*, a grayscale control section 300*t*, and second-stage line memories 300*u*. The grayscale levels r1, g1 and b1 are indicated by the input signal for red, green and blue subpixels belonging to one pixel. On the other hand, the grayscale levels r2, g2 and b2 are indicated by the input signal for red, green and blue subpixels belonging to another pixel that is adjacent to the former pixel in the column direction and located on the next row. The first-stage line memories 300*s* delay the input of the grayscale levels r1, g1, and b1 to the grayscale control section 300*t* by one line.

FIG. 26(*b*) is a schematic representation illustrating the grayscale control section 300*t*. In the grayscale control section 300*t*, the average grayscale level $b_{ave}$ of the grayscale levels b1 and b2 is calculated by using an adding section 310*b*. Next, a grayscale level difference section 320 calculates two grayscale level differences Δbα and Δbβ with respect to the single average grayscale level $b_{ave}$. Thereafter, a grayscale-to-luminance converting section 330 converts the grayscale level differences Δbα and Δbβ into luminance level differences $\Delta Y_b\alpha$ and $\Delta Y_b\beta$, respectively.

Meanwhile, the average grayscale level $r_{ave}$ of the grayscale levels r1 and r2 is calculated by using an adding section 310*r*. And the average grayscale level $g_{ave}$ of the grayscale levels g1 and g2 is calculated by using an adding section 310*g*. Then, a hue determining section 340 calculates a hue coefficient Hb based on these average grayscale levels $r_{ave}$, $g_{ave}$ and $b_{ave}$.

Next, the magnitudes of shift ΔSα and ΔSβ are calculated. In this case, the magnitude of shift ΔSα is obtained as the product of $\Delta Y_b\alpha$ and the hue coefficient Hb, while the magnitude of shift ΔSβ is obtained as the product of $\Delta Y_b\beta$ and the hue coefficient Hb. A multiplying section 350 multiplies the luminance level differences $\Delta Y_b\alpha$ and $\Delta Y_b\beta$ by the hue coefficient Hb, thereby obtaining the magnitudes of shift ΔSα and ΔSβ.

Meanwhile, a grayscale-to-luminance converting section 360*a* carries out a grayscale-to-luminance conversion on the grayscale level b1, thereby obtaining a luminance level $Y_{b1}$. In the same way, another grayscale-to-luminance converting section 360*b* carries out a grayscale-to-luminance conversion on the grayscale level b2, thereby obtaining a luminance level $Y_{ba}$. Next, an adding and subtracting section 370*a* adds the luminance level $Y_{b1}$ and the magnitude of shift ΔSα together, and then the sum is subjected to luminance-to-grayscale conversion by a luminance-to-grayscale converting section 380*a*, thereby obtaining a grayscale level b1'. On the other hand, another adding and subtracting section 370*b* subtracts the magnitude of shift ΔSβ from the luminance level $Y_{b2}$, and then the remainder is subjected to luminance-to-grayscale conversion by another luminance-to-grayscale converting section 380*b*, thereby obtaining a grayscale level b2'. After that, the second-stage line memories 300*u* delay the output of the grayscale levels r2, g2 and b2' by one line as shown in FIG. 26(*a*). In this manner, the blue correcting section 300*b*" controls the luminances by using, as a unit, two blue subpixels belonging to two pixels that are adjacent to each other in the column direction.

In the preferred embodiment described above, the input signal is supposed to be a YCrCb signal, which is usually used as a color TV signal. However, the input signal does not have to be a YCrCb signal but may also indicate the grayscale levels of respective subpixels representing either the three primary colors of R, G and B or any other set of three primary colors such as Ye, M and C (where Ye denotes yellow, M denotes magenta and C denotes cyan).

Also, in the preferred embodiment described above, the grayscale levels are supposed to be indicated by the input signal and the correcting section 300A is supposed to correct the grayscale level of blue subpixels. However, the present invention is in no way limited to that specific preferred embodiment. Alternatively, the luminance levels may be indicated by the input signal. Or the grayscale levels may be converted into luminance levels and then the correcting section 300A may correct the luminance level of blue subpixels. Nevertheless, the luminance level is obtained by raising the grayscale level to the $2.2^{th}$ power and the precision of the luminance level should be higher than that of the grayscale level to the same degree. That is why a circuit for correcting the grayscale levels can be implemented at a lower cost than a circuit for correcting the luminance levels.

Furthermore, in the preferred embodiment described above, when an achromatic color should be represented, the grayscale levels of red, green and blue subpixels yet to be entered into the LCD panel 200A are supposed to be equal to each other. However, this is just an example of the present invention. Optionally, the liquid crystal display device may further include an independent gamma correction processing section for performing independent gamma correction processing. And even when an achromatic color needs to be represented, the grayscale levels of red, green and blue subpixels yet to be entered into the LCD panel 200A may be slightly different from each other.

Hereinafter, a liquid crystal display device 100A' that further includes an independent gamma correction processing section 280 will be described with reference to FIG. 27. Except the independent gamma correction processing section 280, however, the liquid crystal display device 100A' has the same configuration as the liquid crystal display device 100A shown in FIG. 1.

Figure 27:
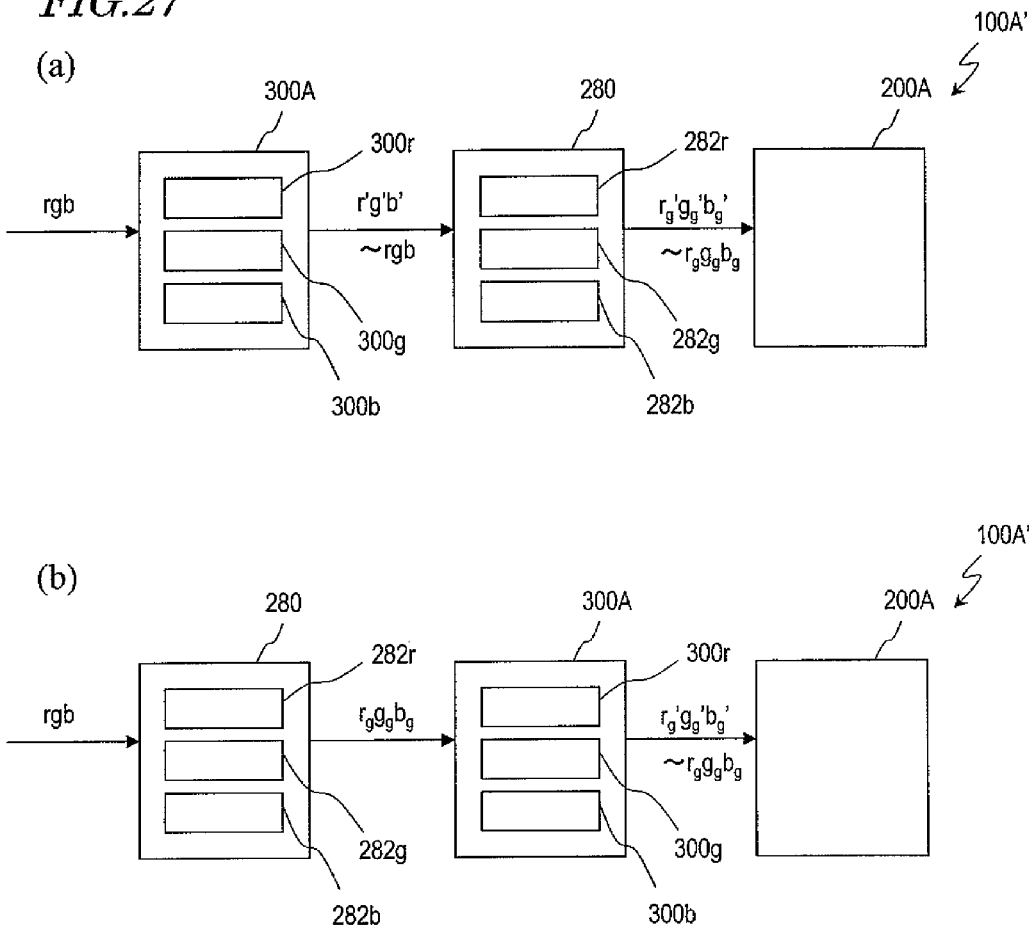
FIGS. 27(*a*) and 27(*b*) are schematic representations illustrating two configurations for a liquid crystal display device as a modified example of the first preferred embodiment in which an independent gamma correction processing section is positioned after and before the correcting section, respectively.

In the liquid crystal display device 100A' shown in FIG. 27(*a*), the grayscale levels r', g' and b' that have been corrected by the correcting section 300A are input to the independent gamma correction processing section 280, which performs independent gamma correction processing on them. Without the independent gamma correction processing, if the color indicated by the input signal changes from black to white while remaining achromatic colors, then the chromaticity of the achromatic color may vary uniquely to the LCD panel 200A when the LCD panel 200A is viewed straight on. By performing the independent gamma correction processing, however, such a chromaticity variation can be minimized.

The independent gamma correction processing section 280 includes red, green and blue processing sections 282*r*, 282*g* and 282*b* for performing independent gamma correction processing on the grayscale levels r', g' and b', respectively. As a result of the independent gamma correction processing that has been performed by these processing sections 282*r*, 282*g* and 282*b*, the grayscale levels r', g' and b' are converted into grayscale levels $r_g'$, $g_g'$ and $b_g'$, respectively. In the same way, grayscale levels r, g and b are converted into grayscale levels $r_g$, $g_g$ and $b_g$, respectively. After that, those grayscale levels $r_g'$, $g_g'$ and $b_g'$ through $r_g$, $g_g$ and $b_g$ that have been subjected to the independent gamma correction processing by the independent gamma correction processing section 280 are input to the LCD panel 200A.

In the liquid crystal display device 100A' shown in FIG. 27(*a*), the independent gamma correction processing section 280 is positioned after the correcting section 300A. However, the present invention is in no way limited to that specific preferred embodiment. Alternatively, the independent gamma correction processing section 280 may also be positioned before the correcting section 300A as shown in FIG. 27(*b*). In that case, the independent gamma correction processing section 280 makes independent gamma correction processing on the grayscale levels r, g and b indicated by the input signal, thereby obtaining grayscale levels $r_g$, $g_g$ and $b_g$. After that, the correcting section 300A makes correction on the signal that has already been subjected to the independent gamma correction processing. As the multiplier for use to perform a luminance-to-grayscale conversion in the correcting section 300A, not the fixed value (e.g., $2.2^{th}$ power) but a value that has been selected according to the characteristic of the LCD panel 200A is used. By providing the independent gamma correction processing section 280 in this manner, the variation in the chromaticity of an achromatic color according to the lightness can also be reduced.

Embodiment 2

In the preferred embodiment described above, each subpixel is supposed to have a single luminance. However, the present invention is in no way limited to that specific preferred embodiment. Optionally, a multi-pixel structure may be adopted and each subpixel may have multiple regions with mutually different luminances.

Hereinafter, a second specific preferred embodiment of a liquid crystal display device according to the present invention will be described with reference to FIG. 28. The liquid crystal display device 100B of this preferred embodiment includes an LCD panel 200B and a correcting section 300B, which also includes red, green and blue correcting sections 300*r*, 300*g* and 300*b*. This liquid crystal display device 100B has the same configuration as its counterpart of the first preferred embodiment described above except that each subpixel in the LCD panel 200B has multiple regions that may have mutually different luminances and that the effective potential of a divided electrode that defines such regions with different luminances varies with the potential on a CS bus line. Thus, description of their common features will be omitted herein to avoid redundancies.

Figure 29:
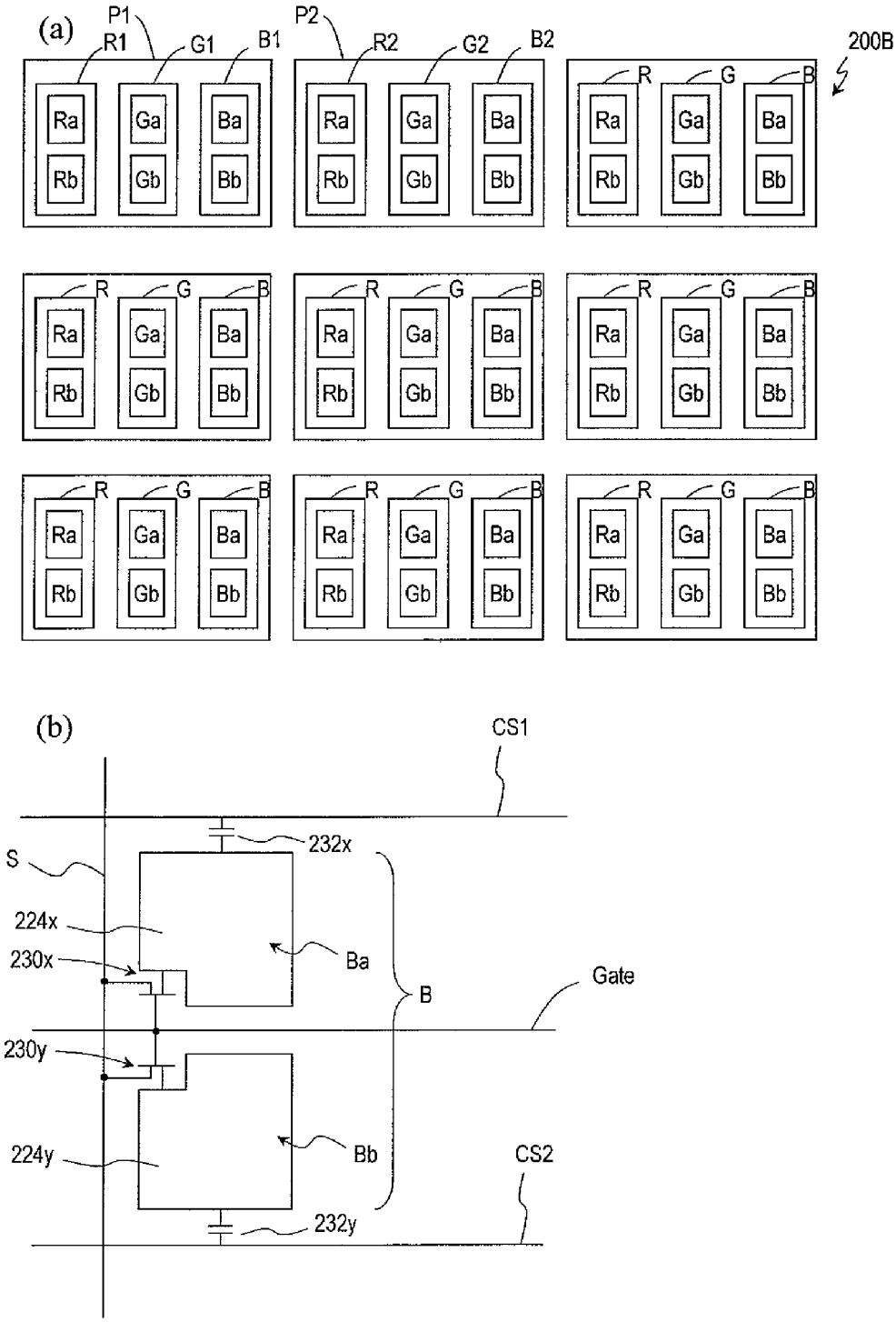
FIG. 29(*a*) is a schematic representation illustrating how respective pixels may be arranged in the liquid crystal display device shown in FIG. 28, and FIG. 29(*b*) is a circuit diagram illustrating the active-matrix substrate of its LCD panel.

FIG. 29(*a*) illustrates how pixels and subpixels, included in each of those pixels, may be arranged in this LCD panel 200B. As an example, FIG. 29(*a*) illustrates an arrangement of pixels in three columns and three rows. Each of those pixels includes three subpixels, which are red, green and blue subpixels R, G and B. The luminances of these subpixels can be controlled independently of each other.

In this liquid crystal display device 100B, each of the three subpixels R, G and B has two divided regions. Specifically, the red subpixel R has first and second regions Ra and Rb, the green subpixel G has first and second regions Ga and Gb, and the blue subpixel B has first and second regions Ba and Bb.

In each of these subpixels R, G and B, the luminance values of its multiple regions may be controlled to be different from each other. As a result, the viewing angle dependence of the gamma characteristic, which refers to a phenomenon that the gamma characteristic when the display screen is viewed straight on is different from the one when the display screen is viewed obliquely, can be reduced. Methods for reducing the viewing angle dependence of the gamma characteristic are disclosed in Japanese Patent Application Laid-Open Publications Nos. 2004-62146 and 2004-78157, for example. By controlling the luminances of multiple different regions of each of those subpixels R, G and B so that those luminances are different from each other, the viewing angle dependence of the gamma characteristic can be reduced as well as is disclosed in Japanese Patent Application Laid-Open Publications Nos. 2004-62146 and 2004-78157. Such a red, green and blue (R, G and B) structure is also called a "divided structure". In the following description, one of the first and second regions that has the higher luminance will sometimes be referred to herein as a "bright region" and the other region with the lower luminance as a "dark region".

FIG. 29(*b*) illustrates a configuration for a blue subpixel B in the liquid crystal display device 100B. Although not shown in FIG. 29(*b*), red and green subpixels R and G also have the same configuration.

The blue subpixel B has two regions Ba and Bb that are defined by divided electrodes 224*x* and 224*y*, respectively. A TFT 230*x* and a storage capacitor 232*x* are connected to the divided electrode 224*x* and a TFT 230*y* and a storage capacitor 232*y* are connected to the divided electrode 224*y*. The TFTs 230*x* and 230*y* have their respective gate electrodes connected to the same gate bus line Gate and have their respective source electrodes connected in common to the same source bus line S. The storage capacitors 232*x* and 232*y* are connected to CS bus lines CS1 and CS2, respectively. The storage capacitor 232*x* is formed by a storage capacitor electrode that is electrically connected to the divided electrode 224*x*, a storage capacitor counter electrode that is electrically connected to the CS bus line CS1, and an insulating layer (not shown) that is arranged between those two electrodes. Likewise, the storage capacitor 232*y* is formed by a storage capacitor electrode that is electrically connected to the divided electrode 224*y*, a storage capacitor counter electrode that is electrically connected to the CS bus line CS2, and an insulating layer (not shown) that is arranged between those two electrodes. The storage capacitor counter electrodes of the storage capacitors 232*x* and 232*y* are independent of each other and can be supplied with mutually different storage capacitor counter voltages through the CS bus lines CS1 and CS2, respectively. Thus, after a voltage has been applied to the divided electrodes 224*x* and 224*y* through the source bus line S while the TFTs 230*x* and 230*y* are in ON state, the TFTs 230*x* and 230*y* may turn OFF and the potentials on the CS bus lines CS1 and CS2 may vary into different values. In that case, the divided electrode 224*x* will have a different effective voltage from the divided electrode 224*y*. As a result, the first region Ba comes to have a different luminance from the second region Bb.

Figure 30:
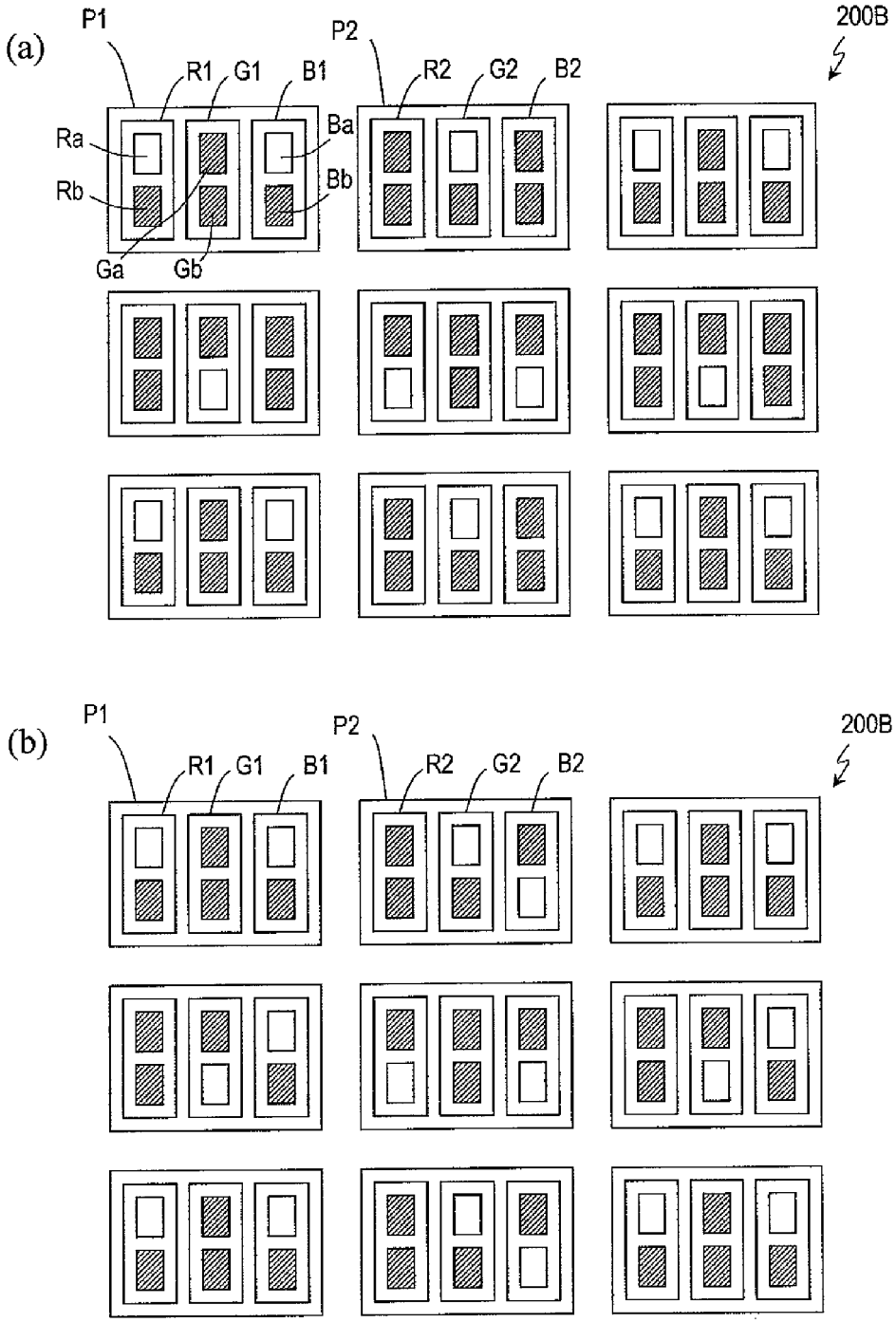
FIGS. 30(*a*) and 30(*b*) are schematic representations illustrating how the LCD panel of the liquid crystal display device shown in FIG. 28 looks when representing an achromatic color and when representing a chromatic color, respectively.

FIGS. 30(*a*) and 30(*b*) illustrate how the LCD panel 200B may look in this liquid crystal display device 100B. In FIG. 30(*a*), the input signal indicates that every pixel should represent the same achromatic color. On the other hand, in FIG. 30(*b*), the input signal indicates that every pixel should represent the same chromatic color. In FIGS. 30(*a*) and 30(*b*), two pixels that are adjacent to each other in the row direction are taken as an example. One of those two pixels is identified by P1 and its red, green and blue subpixels are identified by R1, G1 and B1, respectively. The other pixel is identified by P2 and its red, green and blue subpixels are identified by R2, G2 and B2, respectively.

First of all, it will be described with reference to FIG. 30(*a*) how the LCD panel 200B looks when the color indicated by the input signal is an achromatic color. In such a situation, the grayscale levels of the red, green and blue subpixels are equal to each other.

Figure 28:
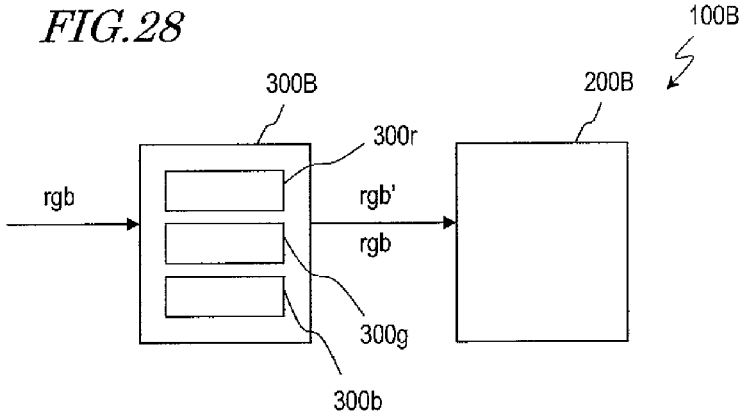
FIG. 28 is a schematic representation illustrating a liquid crystal display device as a second preferred embodiment of the present invention.

In this case, the red, green and blue correcting sections 300*r*, 300*g* and 300*b* shown in FIG. 28 make corrections so that the luminances of the red, green and blue subpixels R1, G1 and B1 of one P1 of the two adjacent pixels are different from those of the red, green and blue subpixels R2, G2 and B2 of the other pixel P2.

Using two subpixels belonging to two adjacent pixels as a unit, each of the red, green and blue correcting sections 300*r*, 300*g* and 300*b* controls the luminances of those subpixels. That is why even if the input signal indicates that such subpixels belonging to two adjacent pixels have the same grayscale level, the LCD panel 200B corrects the grayscale level so that those two subpixels have mutually different luminances. In this preferred embodiment, each of the red, green and blue correcting sections 300*r*, 300*g* and 300*b* makes correction on the grayscale levels of its associated subpixels belonging to two pixels that are adjacent to each other in the row direction. As a result of the correction that has been made by each of the red, green and blue correcting sections 300*r*, 300*g* and 300*b*, one of the two subpixels belonging to those two adjacent pixels has its luminance increased by the magnitude of shift $\Delta S\alpha$, while the other subpixel has its luminance decreased by the magnitude of shift $\Delta S\beta$. Consequently, those two subpixels belonging to the two adjacent pixels have mutually different luminances. In this case, the luminance of the bright subpixel is higher than a luminance corresponding to a reference grayscale level, while that of the dark subpixel is lower than the luminance corresponding to the reference grayscale level. Also, when the screen is viewed straight on, the difference between the luminance of the bright subpixel and the luminance corresponding to the reference grayscale level is substantially equal to the difference between the luminance corresponding to the reference grayscale level and the luminance of the dark subpixel. That is why the average of the luminances of respective subpixels belonging to two adjacent pixels in this LCD panel 200B is substantially equal to that of the luminances corresponding to the grayscale levels of two adjacent subpixels as indicated by the input signal. In this manner, the red, green and blue correcting sections 300*r*, 300*g* and 300*b* make corrections, thereby improving the viewing angle characteristic when the screen is viewed obliquely. In FIG. 30(*a*), two subpixels (e.g., red subpixels) belonging to two pixels that are adjacent to each other in the row direction have opposite brightness levels and two subpixels (e.g., red subpixels) belonging to two pixels that are adjacent to each other in the column direction also have opposite brightness levels.

For example, if the input signal indicates that the grayscale levels of the red, green and blue subpixels should be (100, 100, 100), the liquid crystal display device 100B corrects the grayscale levels of those red, green and blue subpixels into either $137(=(2\times(100/255)^{2.2})^{1/2.2}\times255)$ or zero. As a result, in the LCD panel 200B, the red, green and blue subpixels R1, G1 and B1 belonging to the pixel P1 come to have luminances corresponding to the grayscale levels (137, 0, 137), while the red, green and blue subpixels R2, G2 and B2 belonging to the pixel P2 come to have luminances corresponding to the grayscale levels (0, 137, 0).

In this LCD panel 200B, the red and blue subpixels R1 and B1 of the pixel P1 and the green subpixel G2 of the pixel P2 have an overall luminance corresponding to the grayscale level 137, the regions Ra, Ga and Ba of the red, green and blue subpixels R1, G2 and B1 have a luminance corresponding to the grayscale level $188(=(2\times(137/255)^{2.2})^{1/2.2}\times255)$, and the regions Rb, Gb and Bb of the red, green and blue subpixels R1, G2 and B1 have a luminance corresponding to the grayscale level 0. On the other hand, the red, green and blue subpixels R2, G1 and B2 have an overall luminance corresponding to the grayscale level 0 and the regions Ra and Rb of the red subpixel R2, the regions Ga and Gb of the green subpixel G1 and the regions Ba and Bb of the blue subpixel B2 have a luminance corresponding to the grayscale level 0.

If a multi-pixel drive is performed, the distribution of the luminance levels $Y_{b1}$ and $Y_{b2}$ to the regions Ba and Bb of the blue subpixels B1 and B2 is determined by the structure and settings of the LCD panel 200B although not described in detail herein. Specifically, when viewed straight on, the LCD panel 200B may be designed so that the average luminance of the regions Ba and Bb of the blue subpixel B1 agrees with the luminance corresponding to the grayscale level b1' or b2' of the blue subpixel.

Next, it will be described with reference to FIG. 30(*b*) how the LCD panel 200B looks when the input signal indicates that a chromatic color should be represented. In this case, the input signal is supposed to indicate that the blue subpixel should have a higher grayscale level than the red and green subpixels.

For example, if the input signal indicates that the grayscale levels of the red, green and blue subpixels should be (50, 50, 100), the liquid crystal display device 100B corrects the grayscale levels of the red and green subpixels into either 69(=$(2\times(50/255)^{2.2})^{1/2.2}\times255$) or zero. On the other hand, the liquid crystal display device 100B corrects the grayscale level of the blue subpixel differently from the red and green subpixels. Specifically, the grayscale level of 100 of the blue subpixel indicated by the input signal is corrected into either 121 or 74. It should be noted that $2\times(100/255)^{2.2}=(121/255)^{2.2}+(74/255)^{2.2}$. Consequently, the red, green and blue subpixels R1, G1 and B1 belonging to the pixel P1 in this LCD panel 200B come to have luminances corresponding to the grayscale levels (69, 0, 121) and the red, green and blue subpixels R2, G2 and B2 belonging to the pixel P2 come to have luminances corresponding to the grayscale levels (0, 69, 74).

In this LCD panel 200B, the red subpixel R1 of the pixel P1 has an overall luminance corresponding to the grayscale level 69, the region Ra of the red subpixel R1 has a luminance corresponding to the grayscale level 95(=$(2\times(69/255)^{2.2})^{1/2.2}\times255$), and the region Rb of the red subpixel R1 has a luminance corresponding to the grayscale level 0. In the same way, the region Ga of the green subpixel G2 has a luminance corresponding to the grayscale level 95(=$(2\times(69/255)^{2.2})^{1/2.2}\times255$), and the region Gb of the green subpixel G2 has a luminance corresponding to the grayscale level 0.

The blue subpixel B1 of the pixel P1 has an overall luminance corresponding to the grayscale level 121, the region Ba of the blue subpixel B1 has a luminance corresponding to the grayscale level 167(=$(2\times(121/255)^{2.2})^{1/2.2}\times255$), and the region Bb of the blue subpixel B1 has a luminance corresponding to the grayscale level 0. In the same way, the blue subpixel B2 has an overall luminance corresponding to the grayscale level 74, the region Ba of the blue subpixel B2 has a luminance corresponding to the grayscale level 0, and the region Bb of the blue subpixel B2 has a luminance corresponding to the grayscale level 102(=$(2\times(74/255)^{2.2})^{1/2.2}\times255$).

Embodiment 3

In the preferred embodiments of the present invention described above, the luminance is supposed to be controlled using two subpixels belonging to two adjacent pixels as a unit. However, the present invention is in no way limited to those specific preferred embodiments. Optionally, the luminance may also be controlled using multiple different regions of a single subpixel as a unit.

Hereinafter, a third specific preferred embodiment of a liquid crystal display device according to the present invention will be described with reference to FIG. 31. The liquid crystal display device 100C of this preferred embodiment includes an LCD panel 200C and a correcting section 300C, which also includes red, green and blue correcting sections 300*r*, 300*g* and 300*b*. This liquid crystal display device 100C has the same configuration as its counterpart of the first preferred embodiment described above except that each subpixel has multiple regions, of which the luminances can be different from each other, in the LCD panel 200C and two source bus lines are provided for each column of subpixels. And description of their common features will be omitted herein to avoid redundancies.

Figure 32:
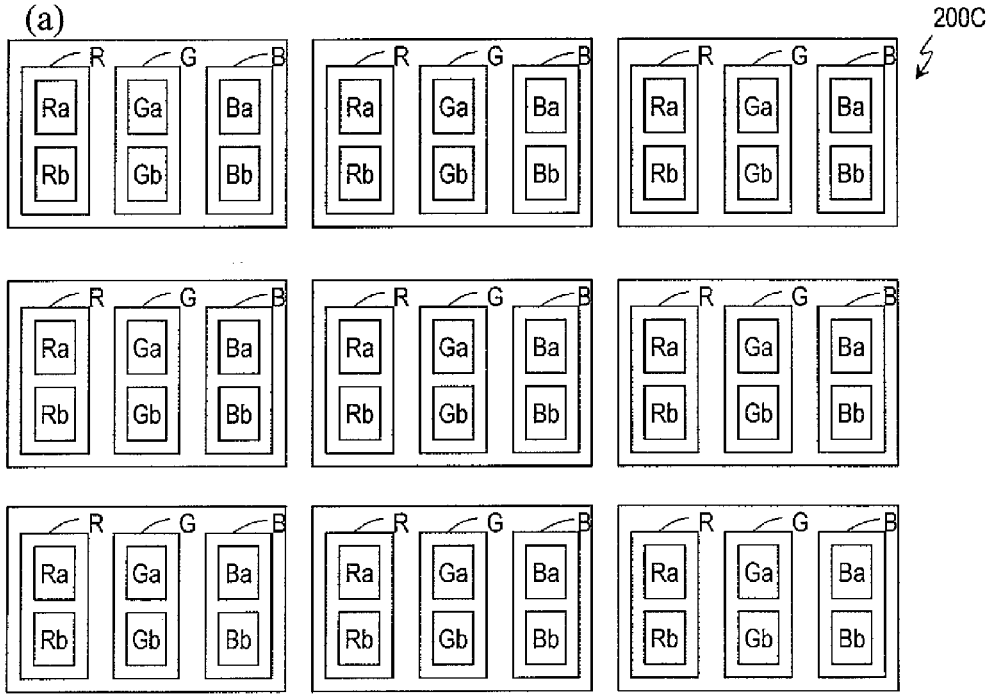
FIG. 32(*a*) is a schematic representation illustrating how respective pixels may be arranged in the liquid crystal display device shown in FIG. 31, and FIG. 32(*b*) is a circuit diagram illustrating the active-matrix substrate of its LCD panel.
Figure 32:
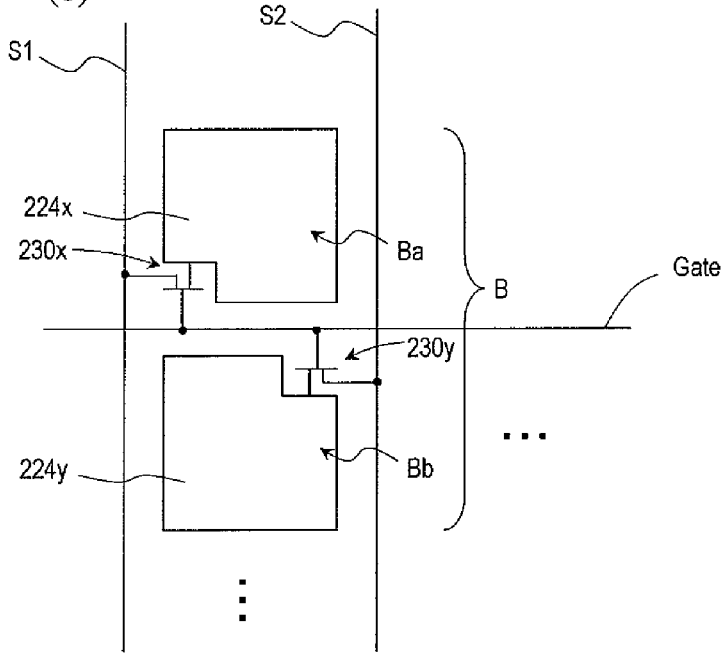

FIG. 32(*a*) illustrates how pixels may be arranged in the LCD panel 200C and how subpixels may be arranged in each of those pixels. In FIG. 32(*a*), illustrated as an example is a matrix of pixels that are arranged in three columns and three rows. Each of those pixels has three subpixels that are red, green and blue subpixels R, G and B.

In this liquid crystal display device 100C, each of the three subpixels R, G and B has two divided regions. Specifically, the red subpixel R has first and second regions Ra and Rb, the green subpixel G has first and second regions Ga and Gb, and the blue subpixel B has first and second regions Ba and Bb. The luminances of these two different regions of each subpixel are controllable independently of each other.

FIG. 32(*b*) illustrates a configuration for a blue subpixel B in the liquid crystal display device 100C. Although not shown in FIG. 32(*b*), red and green subpixels R and G also have the same configuration.

The blue subpixel B has two regions Ba and Bb that are respectively defined by divided electrodes 224*x* and 224*y*, to which TFTs 230*x* and 230*y* are respectively connected. The TFTs 230*x* and 230*y* have their respective gate electrodes connected to the same gate bus line Gate and have their respective source electrodes connected to two different source bus lines S1 and S2, respectively. Thus, while the TFTs 230*x* and 230*y* are in ON state, a voltage is applied to the divided electrodes 224*x* and 224*y* through the source bus lines S1 and S2, respectively, and the first region Ba may have a different luminance from the second region Bb.

In this LCD panel 200C, the voltage to be applied to the divided electrodes 224*x* and 224*y* can be set much more flexibly than in the LCD panel 200B described above. Thus, in this LCD panel 200C, the luminances can be controlled using multiple different regions of a single subpixel as a unit. In this LCD panel 200C, however, two source bus lines are provided for each column of subpixels and the source driver (not shown) needs to perform two different series of signal processing on the single column of subpixels.

In this LCD panel 200C, the luminances are controlled using multiple different regions of a single subpixel as a unit, and therefore, the resolution never decreases. When a middle grayscale is displayed, however, regions with low luminance may be sensed according to the pixel size and the color to be represented, and the display quality may be debased. To overcome such a problem, in this liquid crystal display device 100C, the correcting section 300C minimizes such a decline in display quality.

Figure 33:
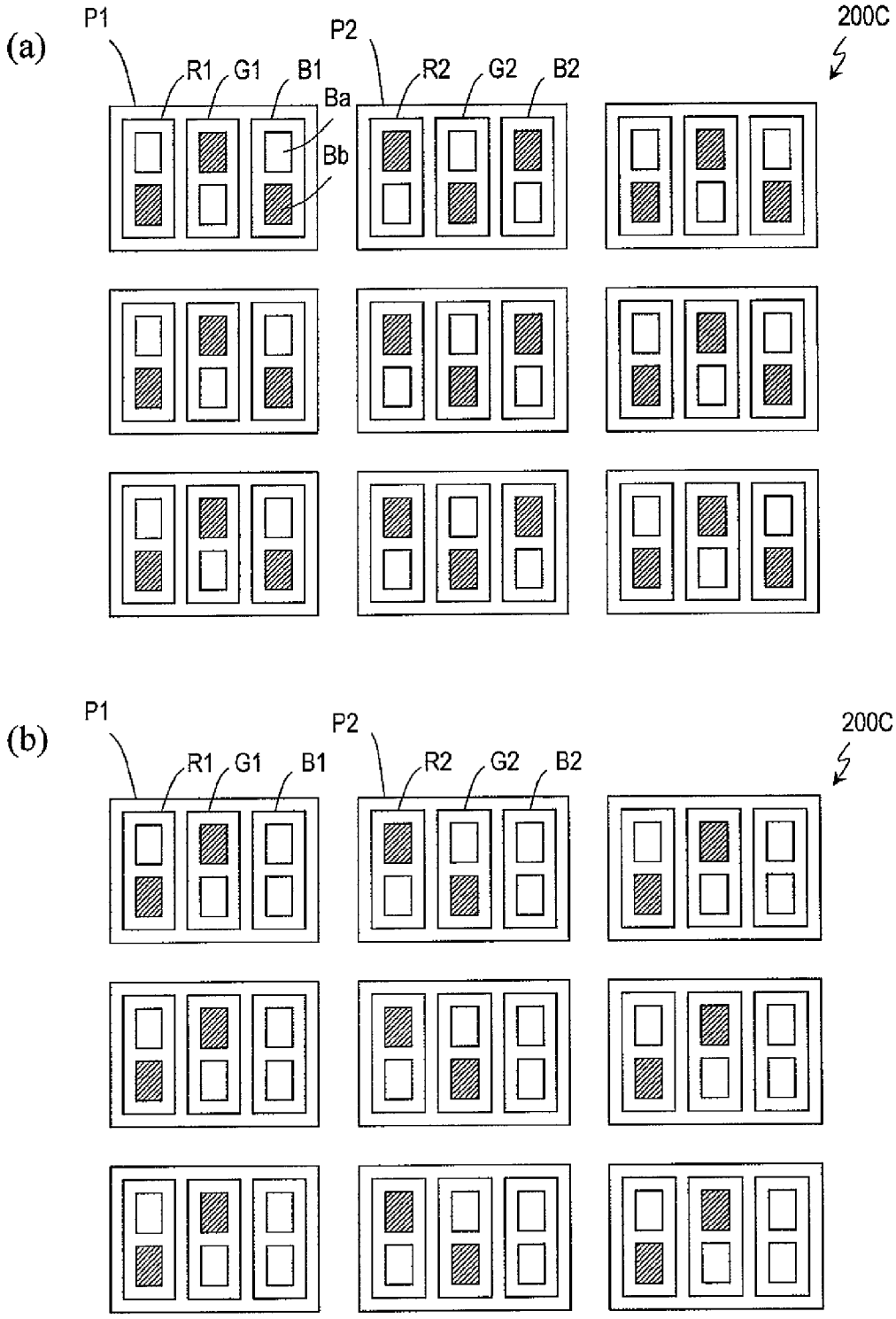
FIGS. 33(*a*) and 33(*b*) are schematic representations illustrating how the LCD panel of the liquid crystal display device shown in FIG. 31 looks when representing an achromatic color and when representing a chromatic color, respectively.

FIGS. 33(*a*) and 33(*b*) illustrate how the LCD panel 200C may look in this liquid crystal display device 100C. In FIG. 33(*a*), the input signal indicates that every pixel should represent the same achromatic color. On the other hand, in FIG. 33(*b*), the input signal indicates that every pixel should represent the same chromatic color. In FIGS. 33(*a*) and 33(*b*), two regions in a single subpixel are taken as an example.

First of all, it will be described with reference to FIG. 33(*a*) how the LCD panel 200C looks when the color indicated by the input signal is an achromatic color. In such a situation, the grayscale levels of the red, green and blue subpixels are equal to each other.

Figure 31:
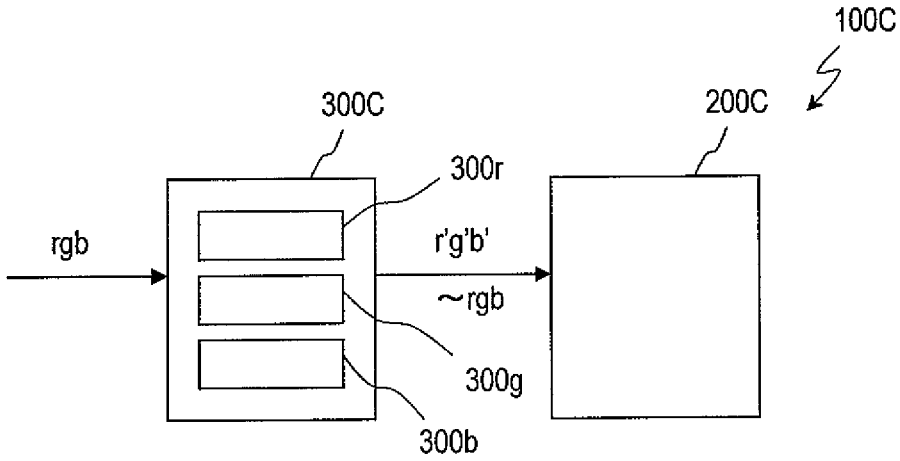
FIG. 31 is a schematic representation illustrating a liquid crystal display device as a third preferred embodiment of the present invention.

In this case, the red, green and blue correcting sections 300*r*, 300*g* and 300*b* shown in FIG. 31 make corrections so that in the LCD panel 200C, the two regions Ra and Rb, Ga and Gb, and Ba and Bb have mutually different luminances in each of the red, green and blue subpixels R1, G1 and B1.

Since the red and green correcting sections 300*r* and 300*g* operate in the same way as the blue correcting section 300*b*, only the operation of the blue correcting section 300*b* will be described. Specifically, the blue correcting section 300*b* controls the luminance of the blue subpixel B1 using its multiple different regions as a unit and corrects the grayscale levels so that those regions Ba and Bb of the blue subpixel B1 have mutually different luminances on the LCD panel 200C.

As a result of the correction that has been made by the blue correcting section 300*b*, the region Ba of the blue subpixel B1 has its luminance increased by the magnitude of shift $\Delta S\alpha$, while the other region Bb thereof has its luminance decreased by the magnitude of shift $\Delta S\beta$. Consequently, those two regions Ba and Bb of the blue subpixel B1 have mutually different luminances. In this case, the luminance of the bright region is higher than a luminance corresponding to a reference grayscale level, while that of the dark region is lower than the luminance corresponding to the reference grayscale level. Also, when the screen is viewed straight on, the first and second regions Ba and Bb have substantially the same area, the difference between the luminance of the bright region and the luminance corresponding to the reference grayscale level is substantially equal to the difference between the luminance corresponding to the reference grayscale level and the luminance of the dark region. That is why the average of the luminances of those two regions Ba and Bb on this LCD panel 200C is substantially equal to the luminance corresponding to the grayscale level of the blue subpixel as indicated by the input signal. The blue correcting section 300*b* makes correction in this manner, thereby improving the viewing angle characteristic when the screen is viewed obliquely.

Next, it will be described with reference to FIG. 33(*b*) how the LCD panel 200C looks when the input signal indicates that a chromatic color should be represented. In this case, the input signal is supposed to indicate that the blue subpixel should have a higher grayscale level than the red and green subpixels.

For example, if the input signal indicates that the grayscale levels of the red, green and blue subpixels should be (50, 50, 100), the liquid crystal display device 100C corrects the grayscale levels of the red and green subpixels into either 69($=(2\times(50/255)^{2.2})^{1/2.2}\times255$) or zero. On the other hand, the liquid crystal display device 100C corrects the grayscale level of the blue subpixel differently from the red and green subpixels. Specifically, the grayscale level of 100 of the blue subpixel indicated by the input signal is corrected into either 121 or 74. It should be noted that $2\times(100/255)^{2.2}=(121/255)^{2.2}+(74/255)^{2.2}$. Consequently, the regions Ra, Ga and Ba of the red, green and blue subpixels R1, G1 and B1 in this LCD panel 200C come to have luminances corresponding to the grayscale levels (69, 0, 121), while the regions Rb, Gb and Bb of the red, green and blue subpixels R1, G1 and B1 come to have luminances corresponding to the grayscale levels (0, 69, 74).

Figure 34:
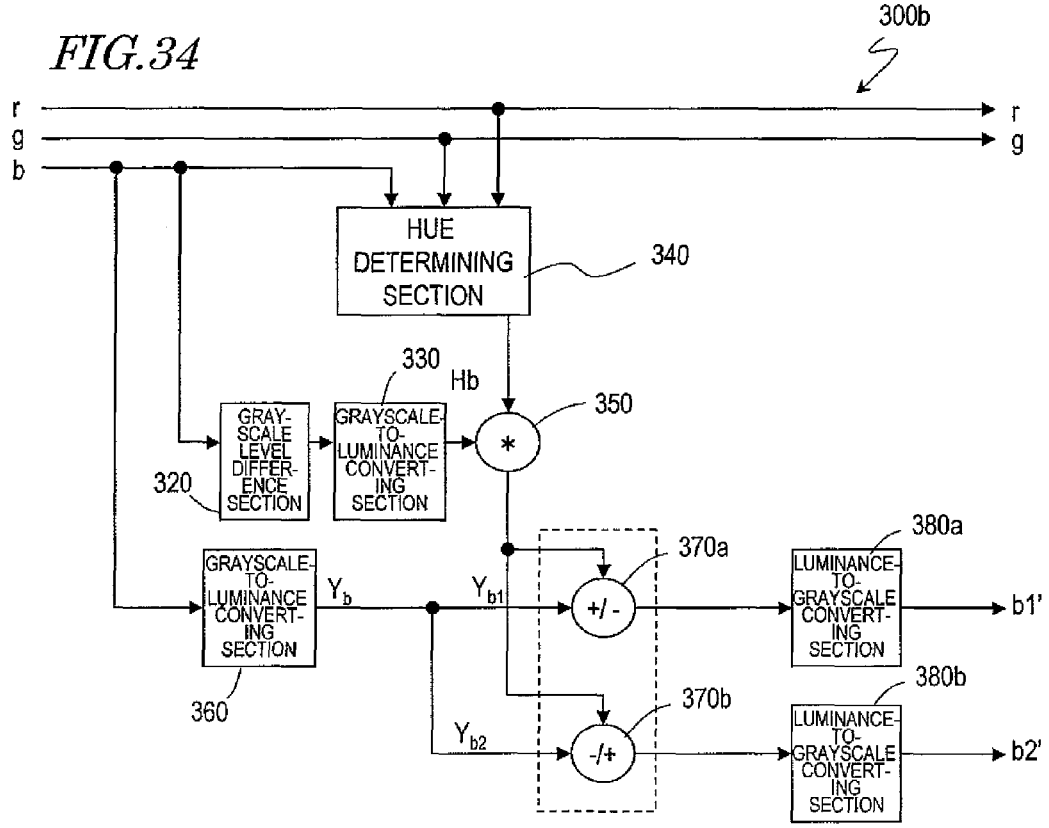
FIG. 34 is a schematic representation illustrating a configuration for the blue correcting section of the liquid crystal display device shown in FIG. 31.

FIG. 34 illustrates a specific configuration for the blue correcting section 300*b*. In this blue correcting section 300*b*, the luminance level $Y_b$ obtained by the grayscale-to-luminance converting section 360 includes luminance levels $Y_{b1}$ and $Y_{b2}$. That is why the luminance levels $Y_{b1}$ and $Y_{b2}$ are equal to each other before subjected to arithmetic operations in adding and subtracting sections 370*a* and 370*b*. In the correcting section 300C, the grayscale level b1' is associated with the region Ba of the blue subpixel B1 and the grayscale level b2' is associated with the region Bb of the blue subpixel B1.

In the LCD panel 200C described above, the number of source bus lines to provide is supposed to be double the number of columns of subpixels. However, the present invention is in no way limited to that specific preferred embodiment. Alternatively, the number of source bus lines may be the same as that of columns of subpixels and the number of gate bus lines to provide may be double the number of rows of subpixels.

Figure 35:
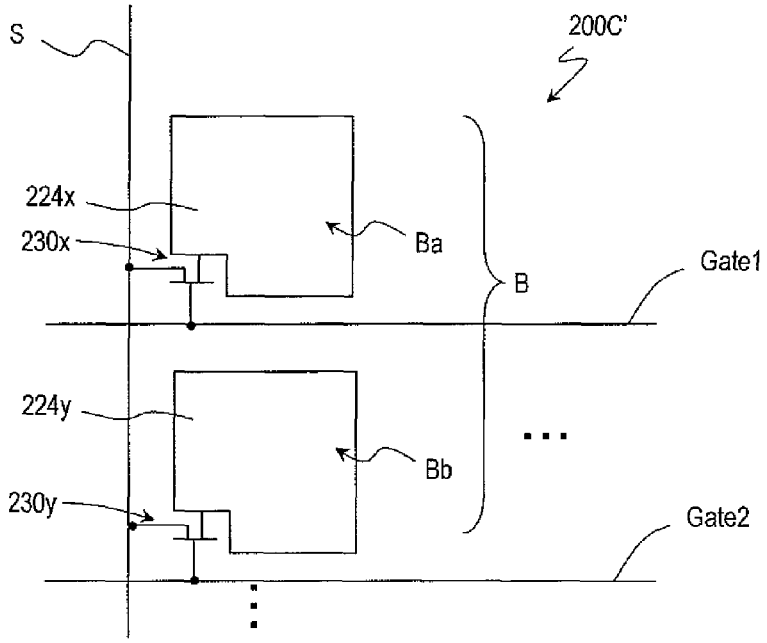
FIG. 35 is a schematic representation illustrating a liquid crystal display device as a modified example of the third preferred embodiment of the present invention.

FIG. 35 is a schematic representation illustrating an alternative LCD panel 200C'. In this LCD panel 200C', the blue subpixel B has two regions Ba and Bb that are respectively defined by divided electrodes 224*x* and 224*y*, to which TFTs 230*x* and 230*y* are respectively connected. The TFTs 230*x* and 230*y* have their respective gate electrodes connected to two different gate bus lines Gate1 and Gate2 and have their respective source electrodes connected to the same source bus line S. Thus, when the TFT 230*x* is in ON state, a voltage is applied to the divided electrode 224*x* through the source bus line S. On the other hand, when the TFT 230*y* is in ON state, a voltage is applied to the divided electrode 224*y* through the source bus line S, too. As a result, the first region Ba may have a different luminance from the second region Bb. In this manner, in this alternative LCD panel 200C', the luminances can also be controlled using two different regions of a single subpixel as a unit. However, in this LCD panel 200C', two gate bus lines need to be provided for each row of pixels and need to be driven at a high rate by a gate driver (not shown).

In the second and third preferred embodiments of the present invention described above, each subpixel R, G or B is supposed to be split into two regions. However, the present invention is in no way limited to those specific preferred embodiments. Optionally, each subpixel R, G or B may be divided into three or more regions.

Embodiment 4

Figure 36:
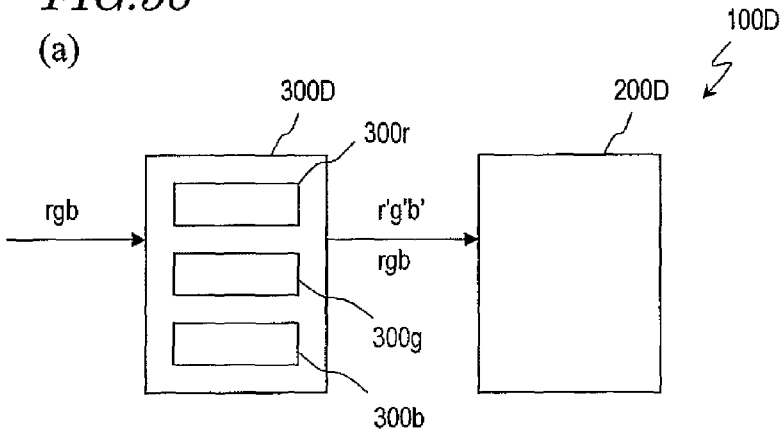
FIG. 36(*a*) is a schematic representation illustrating a liquid crystal display device as a fourth preferred embodiment of the present invention and FIG. 36(*b*) is an equivalent circuit diagram of its LCD panel.
Figure 36:
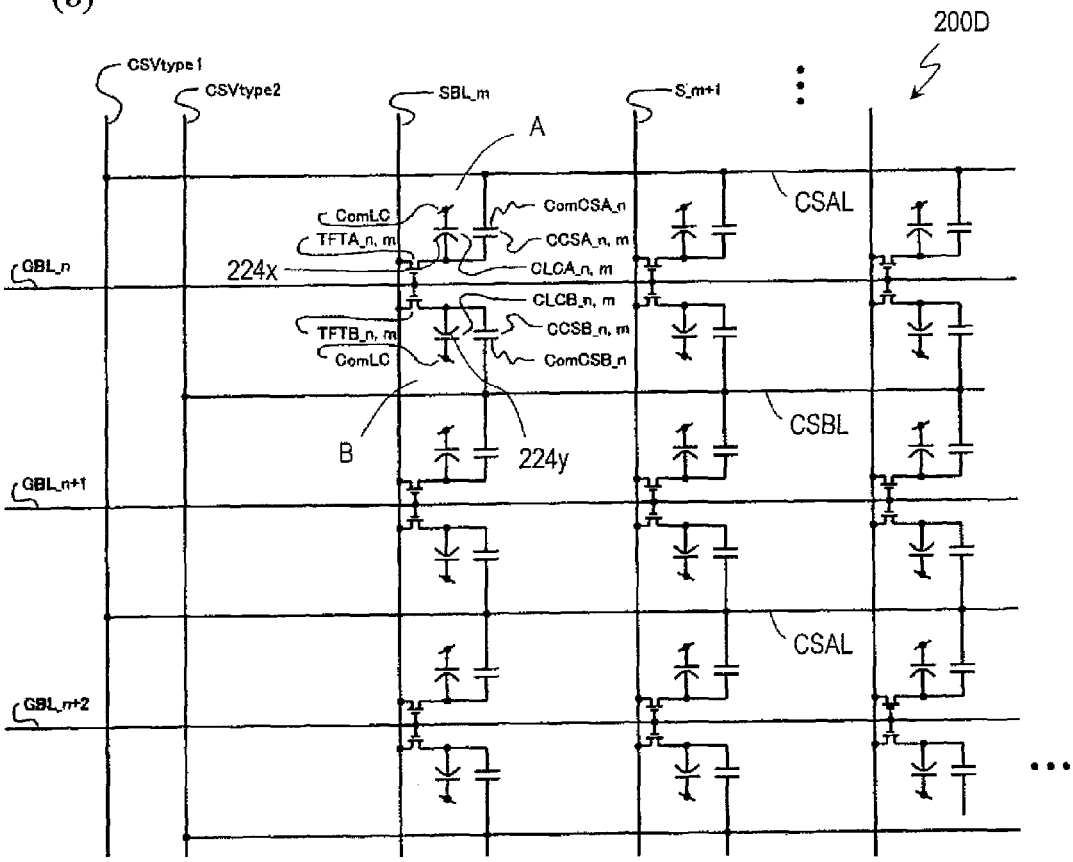

Hereinafter, a fourth preferred embodiment of a liquid crystal display device according to the present invention will be described. As shown in FIG. 36(*a*), the liquid crystal display device 100D of this preferred embodiment includes an LCD panel 200D and a correcting section 300D, which includes a red correcting section 300*r*, a green correcting section 300*g* and a blue correcting section 300*b* for controlling the luminances using, as a unit, two red, green or blue subpixels that are adjacent to each other in the row direction.

FIG. 36(*b*) is an equivalent circuit diagram of a region of the LCD panel 200D. In this LCD panel 200D, subpixels are arranged in columns and rows so as to form a matrix pattern. Each of those subpixels has two regions, of which the luminances may be different from each other. Since the configuration of each subpixel is the same as what has already been described with reference to FIG. 29(*b*), the description thereof will be omitted herein to avoid redundancies.

Now look at the subpixel that is defined by a gate bus line GBL_n representing an $n^{th}$ row and a source bus line SBL_m representing an $m^{th}$ column. Region A of that subpixel includes a liquid crystal capacitor CLCA_n,m and a storage capacitor CCSA_n,m, while region B of that subpixel includes a liquid crystal capacitor CLCB_n,m and a storage capacitor CCSB_n,m. Each liquid crystal capacitor is formed by a divided electrode 224*x* or 224*y*, a counter electrode ComLC, and a liquid crystal layer interposed between them. Each storage capacitor is formed by a storage capacitor electrode, an insulating film, and a storage capacitor counter electrode (ComCSA_n or ComCSB_n). The two divided electrodes 224*x* and 224*y* are connected to a common source bus line SBL_m by way of their associated TFTA_n,m and TFTB_n,m, respectively. The ON/OFF states of TFTA_n,m and TFTB_n,m are controlled with a scan signal voltage supplied to a common gate bus line GBL_n. When the two TFTs are ON, a display signal voltage is applied to the respective divided electrodes 224$x$ and 224$y$ and storage capacitor electrodes of the two regions A and B through a common source bus line. The storage capacitor counter electrode of one of the two regions A and B is connected to a storage capacitor trunk (CS trunk) CSVtype1 by way of a CS bus line CSAL and that of the other region is connected to a storage capacitor trunk (CS trunk) CSVtype2 by way of a CS bus line CSBL.

As shown in FIG. 36(*b*), each CS bus line is also provided for one of the two regions of each subpixel on a different row that is adjacent to the current row in the column direction. Specifically, the CS bus line CSBL is provided for not only respective regions B of the subpixels on the $n^{th}$ row but also respective regions A of the subpixels on the $(n+1)^{th}$ row that is adjacent to the $n^{th}$ row in the column direction.

In this liquid crystal display device 100D, the direction of the electric field applied to the liquid crystal layer of each subpixel inverts at regular time intervals. As for the storage capacitor counter voltages VCSVtype1 and VCSVtype2 supplied to the CS trunks CSVtype1 and CSVtype2, respectively, the first change of the voltage after the voltage on its associated arbitrary gate bus line has fallen from VgH to VgL is "increase" for the voltage VCSVtype1 but "decrease" for the voltage VCSVtype2.

Figure 37:
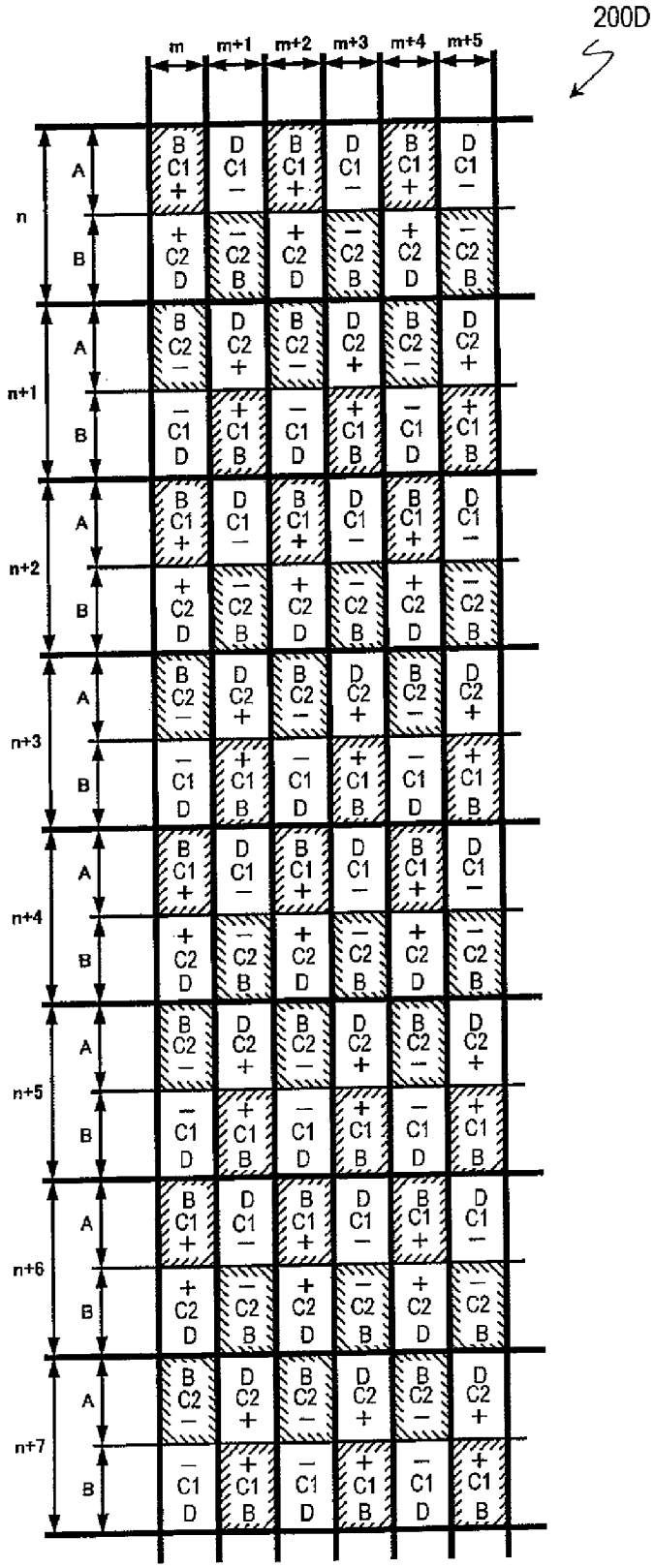
FIG. 37 is a schematic representation showing the respective polarities and brightness levels of the liquid crystal display device shown in FIG. 36.

FIG. 37 is a schematic representation of this LCD panel 200D. In FIG. 37, "B (bright)" and "D (dark)" indicate whether a region of each subpixel is a bright region or a dark region, and "C1" and "C2" indicates whether a region of each subpixel is associated with the CS trunk CSVtype1 or the CS trunk CSVtype2. Also, "+" and "−" indicate that the electric field applied to the liquid crystal layer has two different directions (i.e., two opposite polarities). That is to say, "+" indicates that the potential is higher at the counter electrode than at a subpixel electrode, while "−" indicates that the potential is higher at a subpixel electrode than at the counter electrode.

As can be seen from FIG. 37, when attention is paid to one particular subpixel, one of the two regions thereof is associated with one of the CS trunks CSVtype1 and CSVtype2, while the other region thereof is associated with the other CS trunk CSVtype1 or CSVtype2. Also, look at the arrangement of subpixels, and it can be seen that any two pixels that are adjacent to each other in either the row direction or the column direction have two opposite polarities. That is to say, subpixels of opposite polarities are arranged on a subpixel-by-subpixel basis to form a checkered pattern. Furthermore, look at the respective regions of the subpixels on one row that are associated with the CS trunk CSVtype1, and it can be seen that their brightness and polarity both invert every region. In this manner, the bright and dark regions are also arranged so as to invert their brightness on a region-by-region basis. It should be noted that the state of the LCD panel 200D in one frame is shown in FIG. 37. In the next frame, however, the polarity of each region will be inverted, thereby minimizing the flicker.

Another liquid crystal display device will now be described as Comparative Example 3. The liquid crystal display device of Comparative Example 3 has the same configuration as the liquid crystal display device 100D of this preferred embodiment except that the former device does not include the correcting section 300D.

Figure 38:
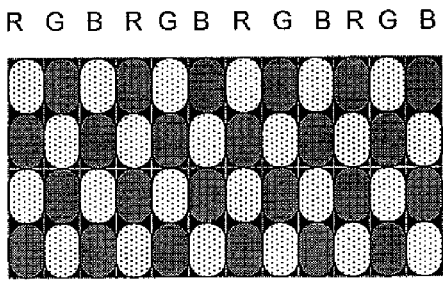
FIG. 38(*a*) is a schematic representation illustrating a liquid crystal display device as Comparative Example 3 and FIG. 38(*b*) is a schematic representation illustrating only blue subpixels of the liquid crystal display device of Comparative Example 3.
Figure 38:
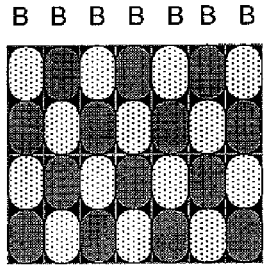

FIG. 38(*a*) is a schematic representation illustrating how the liquid crystal display device of Comparative Example 3 looks when the input signal indicates that every pixel should represent a chromatic color. In this case, each subpixel is in ON state. In the liquid crystal display device of Comparative Example 3, any two regions that are adjacent to each other in the row or column direction have mutually different grayscale levels but each pair of diagonally adjacent regions has the same grayscale level. Also, the polarity is inverted on a subpixel-by-subpixel basis in the row and column directions. FIG. 38(*b*) illustrates only blue subpixels of the liquid crystal display device of Comparative Example 3 for the sake of simplicity. Look at only the blue subpixels of the liquid crystal display device of Comparative Example 3, and it can be seen that any two regions that are adjacent to each other in the row or column direction have different luminance levels (or grayscale levels) and that the bright and dark regions are arranged in a checkered pattern.

Hereinafter, the liquid crystal display device 100D of this fourth preferred embodiment will be described with reference to FIGS. 37, 39, 40 and 41. In the following example, the input signal is supposed to indicate that at least blue subpixels should have the same grayscale level.

Figure 39:
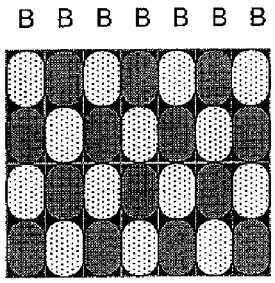
FIG. 39(*a*) is a schematic representation illustrating how the blue subpixels of the liquid crystal display device shown in FIG. 36 look when the hue coefficient Hb is equal to zero, FIG. 39(*b*) is a schematic representation showing how the blue correcting section changes the luminances and polarities, and FIG. 39(*c*) is a schematic representation illustrating blue subpixels that have had their luminances corrected when the hue coefficient Hb is equal to one.
Figure 39:
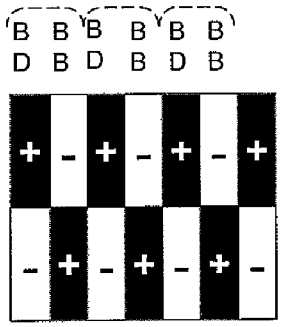
Figure 39:
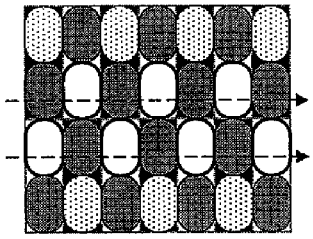

As described above, if the hue coefficient Hb is equal to zero, the blue correcting section 300*b* does not make any correction. Look at only the blue subpixels of the LCD panel 200D in such a situation, and it can be seen that the bright and dark regions of the blue subpixels are arranged in a checkered pattern so that the brightness level inverts on a region-by-region basis as shown in FIG. 39(*a*). Meanwhile, the polarity inverts on a subpixel-by-subpixel basis in both of the row and column directions. It should be noted that the LCD panel 200D shown in FIG. 39(*a*) is the same as the schematic representation of the liquid crystal display device of Comparative Example 3 shown in FIG. 38(*b*).

On the other hand, if the hue coefficient Hb is not zero (e.g., equal to one), then the blue correcting section 300*b* controls the luminances using, as a unit, two blue subpixels belonging to two pixels that are adjacent to each other in the row direction so that bright blue subpixels are diagonally adjacent to each other. In that case, if attention is paid to the brightness levels of those blue subpixels, it can be seen that the bright and dark blue subpixels are arranged in a checkered pattern on a blue subpixel basis. Thus, it can be said that the blue correcting section 300*b* causes the respective blue subpixels to have the bright and dark pattern shown in FIG. 39(*b*). That is why in this LCD panel 200D, the bright and dark regions of bright blue subpixels and those of dark blue subpixels are arranged as shown in FIG. 39(*c*). In this case, in two diagonally adjacent bright blue subpixels, their bright regions are arranged close to each other. And if those bright regions of bright blue subpixels are arranged unevenly in this manner, the display quality may decrease.

In the example just described, the blue correcting section 300*b* is supposed to make a correction so that if the hue coefficient Hb is one, the blue subpixels change their brightness level every subpixel in both of the row and column directions. However, the present invention is in no way limited to that specific preferred embodiment. Alternatively, the blue correcting section 300*b* may also make a correction so that the blue subpixels change their brightness level every other subpixel.

Figure 40:
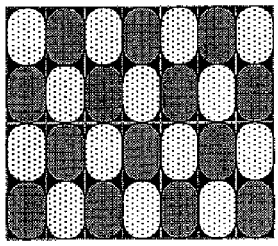
FIG. 40(*a*) is a schematic representation illustrating how the blue subpixels of the liquid crystal display device shown in FIG. 36 look when the hue coefficient Hb is equal to zero, FIG. 40(*b*) is a schematic representation showing how the blue correcting section changes the luminances and polarities, and FIG. 40(*c*) is a schematic representation illustrating blue subpixels that have had their luminances corrected when the hue coefficient Hb is equal to one.
Figure 40:
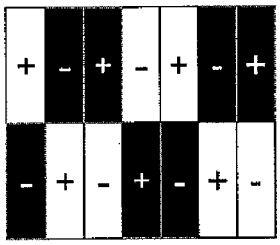
Figure 40:
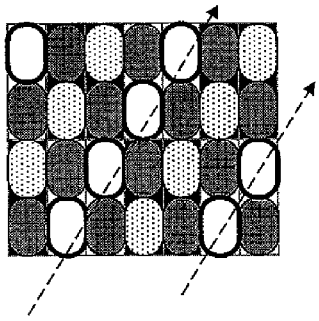

Hereinafter, it will be described with reference to FIG. 40 how the blue correcting section 300*b* makes such a correction. If the hue coefficient Hb is equal to zero, the blue correcting section 300*b* does not make any correction as described above. Look at only the blue subpixels of the LCD panel 200D in such a situation, and it can be seen that the bright and dark regions of the blue subpixels are arranged in a checkered pattern so that the brightness level inverts on a region-by-region basis as shown in FIG. 40(*a*).

On the other hand, if the hue coefficient Hb is equal to one, then the blue correcting section 300*b* makes a correction using, as a unit, two blue subpixels belonging to two pixels that are adjacent to each other in the row direction so that the blue subpixels change their brightness level every other subpixel in the row direction (i.e., two bright blue subpixels alternate with two dark subpixels every two subpixels in the row direction). Thus, it can be said that the blue correcting section 300*b* causes the respective blue subpixels to have the bright and dark pattern shown in FIG. 40(*b*). In that case, the blue subpixels with "+" and "−" polarities include not only bright blue subpixels but also dark blue subpixels as well. That is why the unevenness of polarities and brightness levels can be reduced and the flicker can be minimized. Also, as a result of the correction made by the blue correcting section 300*b*, in this LCD panel 200D, the bright and dark regions of bright blue subpixels and those of dark blue subpixels are arranged as shown in FIG. 40(*c*). In this case, the respective bright regions of bright blue subpixels are arranged in line so as to be diagonally adjacent to each other. And if those bright regions of bright blue subpixels are arranged unevenly in this manner, the display quality may decrease.

In the example described above, the blue correcting section 300*b* is supposed to make a correction so that if the hue coefficient Hb is equal to one, each blue subpixel becomes either a bright blue subpixel or a dark blue subpixel. However, this is only an example of the present invention. Even if the hue coefficient Hb is equal to one, the blue correcting section 300*b* may also make a correction so that a portion of a blue subpixel becomes darker than a bright blue subpixel and brighter than a dark blue subpixel. Such a portion that is darker than a bright blue subpixel and brighter than a dark blue subpixel will be referred to herein as a "moderate blue subpixel".

Hereinafter, it will be described with reference to FIG. 41 how the blue correcting section 300*b* makes such a correction. If the hue coefficient Hb is equal to zero, the blue correcting section 300*b* does not make any correction as described above. Look at only the blue subpixels of the LCD panel 200D in such a situation, and it can be seen that the bright and dark regions of the blue subpixels are arranged in a checkered pattern so that the brightness level inverts on a region-by-region basis as shown in FIG. 41(*a*).

On the other hand, if the hue coefficient Hb is equal to one, then the blue correcting section 300*b* makes a correction using, as a unit, two blue subpixels that interpose another blue subpixel. In FIG. 41(*b*), four blue subpixels that are arranged in the row direction are identified by B1, B2, B3 and B4, respectively. The blue correcting section 300*b* controls luminances using the two blue subpixels B1 and B3 as a unit but does not make any correction on the other blue subpixels B2 and B4. In that case, if attention is paid to the brightness levels of those blue subpixels that are arranged in the row direction, it can be seen that bright and dark blue subpixels are arranged alternately with a moderate blue subpixel interposed between them. Thus, it can be said that the blue correcting section 300*b* causes the respective blue subpixels to have the bright and dark pattern shown in FIG. 41(*b*). That is why in this LCD panel 200D, the bright and dark regions of bright, moderate and dark blue subpixels are arranged as shown in FIG. 41(*c*). If attention is paid to the brightness levels of a row of subpixels, a bright blue subpixel, a moderate blue subpixel, a dark blue subpixel and a moderate blue subpixel are arranged in this order. By having the blue correcting section 300*b* make such a correction, it is possible to prevent the bright regions of bright blue subpixels from being arranged unevenly and a decrease in display quality can be minimized.

Figure 41:
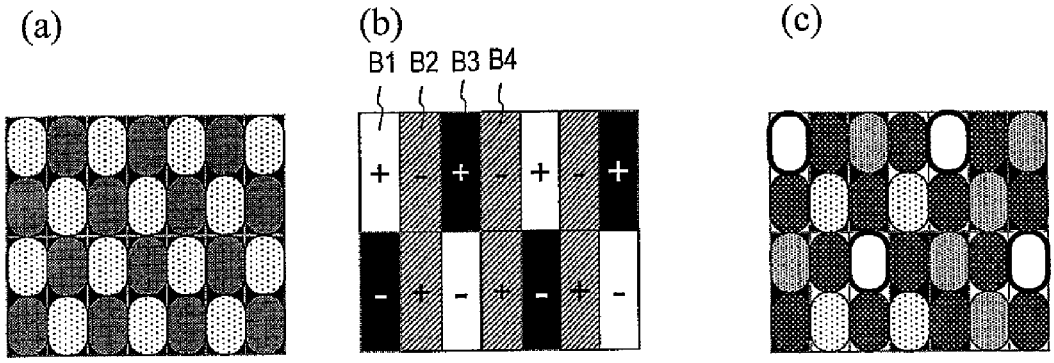
FIG. 41(*a*) is a schematic representation illustrating how the blue subpixels of the liquid crystal display device shown in FIG. 36 look when the hue coefficient Hb is equal to zero, FIG. 41(*b*) is a schematic representation showing how the blue correcting section changes the luminances and polarities, and FIG. 41(*c*) is a schematic representation illustrating blue subpixels that have had their luminances corrected when the hue coefficient Hb is equal to one.
Figure 42:
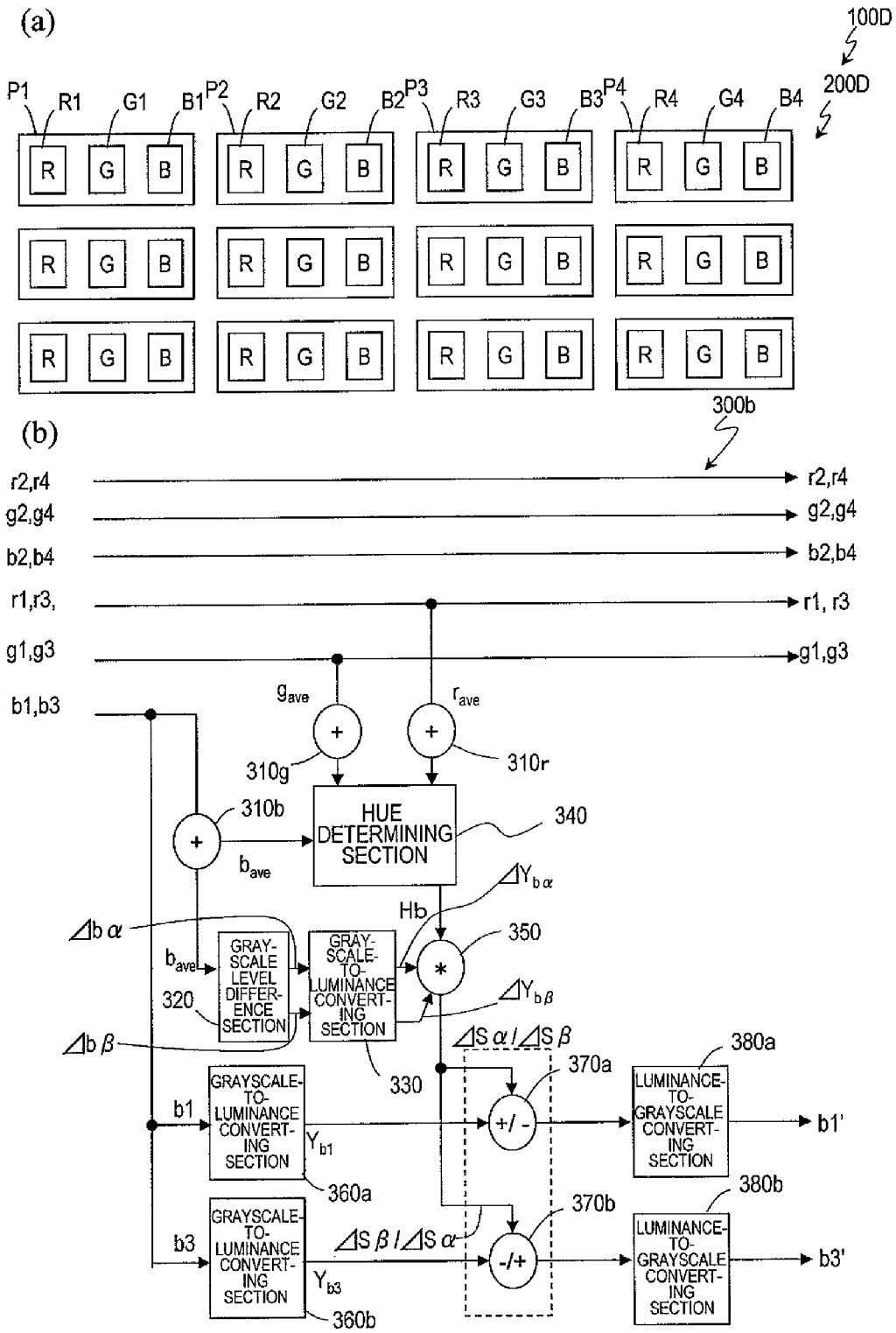
FIG. 42(*a*) is a schematic representation illustrating an LCD panel that is designed to make the correction shown in FIG. 41 for the liquid crystal display device and FIG. 42(*b*) is a schematic representation illustrating a configuration for its blue correcting section.

Hereinafter, the liquid crystal display device 100D that makes a correction as shown in FIG. 41 will be described. FIG. 42(*a*) is a schematic representation illustrating the LCD panel 200D of this liquid crystal display device 100D. As described above, in the LCD panel 200D, each subpixel has multiple regions that may have mutually different luminances. However, illustration of those regions is omitted in FIG. 42(*a*). Also, shown in FIG. 42 are red, green and blue subpixels R1, G1 and B1 belonging to a pixel P1, red, green and blue subpixels R2, G2 and B2 belonging to a pixel P2, red, green and blue subpixels R3, G3 and B3 belonging to a pixel P3, and red, green and blue subpixels R4, G4 and B4 belonging to a pixel P4.

FIG. 42(*b*) is a schematic representation illustrating a blue correcting section 300*b*. In FIG. 42(*b*), the grayscale levels r1, g1 and b1 are indicated by the input signal for the subpixels R1, G1 and B1, respectively, which belong to the pixel P1 as shown in FIG. 42(*a*). The grayscale levels r2, g2 and b2 are indicated by the input signal for the subpixels R2, G2 and B2, respectively, which belong to the pixel P2. Also, the grayscale levels r3, g3 and b3 are indicated by the input signal for the subpixels R3, G3 and B3, respectively, which belong to the pixel P3 as shown in FIG. 42(*a*). And the grayscale levels r4, g4 and b4 are indicated by the input signal for the subpixels R4, G4 and B4, respectively, which belong to the pixel P4.

In the blue correcting section 300*b*, the average grayscale level $b_{ave}$ of the grayscale levels b1 and b3 is calculated by using an adding section 310*b*. Next, a grayscale level difference section 320 calculates two grayscale level differences $\Delta b\alpha$ and $\Delta b\beta$ with respect to the single average grayscale level $b_{ave}$. Next, a grayscale-to-luminance converting section 330 converts the grayscale level differences $\Delta b\alpha$ and $\Delta b\beta$ into luminance level differences $\Delta Y_b\alpha$ and $\Delta Y_b\beta$, respectively.

Meanwhile, the average grayscale level $r_{ave}$ of the grayscale levels r1 and r3 is calculated by using an adding section 310*r*. And the average grayscale level $g_{ave}$ of the grayscale levels g1 and g3 is calculated by using an adding section 310*g*. Then, a hue determining section 340 calculates a hue coefficient Hb based on these average grayscale levels $r_{ave}$, $g_{ave}$ and $b_{ave}$.

Next, the magnitudes of shift $\Delta S\alpha$ and $\Delta S\beta$ are calculated. In this case, the magnitude of shift $\Delta S\alpha$ is obtained as the product of $\Delta Y_b\alpha$ and the hue coefficient Hb, while the magnitude of shift $\Delta S\beta$ is obtained as the product of $\Delta Y_b\beta$ and the hue coefficient Hb. A multiplying section 350 multiplies the luminance level differences $\Delta Y_b\alpha$ and $\Delta Y_b\beta$ by the hue coefficient Hb, thereby obtaining the magnitudes of shift $\Delta S\alpha$ and $\Delta S\beta$.

Meanwhile, a grayscale-to-luminance converting section 360*a* carries out a grayscale-to-luminance conversion on the grayscale level b1, thereby obtaining a luminance level $Y_{b1}$. In the same way, another grayscale-to-luminance converting section 360*b* carries out a grayscale-to-luminance conversion on the grayscale level b3, thereby obtaining a luminance level $Y_{b3}$. Next, an adding and subtracting section 370*a* adds the luminance level $Y_{b1}$ and the magnitude of shift $\Delta S\alpha$ together, and then the sum is subjected to luminance-to-grayscale conversion by a luminance-to-grayscale converting section 380*a*, thereby obtaining a grayscale level b1'. On the other hand, another adding and subtracting section 370*b* subtracts the magnitude of shift $\Delta S\beta$ from the luminance level $Y_{b3}$, and then the remainder is subjected to luminance-to-grayscale conversion by another luminance-to-grayscale converting section 380*b*, thereby obtaining a grayscale level b3'. No correction is made on the grayscale levels r1 to r4, g1 to g4, b2, and b4. By having the blue correcting section 300*b* make such a correction, it is possible to prevent the bright regions of bright blue subpixels from being arranged unevenly and a decrease in display quality can be minimized.

Figure 43:
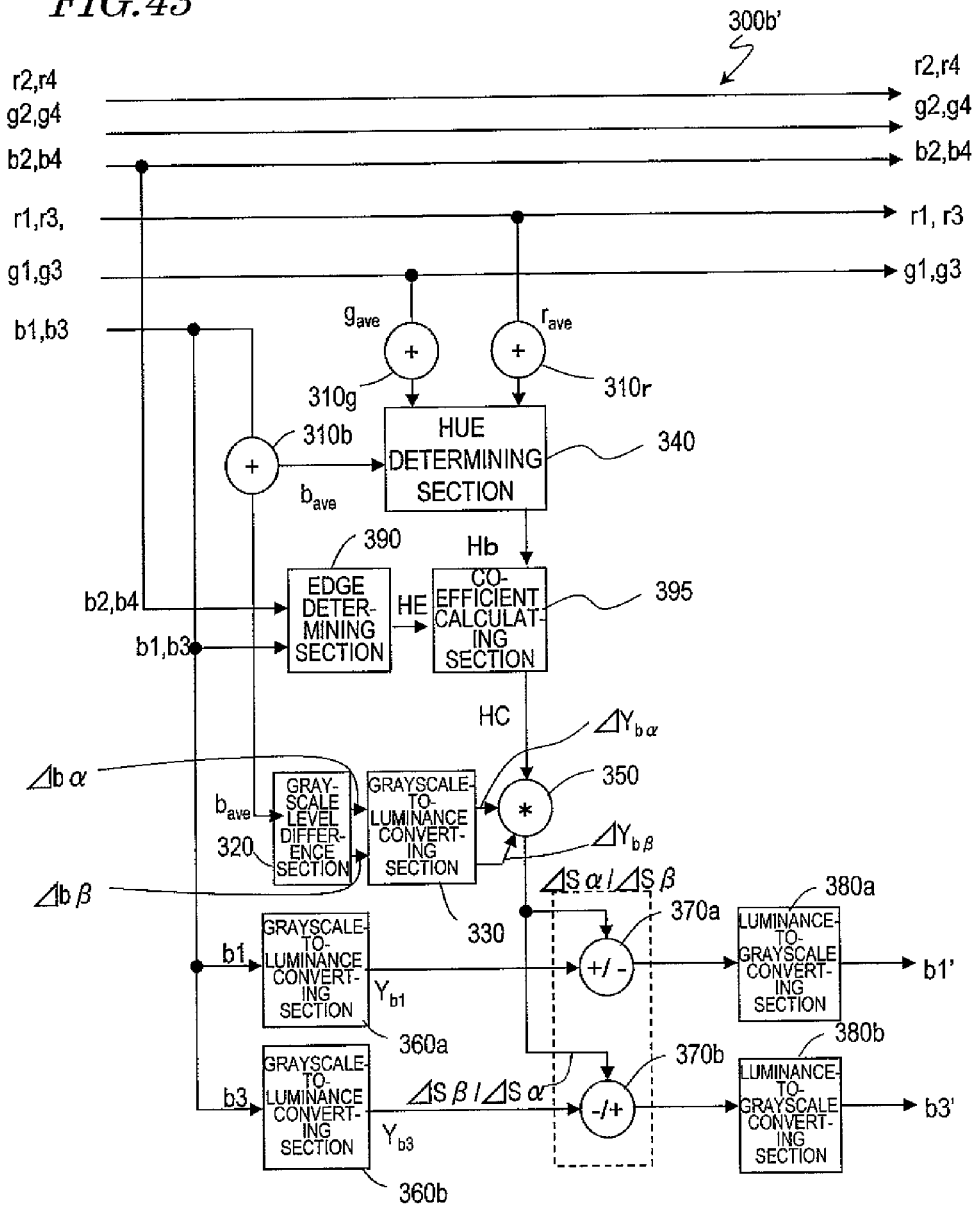
FIG. 43 is a schematic representation illustrating a configuration for the blue correcting section of a liquid crystal display device as a modified example of the fourth preferred embodiment of the present invention.

It is preferred that edge processing be further performed. FIG. 43 is a schematic representation illustrating an alternative correcting section 300*b*', which has the same configuration as the blue correcting section 300*b* except that this correcting section 300*b*' further includes the edge determining section 390 and coefficient calculating section 395 that have already been described with reference to FIG. 18. Thus, description of their common features will be omitted herein to avoid redundancies.

The edge determining section 390 obtains an edge coefficient HE based on the grayscale levels b1 to b4 indicated by the input signal. In this case, the edge coefficient is a function that increases as the difference between the grayscale levels b1 to b4 increases. And the edge coefficient HE may be represented as HE=(MAX (b1, b2, b3, b4)−MIN (b1, b2, b3, b4))/MAX (b1, b2, b3, b4), for example. However, the edge coefficient HE may also be obtained by any other method and may be calculated based on only the grayscale levels b1 and b3.

Next, the coefficient calculating section 395 calculates a correction coefficient HC based on the hue coefficient Hb that has been obtained by the hue determining section 340 and the edge coefficient HE that has been obtained by the edge determining section 390. The correction coefficient HC may be represented as HC=Hb−HE, for example. The grayscale levels b1 and b3 are corrected just as described above using this correction coefficient HC. The edge processing may be performed in this manner.

Embodiment 5

In the preferred embodiments described above, the luminances are supposed to be controlled by using, as a unit, two blue subpixels belonging to two pixels that are arranged in the row direction. However, the present invention is in no way limited to those specific preferred embodiments. Alternatively, the luminances may also be controlled by using, as a unit, two blue subpixels belonging to two pixels that are arranged in the column direction.

Hereinafter, a fifth specific preferred embodiment of a liquid crystal display device according to the present invention will be described with reference to FIG. 44. Specifically, FIG. 44(*a*) is a schematic representation illustrating a liquid crystal display device 100E according to this preferred embodiment. This liquid crystal display device 100E includes an LCD panel 200E and a correcting section 300E, which includes red, green and blue correcting sections 300*r*", 300*g*" and 300*b*".

Figure 44:
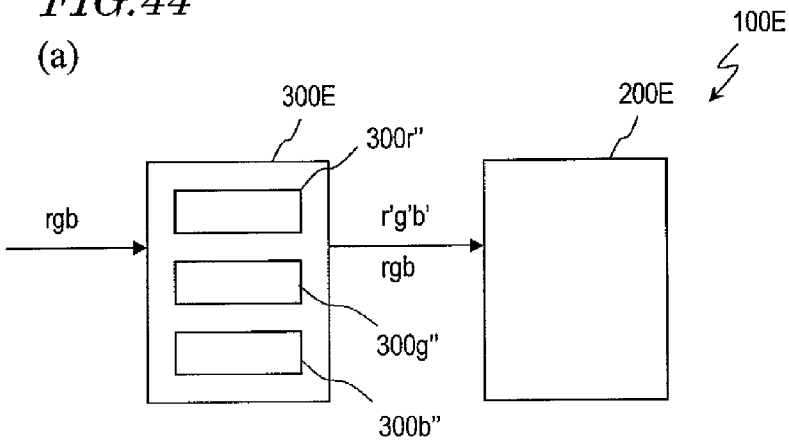
FIG. 44(*a*) is a schematic representation illustrating a liquid crystal display device as a fifth preferred embodiment of the present invention and FIG. 44(*b*) is a schematic representation illustrating its LCD panel.
Figure 44:
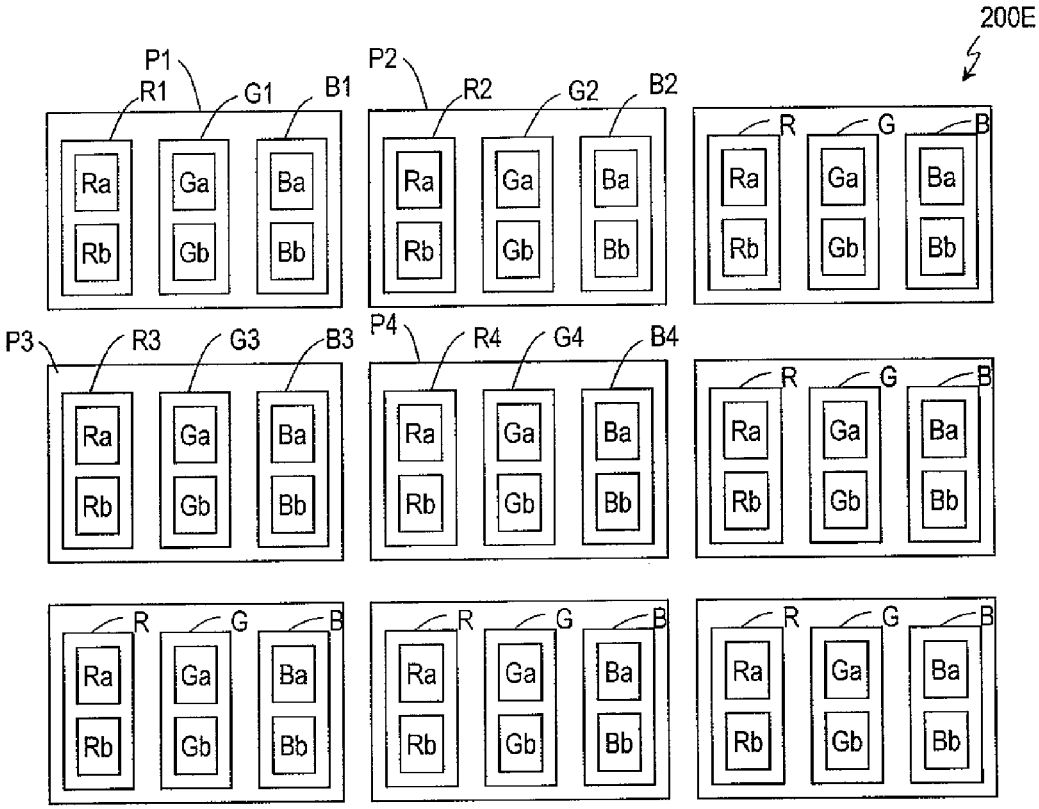

FIG. 44(*b*) is a schematic representation illustrating the LCD panel 200E, in which each subpixel has multiple regions that may have mutually different luminances. A pixel P3 consisting of red, green and blue subpixels R3, G3 and B3 is arranged adjacent in the column direction to a pixel P1 consisting of red, green and blue subpixels R1, G1 and B1. Likewise, a pixel P4 consisting of red, green and blue subpixels R4, G4 and B4 is arranged adjacent in the column direction to a pixel P2 consisting of red, green and blue subpixels R2, G2 and B2.

Even in a situation where the blue correcting section 300*b*" controls the luminances by using, as a unit, two blue subpixels belonging to two pixels that are adjacent to each other in the column direction, if the blue correcting section 300*b*" gives the bright and dark pattern shown in FIG. 39(*b*) to the blue subpixels, then the bright regions of the bright blue subpixels will be arranged unevenly as shown in FIG. 39(*c*). That is why it is preferred that the blue correcting section 300*b*" give the bright and dark pattern shown in FIG. 41(*b*) to the blue subpixels.

Figure 45:
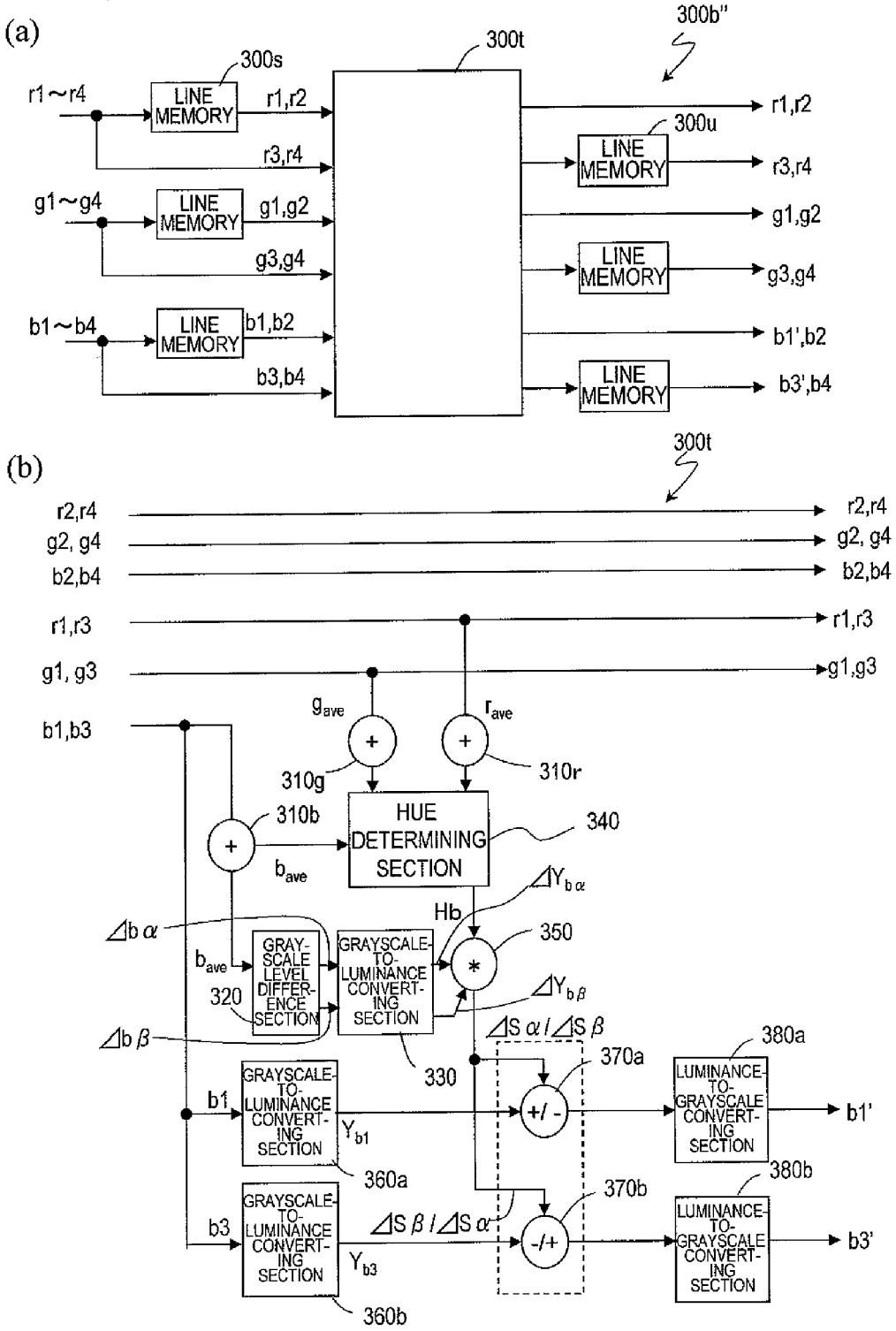
FIG. 45(*a*) is a schematic representation illustrating a configuration for the blue correcting section shown in FIG. 44 and FIG. 45(*b*) is a schematic representation illustrating its grayscale control section.

Hereinafter, the blue correcting section 300*b*" of the liquid crystal display device 100E of this preferred embodiment will be described with reference to FIG. 45. As shown in FIG. 45(*a*), the blue correcting section 300*b*" includes first-stage line memories 300*s*, a grayscale control section 300*t*, and second-stage line memories 300*u*. The grayscale levels r1, g1 and b1 are indicated by the input signal for the subpixels R1, G1 and B1, respectively, which belong to the pixel P1 as shown in FIG. 44(*b*). The grayscale levels r2, g2 and b2 are indicated by the input signal for the subpixels R2, G2 and B2, respectively, which belong to the pixel P2. Also, the grayscale levels r3, g3 and b3 are indicated by the input signal for the subpixels R3, G3 and B3, respectively, which belong to the pixel P3 as shown in FIG. 44(*b*). And the grayscale levels r4, g4 and b4 are indicated by the input signal for the subpixels R4, G4 and B4, respectively, which belong to the pixel P4. The first-stage line memories 300*s* delay the input of the grayscale levels r1, g1, b1, r2, g2 and b2 to the grayscale control section 300*t* by one line.

FIG. 45(*b*) is a schematic representation illustrating the grayscale control section 300*t*. In the grayscale control section 300*t*, the average grayscale level $b_{ave}$ of the grayscale levels b1 and b3 is calculated by using an adding section 310*b*. Next, a grayscale level difference section 320 calculates two grayscale level differences $\Delta b\alpha$ and $\Delta b\beta$ with respect to the single average grayscale level $b_{ave}$. Next, a grayscale-to-luminance converting section 330 converts the grayscale level differences $\Delta b\alpha$ and $\Delta b\beta$ into luminance level differences $\Delta Y_b\alpha$ and $\Delta b\beta$ respectively.

Meanwhile, the average grayscale level $r_{ave}$ of the grayscale levels r1 and r3 is calculated by using an adding section 310*r*. And the average grayscale level $g_{ave}$ of the grayscale levels g1 and g3 is calculated by using an adding section 310*g*. Then, a hue determining section 340 calculates a hue coefficient Hb based on these average grayscale levels $r_{ave}$, $g_{ave}$ and $b_{ave}$.

Next, a multiplying section 350 multiplies the luminance level differences $\Delta Y_b\alpha$ and $\Delta Y_b\beta$ by the hue coefficient Hb, thereby obtaining the magnitudes of shift $\Delta S\alpha$ and $\Delta S\beta$. Meanwhile, a grayscale-to-luminance converting section 360*a* carries out a grayscale-to-luminance conversion on the grayscale level b1, thereby obtaining a luminance level $Y_{b1}$. In the same way, another grayscale-to-luminance converting section 360*b* carries out a grayscale-to-luminance conversion on the grayscale level b3, thereby obtaining a luminance level $Y_{b3}$. Next, an adding and subtracting section 370*a* adds the luminance level $Y_{b1}$ and the magnitude of shift $\Delta S\alpha$ together, and then the sum is subjected to luminance-to-grayscale conversion by a luminance-to-grayscale converting section 380*a*, thereby obtaining a grayscale level b1'. On the other hand, another adding and subtracting section 370*b* subtracts the magnitude of shift $\Delta S\beta$ from the luminance level $Y_{b3}$, and then the remainder is subjected to luminance-to-grayscale conversion by another luminance-to-grayscale converting section 380*b*, thereby obtaining a grayscale level b3'. By having the blue correcting section 300*b*" make such a correction, it is possible to prevent the bright regions of bright blue subpixels from being arranged unevenly and a decrease in display quality can be minimized.

Figure 46:
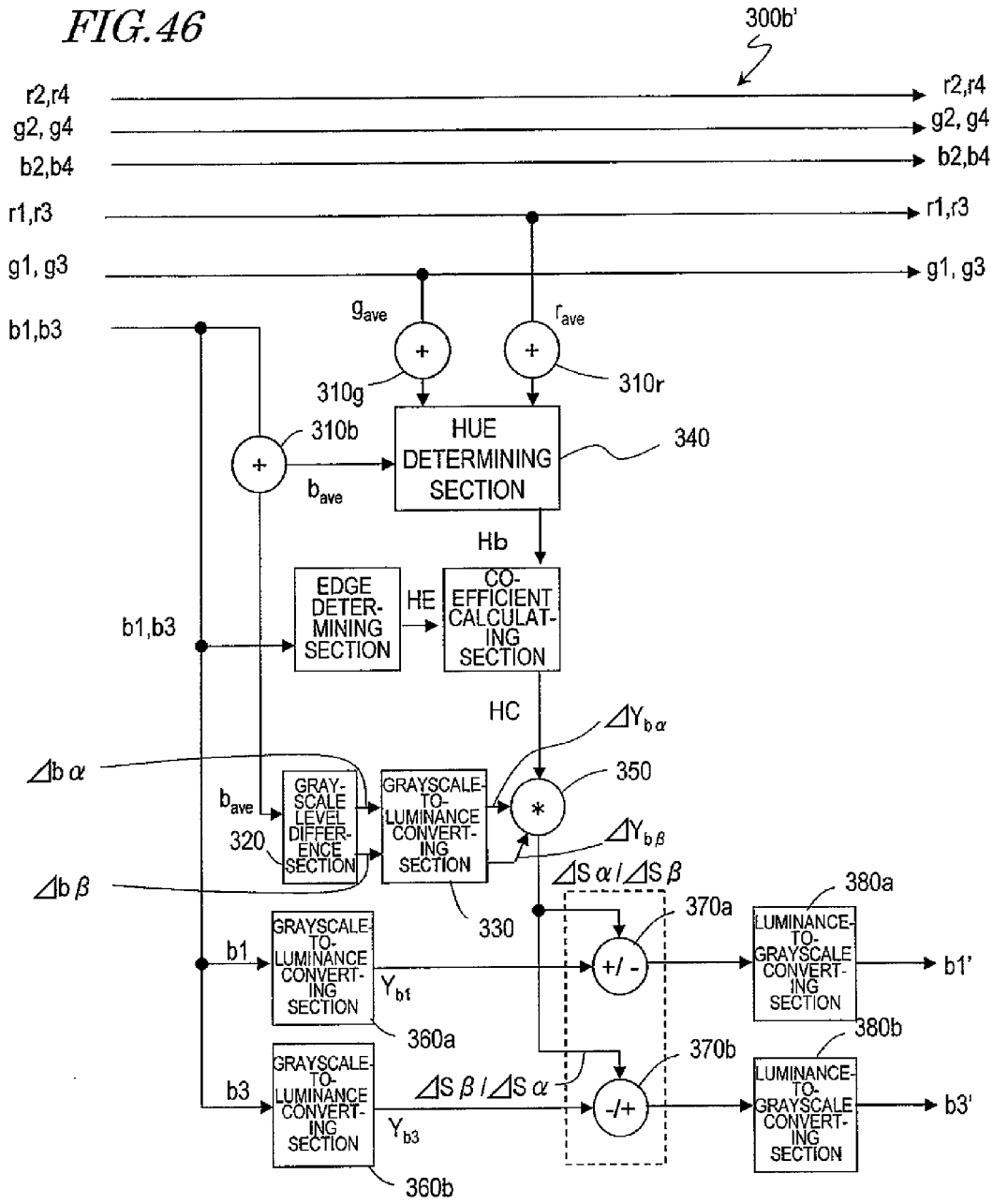
FIG. 46 is a schematic representation illustrating a configuration for the blue correcting section of a liquid crystal display device as a modified example of the fifth preferred embodiment of the present invention.

It is preferred that edge processing be further performed. FIG. 46 is a schematic representation illustrating an alternative blue correcting section 300*b*', which has the same configuration as the blue correcting section 300*b*" shown in FIG. 45 except that this correcting section 300*b*' further includes the edge determining section 390 and coefficient calculating section 395 that have already been described with reference to FIG. 18. Thus, description of their common features will be omitted herein to avoid redundancies.

The edge determining section 390 obtains an edge coefficient HE based on the grayscale levels b1 to b3 indicated by the input signal. In this case, the edge coefficient HE may be represented as HE=(MAX (b1, b3)−MIN (b1, b3))/MAX (b1, b3), for example. However, the edge coefficient HE may also be obtained by any other method.

Next, the coefficient calculating section 395 calculates a correction coefficient HC based on the hue coefficient Hb that has been obtained by the hue determining section 340 and the edge coefficient HE that has been obtained by the edge determining section 390. The correction coefficient HC may be represented as HC=Hb−HE, for example. The grayscale levels b1 and b3 are corrected just as described above using this correction coefficient HC. The edge processing may be performed in this manner.

Embodiment 6

In the first through fifth preferred embodiments of the present invention described above, a display operation is supposed to be performed using three primary colors per pixel. However, the present invention is in no way limited to those specific preferred embodiments. Alternatively, a display operation may also be performed using four or more primary colors per pixel. For example, each pixel may include red, green, blue, yellow, cyan and magenta subpixels.

Figure 47:
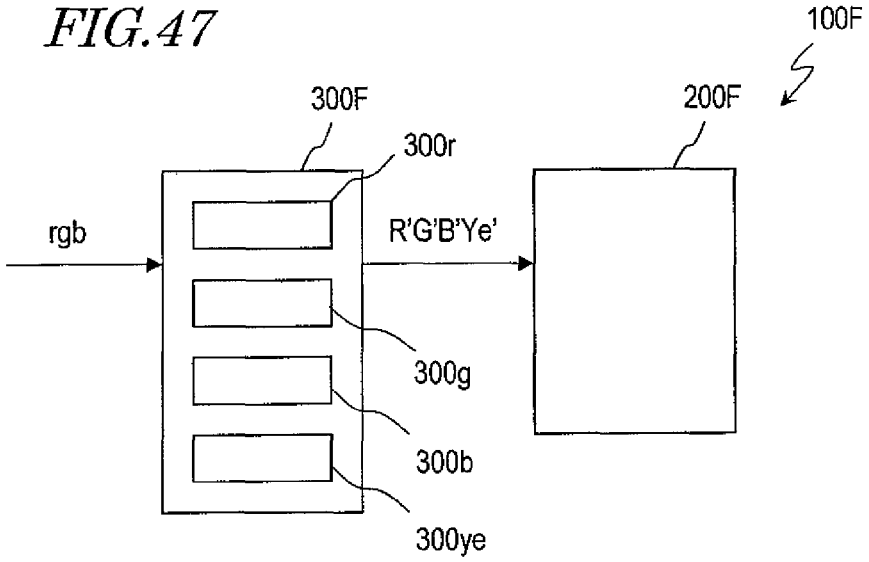
FIG. 47 is a schematic representation illustrating a liquid crystal display device as a sixth preferred embodiment of the present invention.

FIG. 47 is a schematic representation illustrating a liquid crystal display device as a sixth preferred embodiment of the present invention. The liquid crystal display device 100F of this preferred embodiment includes a multi-primary-color display panel 200F and a correcting section 300F. In the multi-primary-color display panel 200F, each pixel includes red (R), green (G), blue (B), and yellow (Ye) subpixels. The correcting section 300F includes red, green, blue and yellow correcting sections 300*r*, 300*g*, 300*b* and 300*ye* for controlling the luminances using two red, green, blue or yellow subpixels as a unit.

Figure 48:
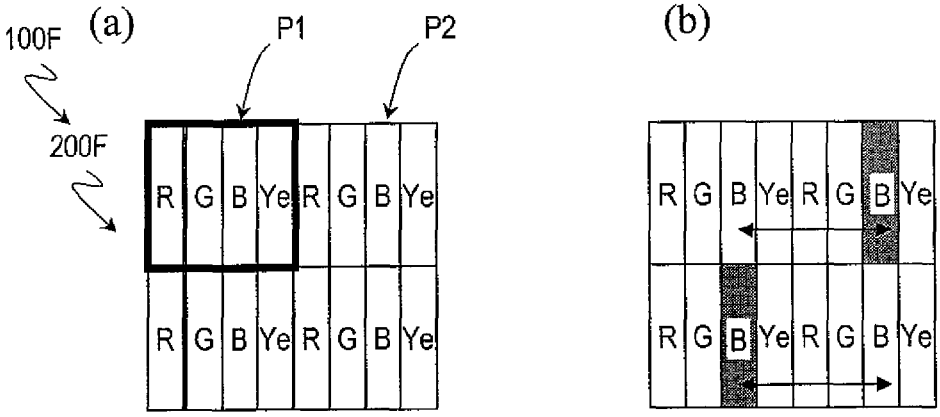
FIG. 48(*a*) is a schematic representation illustrating how subpixels may be arranged in the multi-primary-color display panel of the liquid crystal display device shown in FIG. 47 and FIG. 48(*b*) is a schematic representation illustrating where blue subpixels, of which the luminances need to be controlled, are located with respect to bright blue subpixels.

FIG. 48(*a*) is a schematic representation illustrating the multi-primary-color display panel 200F of this liquid crystal display device 100F. In the multi-primary-color display panel 200F, each pixel includes red (R), green (G), blue (B), and yellow (Ye) subpixels, which are arranged in this order in the row direction. In the column direction, on the other hand, subpixels representing the same color are arranged.

Figure 49:
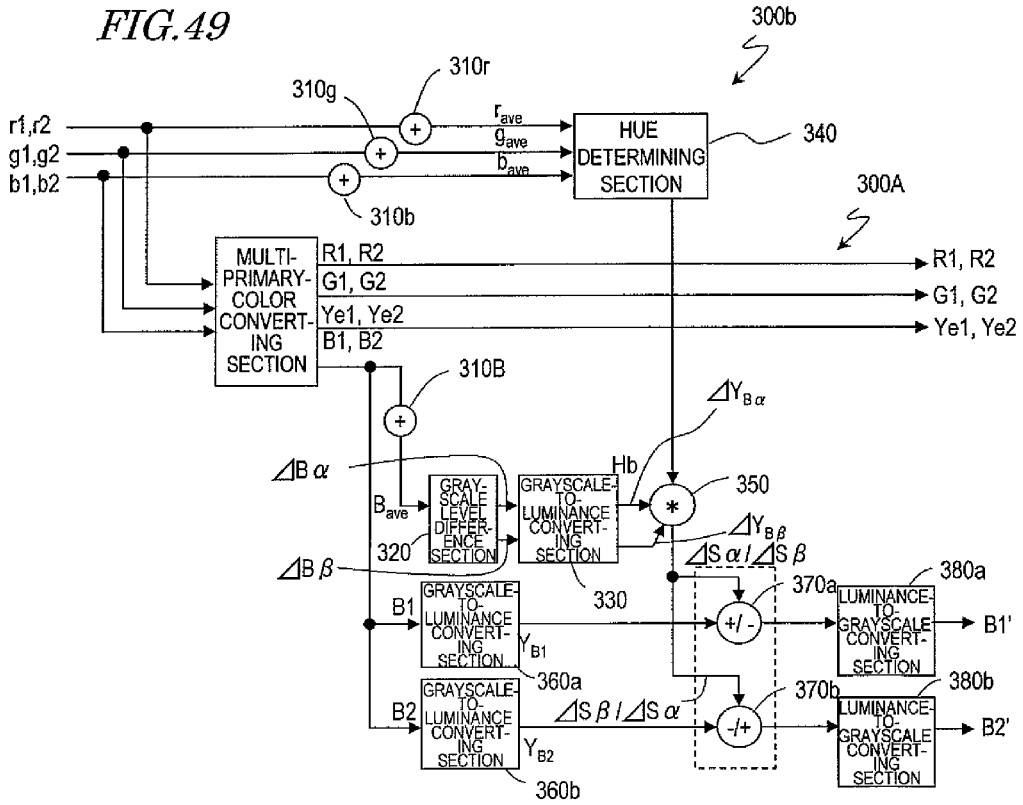
FIG. 49 is a schematic representation illustrating a configuration for the blue correcting section of the liquid crystal display device shown in FIG. 47.

Hereinafter, the blue correcting section 300*b* will be described with reference to FIG. 49. The red, green and yellow correcting sections 300*r*, 300*g* and 300*ye* for making corrections on the grayscale levels R1 and R2, G1 and G2, and Ye1 and Ye2 that have been subjected to multi-primary-color conversion have the same configuration as the blue correcting section 300*b*, and a detailed description thereof will be omitted herein.

The blue correcting section 300*b* has the same configuration as its counterpart that has already been described with reference to FIG. 8 except that the blue correcting section 300*b* further includes a multi-primary-color converting section 400. And description of their common features will be omitted herein to avoid redundancies. The multi-primary-color converting section 400 obtains grayscale levels R1, G1, B1, and Ye1 for the respective subpixels of each pixel in the LCD panel 200F based on the grayscale levels r1, g1 and b1 of the input signal, and also obtains grayscale levels R2, G2, B2, and Ye2 for the respective subpixels of each pixel in the LCD panel 200F based on the grayscale levels r2, g2 and b2 of the input signal. The grayscale levels R1, G1, B1 and Ye1 are indicated for the respective subpixels belonging to the pixel P1 shown in FIG. 48(*a*). On the other hand, the grayscale levels R2, G2, B2 and Ye2 are indicated for the respective subpixels belonging to the pixel P2.

The average of the grayscale levels B1 and B2 is calculated by using an adding section 310B. In the following description, the average of the grayscale levels B1 and B2 will be referred to herein as an average grayscale level $B_{ave}$. Next, a grayscale level difference section 320 calculates two grayscale level differences $\Delta B\alpha$ and $\Delta B\beta$ with respect to the single average grayscale level $B_{ave}$. The grayscale level differences $\Delta B\alpha$ and $\Delta B\beta$ are associated with a bright blue subpixel and a dark blue subpixel, respectively. Next, a grayscale-to-luminance converting section 330 converts the grayscale level differences $\Delta B\alpha$ and $\Delta B\beta$ into luminance level differences $\Delta Y_B\alpha$ and $\Delta Y_B\beta$, respectively.

Meanwhile, the averages of the three pairs of grayscale levels r1 and r2, g1 and g2, and b1 and b2 are calculated by adding sections 310*r*, 310*g* and 310*b*, respectively. In the following description, those averages of the three pairs of grayscale levels r1 and r2, g1 and g2, and b1 and b2 will be referred to herein as average grayscale levels $r_{ave}$, $g_{ave}$, and $b_{ave}$, respectively.

The hue determining section 340 determines the hue of the color to be represented by a pixel in accordance with the input signal. Specifically, the hue determining section 340 obtains a hue coefficient Hb by using average grayscale levels $r_{ave}$, $g_{ave}$ and $b_{ave}$. The hue coefficient Hb is a function that varies according to the hue.

Alternatively, the hue determining section 340 may also obtain the hue coefficient Hb based on the average grayscale levels $R_{ave}$, $G_{ave}$, $B_{ave}$ and $Ye_{ave}$. In that case, since $R_{ave}$, $G_{ave}$, $B_{ave}$ and $Ye_{ave}$ correspond to the average grayscale levels that have been obtained based on the grayscale levels indicated by the input signal, correction on the blue subpixel is made indirectly according to the hue of the color to be represented by a pixel in accordance with the input signal. Nevertheless, as the hue can be determined sufficiently accurately by using the average grayscale levels $r_{ave}$, $g_{ave}$ and $b_{ave}$, the complexity of processing can be minimized.

Next, the magnitudes of shift $\Delta S\alpha$ and $\Delta S\beta$ are calculated. In this case, the magnitude of shift $\Delta S\alpha$ is obtained as the product of $\Delta Y_B\alpha$ and the hue coefficient Hb, while the magnitude of shift $\Delta S\beta$ is obtained as the product of $\Delta Y_B\beta$ and the hue coefficient Hb. A multiplying section 350 multiplies the luminance level differences $\Delta Y_B\alpha$ and $\Delta Y_B\beta$ by the hue coefficient Hb, thereby obtaining the magnitudes of shift $\Delta S\alpha$ and $\Delta S\beta$.

Meanwhile, a grayscale-to-luminance converting section 360*a* carries out a grayscale-to-luminance conversion on the grayscale level B1, thereby obtaining a luminance level $Y_{B1}$, which can be calculated by the following equation:

$$Y_{B1}=B1^{2.2}(\text{where } 0\leq B1\leq 1)$$

In the same way, another grayscale-to-luminance converting section 360*b* carries out a grayscale-to-luminance conversion on the grayscale level B2, thereby obtaining a luminance level $Y_{B2}$.

Next, an adding and subtracting section 370*a* adds the luminance level $Y_{B1}$ and the magnitude of shift $\Delta S\alpha$ together, and then the sum is subjected to luminance-to-grayscale conversion by a luminance-to-grayscale converting section 380*a*, thereby obtaining a grayscale level B1'. On the other hand, another adding and subtracting section 370*b* subtracts the magnitude of shift $\Delta S\beta$ from the luminance level $Y_{B2}$, and then the remainder is subjected to luminance-to-grayscale conversion by another luminance-to-grayscale converting section 380*b*, thereby obtaining a grayscale level B2'.

As described above, in this liquid crystal display device 100F, the luminances are controlled by using, as a unit, two blue subpixels belonging to two pixels that are adjacent to each other in the column direction. In FIG. 48(*b*), those pairs of blue subpixels, of which the luminances need to be controlled, are indicated by the arrows. Strictly speaking, the luminances of red, green, and yellow subpixels may also be controlled. However, only two blue subpixels, of which the luminances need to be controlled, are described herein to avoid redundancies. In FIG. 48(*b*), the non-shadowed blue subpixels are bright blue subpixels and the shadowed ones are dark blue subpixels.

In the multi-primary-color display panel 200F shown in FIG. 48, subpixels to represent the same color are arranged in the column direction. However, the present invention is in no way limited to that specific preferred embodiment. Alternatively, subpixels representing mutually different colors may also be arranged in the column direction. In that case, using two blue subpixels belonging to two pixels that are adjacent to each other in the column direction as a unit, the luminances may be controlled so that bright blue subpixels are arranged in the row direction. Consequently, it is possible to prevent the bright blue subpixels from being arranged unevenly and a substantial decrease in the resolution of the color blue can be minimized.

Also, in the multi-primary-color display panel 200F shown in FIG. 48, subpixels belonging to a single pixel are arranged in a row. However, this is just an example of the present invention. Alternatively, subpixels belonging to a single pixel may also be arranged in multiple rows.

Figure 50:
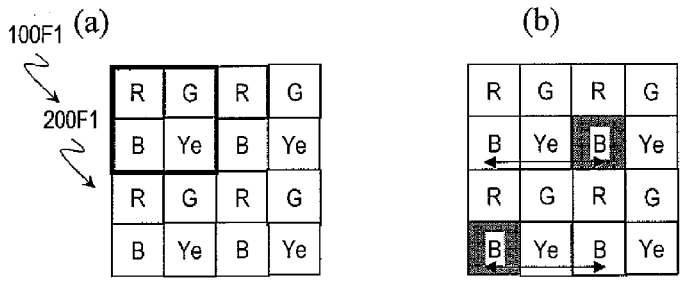
FIG. 50(*a*) is a schematic representation illustrating how subpixels may be arranged in the multi-primary-color display panel of a liquid crystal display device as a modified example of the sixth preferred embodiment and FIG. 50(*b*) is a schematic representation illustrating where blue subpixels, of which the luminances need to be controlled, are located with respect to bright blue subpixels.

FIG. 50(*a*) is a schematic representation illustrating a multi-primary-color display panel 200F1 for a liquid crystal display device 100F1. In this multi-primary-color display panel 200F1, subpixels included in a single pixel are arranged in two columns and two rows. Specifically, red and green subpixels belonging to the same pixel are arranged in this order in a row in the row direction and blue and yellow subpixels belonging to that pixel are arranged in this order in an adjacent row in the row direction. Look at the arrangement of subpixels in the column direction, and it can be seen that red and blue subpixels are arranged alternately and green and yellow subpixels are also arranged alternately. As shown in FIG. 50(*b*), in this liquid crystal display device 100F1, the luminances are controlled by using, as a unit, two blue subpixels belonging to two pixels that are adjacent to each other in the row direction so that bright blue subpixels are diagonally adjacent to each other.

In the multi-primary-color display panels 200F and 200F1 shown in FIGS. 48 and 50, each pixel consists of red, green, blue and yellow subpixels. However, this is only an example of the present invention. Alternatively, each pixel may include a white subpixel instead of the yellow subpixel. It should be noted that those four subpixels do not always have to be arranged in that order. Nevertheless, at least the subpixels that need to have their grayscale levels corrected (e.g., blue subpixels in this preferred embodiment) are preferably arranged at regular intervals over multiple pixels.

In the multi-primary-color display panels 200F and 200F1 described above, a single pixel is supposed to consist of four subpixels. However, the present invention is in no way limited to that specific preferred embodiment. Optionally, in another multi-primary-color display panel, each pixel may also consist of six subpixels.

Figure 51:
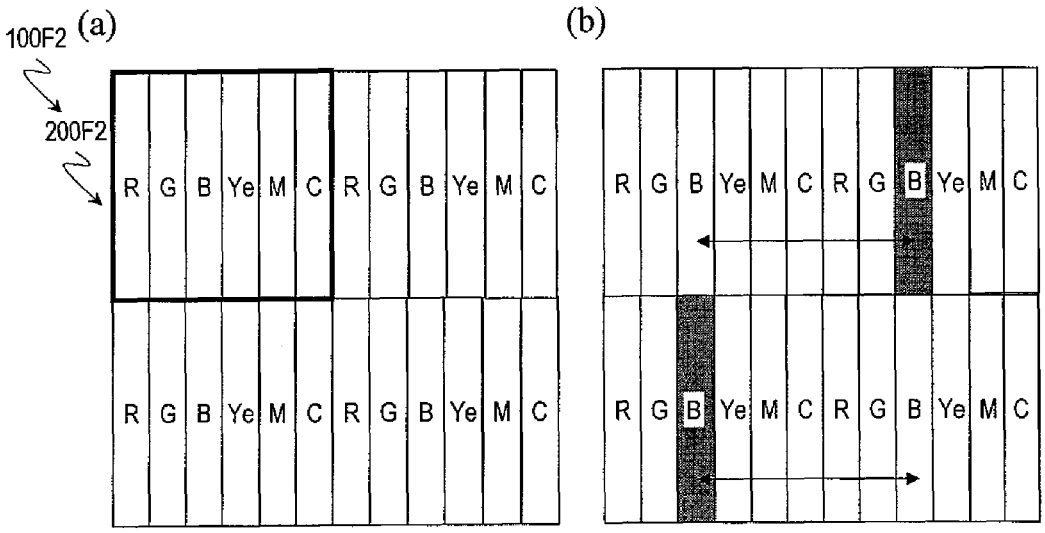
FIG. 51(*a*) is a schematic representation illustrating how subpixels may be arranged in the multi-primary-color display panel of a liquid crystal display device as another modified example of the sixth preferred embodiment and FIG. 51(*b*) is a schematic representation illustrating where blue subpixels, of which the luminances need to be controlled, are located with respect to bright blue subpixels.

FIG. 51(*a*) is a schematic representation illustrating such a multi-primary-color display panel 200F2. In the multi-primary-color display panel 200F2, each pixel consists of red (R), green (G), blue (B), yellow (Ye), cyan (C) and magenta (M) subpixels. Although not shown in FIG. 51(*a*), the correcting section 300F preferably includes not only the red, green, blue and yellow correcting sections 300*r*, 300*g*, 300*b* and 300*ye* but also cyan and magenta correcting sections 300*c* and 300*m* as well. In the multi-primary-color display panel 200F2, the red, green, blue, yellow, magenta and cyan subpixels belonging to the same pixel are arranged in this order in the row direction and subpixels representing the same color are arranged in the column direction.

In FIG. 51(*a*), subpixels to represent the same color are arranged in the column direction. However, the present invention is in no way limited to that specific preferred embodiment. Alternatively, subpixels representing mutually different colors may also be arranged in the column direction. In that case, using two blue subpixels belonging to two pixels that are adjacent to each other in the column direction as a unit, the luminances may be controlled so that bright blue subpixels are arranged in the row direction. Consequently, it is possible to prevent the bright blue subpixels from being arranged unevenly and a substantial decrease in the resolution of the color blue can be minimized. For example, red, green, magenta, cyan, blue and yellow subpixels belonging to one pixel may be arranged in this order in a row and cyan, blue, yellow, red, green and magenta subpixels belonging to another pixel may be arranged in this order in the next adjacent row.

Also, in the multi-primary-color display panel 200F2 shown in FIG. 51, subpixels belonging to a single pixel are arranged in a row. However, this is just an example of the present invention. Alternatively, subpixels belonging to a single pixel may also be arranged in multiple rows.

Figure 52:
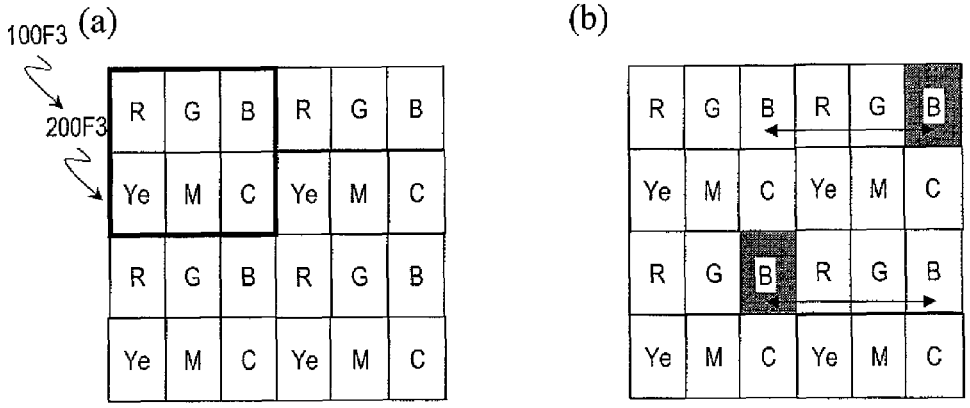
FIG. 52(*a*) is a schematic representation illustrating how subpixels may be arranged in the multi-primary-color display panel of a liquid crystal display device as still another modified example of the sixth preferred embodiment and FIG. 52(*b*) is a schematic representation illustrating where blue subpixels, of which the luminances need to be controlled, are located with respect to bright blue subpixels.

FIG. 52(*a*) is a schematic representation illustrating a multi-primary-color display panel 200F3 for a liquid crystal display device 100F3. In this multi-primary-color display panel 200F3, subpixels included in a single pixel are arranged in three columns and two rows. Specifically, red, green and blue subpixels belonging to the same pixel are arranged in this order in a row in the row direction and yellow, magenta and cyan subpixels belonging to that pixel are arranged in this order in an adjacent row in the row direction. Look at the arrangement of subpixels in the column direction, and it can be seen that red and yellow subpixels are arranged alternately, green and magenta subpixels are arranged alternately, and blue and cyan subpixels are also arranged alternately. Alternatively, red and cyan subpixels may be arranged alternately, green and magenta subpixels may be arranged alternately, and blue and yellow subpixels may be arranged alternately.

As shown in FIG. 52(*b*), in this liquid crystal display device 100F3, the luminances are controlled by using, as a unit, two blue subpixels belonging to two pixels that are adjacent to each other in the row direction so that bright and dark blue subpixels alternate with each other in the row direction.

It should be noted that those six subpixels do not always have to be arranged in that order. Nevertheless, at least the subpixels that need to have their grayscale levels corrected (e.g., blue subpixels in this preferred embodiment) are preferably arranged at regular intervals over multiple pixels. Also, in the multi-primary-color display panels 200F2 and 200F3, each pixel consists of red, green, blue, yellow, cyan and magenta subpixels. However, this is just an example of the present invention. Alternatively, each pixel may also consist of first red, green, blue, yellow, cyan and second red subpixels.

Furthermore, in the preferred embodiments described above, each of the correcting sections 300B, 300C, 300D, 300E and 300F is supposed to include red, green, blue, yellow, cyan, and/or magenta correcting sections 300*r*, 300*g*, 300*b*, 300*ye*, 300*c* and 300*m*. However, this is only an example of the present invention. As already described with reference to FIG. 19, each of these correcting sections may include at least one of the red, green, blue, yellow, cyan, and/or magenta correcting sections 300*r*, 300*g*, 300*b*, 300*ye*, 300*c* and 300*m*.

Furthermore, in the preferred embodiments described above, the liquid crystal layer is supposed to be a vertical alignment liquid crystal layer. However, the present invention is in no way limited to those specific preferred embodiments. If necessary, a liquid crystal layer of any other mode may also be used.

The entire disclosures of Japanese Patent Applications Nos. 2008-335246 and 2009-132500, from which the present application claims priority, are hereby incorporated by reference.

INDUSTRIAL APPLICABILITY

The present invention provides a liquid crystal display device that can improve the viewing angle characteristic and minimize a decline in display quality.

REFERENCE SIGNS LIST

100 liquid crystal display device
200 LCD panel
300 correcting section

The invention claimed is:

1. A liquid crystal device comprising multiple pixels including first and second pixels that are arranged adjacent to each other, wherein each said pixel includes a number of subpixels including first, second and third subpixels, and wherein if an input signal indicates that each of the first and second pixels should represent a particular chromatic color, not only the third subpixel of at least one of the first and second pixels but also at least one of the respective first and second subpixels of the first and second pixels turn ON, and wherein if the average luminance of the respective third subpixels of the first and second pixels in one situation where the input signal indicates that each of the first and second pixels should represent the chromatic color is substantially equal to that of the respective third subpixels of the first and second pixels in another situation where the input signal indicates that each of the first and second pixels should represent an achromatic color, the luminances of the respective third subpixels of the first and second pixels in the former situation are different from those of the respective third subpixels of the first and second pixels in the latter situation.

2. The liquid crystal device of claim 1, wherein the first, second and third subpixels are red, green and blue subpixels, respectively.

3. The liquid crystal device of claim 1, wherein if the average luminance of the respective first subpixels of the first and second pixels in one situation where the input signal indicates that each of the first and second pixels should represent another chromatic color is equal to that of the respective first subpixels of the first and second pixels in another situation where the input signal indicates that each of the first and second pixels should represent an achromatic color, the luminances of the respective first subpixels of the first and second pixels in the former situation are different from those of the respective first subpixels of the first and second pixels in the latter situation.

4. The liquid crystal device of claim 1, wherein if the average luminance of the respective second subpixels of the first and second pixels in one situation where the input signal indicates that each of the first and second pixels should represent still another chromatic color is equal to that of the respective second subpixels of the first and second pixels in another situation where the input signal indicates that each of the first and second pixels should represent an achromatic color, the luminances of the respective second subpixels of the first and second pixels in the former situation are different from those of the respective second subpixels of the first and second pixels in the latter situation.

5. The liquid crystal device of claim 1, further comprising:

first, second and third subpixel electrodes that define the first, second and third subpixels, respectively; and source bus lines, which are provided for the first, second and third subpixel electrodes, respectively.

6. The liquid crystal device of claim 1, wherein each of the first, second and third subpixels has multiple regions that are able to have mutually different luminances.

7. The liquid crystal device of claim 6, further comprising:

first, second and third subpixel electrodes, which define the first, second and third subpixels, respectively, and each of which has divided electrodes that define the multiple regions;

source bus lines, which are provided for the first, second and third subpixel electrodes, respectively; and storage capacitor bus lines, which are provided for the respective divided electrodes of the first, second and third subpixel electrodes.

8. The liquid crystal device of claim 1, wherein either the input signal or a signal obtained by converting the input signal indicates the respective grayscale levels of the multiple subpixels that are included in each of the multiple pixels, and wherein the grayscale levels of the respective third subpixels of the first and second pixels, which are indicated by either the input signal or the converted signal, are corrected according to the hues of the first and second pixels that are also indicated by the input signal.

9. The liquid crystal device of claim 1, wherein either the input signal or a signal obtained by converting the input signal indicates the respective grayscale levels of the multiple subpixels that are included in each of the multiple pixels, and wherein the grayscale levels of the respective third subpixels of the first and second pixels, which are indicated by either the input signal or the converted signal, are corrected according to not only the hues of the first and second pixels that are also indicated by the input signal but also a difference in grayscale level between the respective third subpixels of the first and second pixels, which is also indicated by the input signal.

10. The liquid crystal device of claim 1, wherein if the input signal indicates that the third subpixel of one of the first and second pixels has a first grayscale level and that the third subpixel of the other pixel has either the first grayscale level or a second grayscale level, which is higher than the first grayscale level, then the luminances of the respective third subpixels of the first and second pixels are different from ones that are associated with the grayscale levels indicated by either the input signal or the signal obtained by converting the input signal, and wherein if the input signal indicates that the third subpixel of the one pixel has the first grayscale level and that the third subpixel of the other pixel has a third grayscale level, which is higher than the second grayscale level, then the luminances of the respective third subpixels of the first and second pixels are substantially equal to ones that are associated with the grayscale levels indicated by either the input signal or the signal obtained by converting the input signal.

11. A liquid crystal device comprising a pixel that has a number of subpixels including first, second and third subpixels, wherein each of the first, second and third subpixels has a number of regions including first and second regions that are able to have mutually different luminances, and wherein if an input signal indicates that the pixel should represent a particular chromatic color, not only at least one of the first and second regions of the third subpixel but also at least one of the respective first and second regions of the first and second subpixels turn ON, and wherein if the average luminance of the first and second regions of the third subpixel in one situation where the input signal indicates that the pixel should represent the chromatic color is equal to that of the first and second regions of the third subpixel in another situation where the input signal indicates that the pixel should represent an achromatic color, the respective luminances of the first and second regions of the third subpixel in the former situation are different from those of the first and second regions of the third subpixel in the latter situation.

12. The liquid crystal device of claim 11, wherein the first, second and third subpixels are red, green and blue subpixels, respectively.

13. The liquid crystal device of claim 11, further comprising:

first, second and third subpixel electrodes, which define the first, second and third subpixels, respectively, and each of which has first and second divided electrodes that define the first and second regions, respectively; and source bus lines, which are provided for the first and second divided electrodes of the first, second and third subpixel electrodes, respectively.

14. The liquid crystal device of claim 11, further comprising:

first, second and third subpixel electrodes, which define the first, second and third subpixels, respectively, and each of which has first and second divided electrodes that define the first and second regions, respectively;

source bus lines, which are provided for the first, second and third subpixel electrodes, respectively; and gate bus lines, which are provided for the respective first and second divided electrodes of the first, second and third subpixel electrodes.

15. A liquid crystal display device comprising multiple pixels that are arranged in columns and rows to form a matrix pattern, wherein the multiple pixels include first, second, third and fourth pixels, which are arranged in this order along either one of the columns or one of the rows, and wherein each of the pixels has a number of subpixels including first, second and third subpixels, and wherein if an input signal indicates that each of the first and third pixels should represent a particular chromatic color, not only the third subpixel of at least one of the first and third pixels but also at least one of the respective first and second subpixels of the first and third pixels turn ON, and wherein if the average luminance of the respective third subpixels of the first and third pixels in one situation where the input signal indicates that the first and third pixels should represent the chromatic color is substantially equal to that of the respective third subpixels of the first and third pixels in another situation where the input signal indicates that the first and third pixels should represent an achromatic color, the luminances of the respective third subpixels of the first and third pixels in the former situation are different from those of the respective third subpixels of the first and third pixels in the latter situation.

16. The liquid crystal device of claim 15, wherein the luminance of the respective third subpixels of the second and fourth pixels is substantially equal to a one that is associated with a grayscale level indicated by either the input signal or a signal obtained by converting the input signal.

* * * * *